US005304463A

United States Patent [19]

Sato et al.

[11] Patent Number: 5,304,463

[45] Date of Patent: Apr. 19, 1994

[54] SILVER HALIDE COLOR PHOTOGRAPHIC MATERIAL

[75] Inventors: Takehiko Sato; Nobuo Seto, both of Minami-ashigara, Japan

[73] Assignee: Fuji Photo Film Co., Ltd., Kanagawa, Japan

[21] Appl. No.: 889,374

[22] Filed: May 28, 1992

[30] Foreign Application Priority Data

May 28, 1991 [JP] Japan ..... 3-152346

[51] Int. Cl.[5] ..... G03C 1/46

[52] U.S. Cl. ..... 430/503; 430/557; 430/551; 430/372; 430/607; 430/546

[58] Field of Search ..... 430/503, 557, 551, 607, 430/546, 372

[56] References Cited

U.S. PATENT DOCUMENTS

| | | | |
|---|---|---|---|
| 4,149,886 | 4/1979 | Tanaka et al. | 430/557 |
| 4,248,961 | 2/1981 | Hagen et al. | 430/557 |
| 4,289,847 | 9/1981 | Ishikawa et al. | 430/557 |
| 4,933,271 | 6/1990 | Rody et al. | 430/551 |
| 5,091,294 | 2/1992 | Nishijima et al. | 430/551 |

FOREIGN PATENT DOCUMENTS

| | | |
|---|---|---|
| 447920A1 | 9/1991 | European Pat. Off. . |
| 1204680 | 9/1970 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material having photosensitive layers and non-photosensitive layers adjacent to photosensitive layers on a base, which comprises a yellow dye-forming coupler selected from a group consisting of couplers represented by formulas (I), (II), and (III) and a compound represented by the following formula (IV):

Formula (I)

wherein $R_1$ represents a monovalent group, Q represents a group of non-metallic atoms required to form together with the C a cyclic hydrocarbon group or a heterocyclic group that has a heteroatom of N, S, O, or P, and $Y_R$ represents a residue remaining after removing the acyl group from the coupler represented by formula (I), provided that $R_1$ is not a hydrogen atom and does not bond to Q to form a ring, Formula (II)

Formula (III)

wherein $X^1$, and $X^2$ each represent an alkyl group, an aryl group, or a heterocyclic group, $X^3$ represents an organic residue required to form a nitrogen-containing heterocyclic group together with the >N—, Y represents an aryl group or a heterocyclic group, and Z represents a coupling releasing group, Formula (IV)

wherein $R_{41}$ represents a hydrogen atom, an alkyl group, an aryl group, an alkenyl group, or a heterocyclic group; $R_{42}$ represents an alkyl group, an aryl group, an alkenyl group, or a heterocyclic group, and n is an integer of 0 to 4, provided that $R_{41}$ and $R_{42}$ may together form a 5- to 7-membered ring.

25 Claims, No Drawings

SILVER HALIDE COLOR PHOTOGRAPHIC MATERIAL

FIELD OF THE INVENTION

The present invention relates to a multilayer silver halide color photographic material, and more particularly to a multilayer silver halide color photographic material (hereinafter referred to as a photographic material) containing a new combination of couplers, which color photographic material is good in color-forming property, is improved in image preservability, and does not lose color balance.

BACKGROUND OF THE INVENTION

Silver halide color photographic materials have a multilayer constitution comprising photosensitive layers, which are three silver halide emulsion layers selectively sensitized so as to have sensitivities to blue light, green light, and red light, and which are coated on a base. For example, in the case of so-called color photographic print papers (hereinafter referred to as color papers), a cyan color-forming emulsion layer, a magenta color-forming emulsion layer, and a yellow color-forming emulsion layer are coated, generally in the stated order with the cyan color-forming emulsion layer being nearer to the exposure side, and a color-mix-inhibiting-intermediate layer, an ultraviolet-absorbing layer, a protective layer, and the like are provided between these photosensitive layers.

In so-called color positive films, a magenta color-forming emulsion layer, a cyan color-forming emulsion layer, and a yellow color-forming emulsion layer are coated, generally in the stated order with the magenta-color forming emulsion layer being far from the base, i.e., nearer to the exposure side. In color negative films the arrangement of layers is varied, and even though a cyan color-forming emulsion layer, a magenta color-forming emulsion layer, and a yellow color-forming emulsion layer are generally coated, in the stated order with the cyan color-forming emulsion layer being nearer to the exposure side, in the case of photographic materials having two or more emulsion layers having the same color sensitivity and different in sensitivity, some photographic materials have such emulsion layers with an emulsion layer different in color sensitivity between them, wherein, for example, a bleachable yellow filter layer, an intermediate layer, and a protective layer are inserted.

In order to form a color photographic image, three color photographic couplers, i.e., yellow, magenta, and cyan photographic couplers, are contained in photosensitive layers, and the exposed photographic material is subjected to color development processing with a so-called color-developing agent. The oxidized product of an aromatic primary amine causes a coupling reaction with the couplers to form color-formed dyes, and preferably the couplers are such couplers wherein the coupling speeds are as high as possible and the color-forming property is good so as to give high color densities within a limited developing time. Further, all of the color formed dyes are required to be bright cyan, magenta, and yellow dyes with less subsidiary absorption in order to give a color photographic image good in color reproduction.

On the other hand, the formed color photographic image is required to be good in preservability under various conditions. To satisfy this requirement, it is important that fading or discoloration speed of each of the different color-formed dyes is slow and the speed of fading is uniform throughout the image density as much as possible, so that the color balance of the remaining dye image remains unchanged.

Conventionally, in photographic materials, particularly in color papers, deterioration of the yellow dye image owing to long-term dark-fading by humidity and heat is considerable, which is liable to cause a change in the color balance, and therefore an improvement is desired.

In photographic materials in which dark-fading is significantly prevented, however, conventionally color-forming property is unsatisfactory, and therefore a new combination of couplers good in color reproduction and outstanding in image preservability is desired.

To solve these problems in part, various yellow couplers, and their combinations have been suggested conventionally. Examples are described, for example, in JP-A ("JP-A" means unexamined published Japanese patent application) Nos. 20037/1982, 57236/1984, 208745/1983, 205446/1985, 117249/1985, 229029/1985, 222852/1985, 50136/1986, 160143/1984, 120147/1986, 4047/1986, 239149/1987, 240965/1987, 254149/1987, and 300748/1990, and in JP-B ("JP-B" means examined Japanese patent publication) No. 7344/1987.

However, these couplers and combinations do not bring about sufficient color-forming property of the yellow coupler, and because fading in the yellow dye section resulting from deterioration due to light or heat is considerable, a change in color balance occurs and therefore the overall problems have not yet been overcome satisfactorily.

SUMMARY OF THE INVENTION

The present invention is intended to solve the above problems simultaneously. More specifically, the object of the present invention is to provide a multilayer silver halide color photographic material that is good in color-forming property, that is improved in image preservability, and that can keep color balance for a long period of time in dark as well as under light.

Other and further objects, features, and advantages of the invention will appear more fully from the following description.

DETAILED DESCRIPTION OF THE INVENTION

The object of the present invention has been attained by the following photographic material:

A silver halide color photographic material having photosensitive layers of yellow color-forming layer, magenta color-forming layer, and cyan color-forming layer, and non-photosensitive layers adjacent to said photosensitive layers on a base, which comprises, in the said yellow color-forming photosensitive layer, at least one coupler selected from an acylacetamide yellow dye-forming coupler represented by the following formula (I), a yellow dye-forming coupler represented by the following formula (II), and a yellow dye-forming coupler represented by the following formula (III), and in at least one layer selected from yellow color-forming photosensitive layers and non-photosensitive layers adjacent thereto, at least one compound represented by the following formula (IV):

Formula (I)

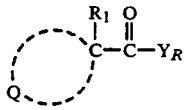

wherein $R_1$ represents a monovalent group, Q represents a group of non-metallic atoms required to form together with the C (carbon atom) a substituted or unsubstituted 3- to 5-membered cyclic hydrocarbon group or a substituted or unsubstituted 3- to 5-membered heterocyclic group that has in the group at least one heteroatom selected from a group consisting of N, S, O, and P, and $Y_R$ represents a residue remaining after removing the acyl group

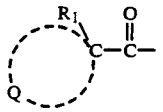

at the α position of the acetamide moiety from the acylacetamide yellow dye-forming coupler represented by formula (I), provided that $R_1$ is not a hydrogen atom and does not bond to Q to form a ring, Formula (II)

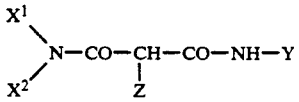

Formula (III)

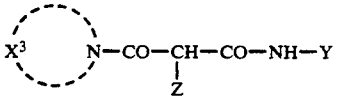

wherein $X^1$ and $X^2$ each represent an alkyl group, an aryl group, or a heterocyclic group, $X^3$ represents an organic residue required to form a nitrogen-containing heterocyclic group together with the >N—, Y represents an aryl group or a heterocyclic group, and Z represents a group capable of being released upon a coupling reaction of the coupler represented by said formula with the oxidized product of a developing agent, Formula (IV)

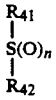

wherein $R_{41}$ represents a hydrogen atom, a substituted or unsubstituted alkyl group, a substituted or unsubstituted aryl group, a substituted or unsubstituted alkenyl group, or a substituted or unsubstituted heterocyclic group; $R_{42}$ represents a substituted or unsubstituted alkyl group, a substituted or unsubstituted aryl group, a substituted or unsubstituted alkenyl group, or a substituted or unsubstituted heterocyclic group, and n is an integer of 0 to 4, provided that $R_{41}$ and $R_{42}$ may together form a 5- to 7-membered ring.

Formula (I) will now be described in detail.

The acylacetamide yellow coupler of the present invention is preferably represented by the following formula (I-A):

Formula (I-A)

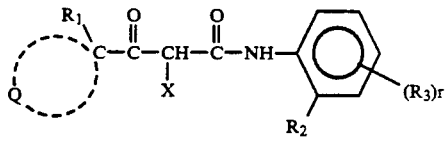

In formula (I-A), $R_1$ represents a monovalent group other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, S, O, and P; $R_2$ represents a hydrogen atom, a halogen atom (e.g., F, Cl, Br, and I, which is applied hereinafter to the description of formula (I-A)), an alkoxy group, an aryloxy group, an alkyl group, or an amino group; $R_3$ represents a group capable of substitution onto a benzene ring, X represents a hydrogen atom or a group capable of being released upon a coupling reaction thereof with the oxidized product of an aromatic primary amine developing agent (hereinafter referred to as coupling releasing group), r is an integer of 0 to 4, and when r is 2 or more, the $R_3$ groups may be the same or different.

In formula (I), $Y_R$ represents a residue remaining after removing the acyl group

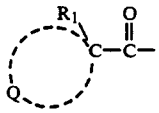

at the α position of the acetamide moiety from the acylacetamide yellow dye-forming coupler represented by formula (I). In other words, $Y_R$ represents the remaining portion of formula (I) that does not correspond to the acyl group referred to above. Preferably $Y_R$ represents the following residue as shown in formula (I-A)

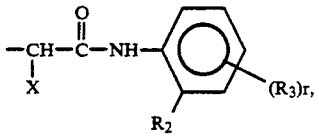

wherein the substituents are as defined in formula (I-A). $Y_R$ may also be represented by the corresponding residues as shown in publications.

When any of the substituents in formula (I-A) is an alkyl group or contains an alkyl group, unless otherwise specified, the alkyl group means a straight-chain, branched-chain, or cyclic alkyl group, which may be substituted and/or unsaturated (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl).

When any of the substituents in formula (I-A) is an aryl group or contains an aryl group, unless otherwise specified, the aryl group means a monocyclic or condensed cyclic aryl group, which may be substituted, containing (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl).

When any of the substituents in formula (I-A) is a heterocyclic group or contains a heterocyclic group, unless otherwise specified, the heterocyclic group means a 3- to 8-membered monocyclic or condensed ring heterocyclic group that contains at least one heteroatom selected from the group consisting of O, N, S, P, Se, and Te (e.g., 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedion-3-yl).

Substituents preferably used in formula (I-A) will now be described below.

In formula (I-A), preferably $R_1$ represents a halogen atom, a cyano group, a monovalent aliphatic-type group that may be substituted and has a total number of carbon atoms (hereinafter abbreviated to a C-number) of 1 to 30 (e.g., alkyl and alkoxy) or a monovalent aryl-type group that may be substituted and has a C-number of 6 to 30 (e.g., aryl and aryloxy), whose substituent includes, for example, a halogen atom, an alkyl group, an alkoxy group, a nitro group, an amino group, a carbonamido group, a sulfonamido group, and an acyl group.

In formula (I-A), Q preferably represents a group of non-metallic atoms required to form together with the C a substituted or unsubstituted 3- to 5-membered hydrocarbon ring having a C-number of 3 to 30 or a substituted or unsubstituted 3- to 5-membered heterocyclic ring moiety having a C-number of 2 to 30 and in the group at least one heteroatom selected from a group consisting of N, S, O, and P. The ring formed by Q together with the C may have an unsaturated bond in the ring. Examples of the ring formed by Q together with the C include a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of the substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (I-A), $R_2$ preferably represents a halogen atom, an alkoxy group that may be substituted and has a C-number of 1 to 30, an aryloxy group that may be substituted and has a C-number of 6 to 30, an alkyl group that may be substituted and has a C-number of 1 to 30, or an amino group that may be substituted and has a C-number of 0 to 30, and the substituent includes, for example, a halogen atom, an alkyl group, an alkoxy group, and an aryloxy group.

Examples of $R_3$ in formula (I-A) include a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group (as defined above), a cyano group, an acyl group, an acyloxy group, an alkylsulfonyloxy group, and an arylsulfonyloxy group; and examples of the coupling releasing group include a heterocyclic group (as defined above) bonded to the coupling active site through the nitrogen atom, an aryloxy group, an arylthio group, an acyloxy group, an alkylsulfonyloxy group, an arylsulfoxyloxy group, a heterocyclic oxy group (wherein heterocyclic is as defined above), and a halogen atom.

In formula (I-A), $R_3$ represents a halogen atom, an alkyl group that may be substituted and has a C-number of 1 to 30, an aryl group that may be substituted and has a C-number of 6 to 30, an alkoxy group that may be substituted and has a C-number of 1 to 30, an alkoxycarbonyl group that may be substituted and has a C-number of 2 to 30, an aryloxycarbonyl group that may be substituted and has a C-number of 7 to 30, a carbonamido group that may be substituted and has a C-number of 1 to 30, a sulfonamido group that may be substituted and has a C-number of 1 to 30, a carbamoyl group that may be substituted and has a C-number of 1 to 30, a sulfamoyl group that may be substituted and has a C-number of 0 to 30, an alkylsulfonyl group that may be substituted and has a C- number of 1 to 30, a ureido group that may be substituted and has a C-number of 1 to 30, a sulfamoylamino group that may be substituted and has a C-number of 0 to 30, an alkoxycarbonylamino group that may be substituted and has a C-number of 2 to 30, a heterocyclic group that may be substituted and has a C-number of 1 to 30, an acyl group that may be substituted and has a C-number of 1 to 30, an alkylsulfonyloxy group that may be substituted and has a C-number of 1 to 30, and an arylsulfonyloxy group that may be substituted and has a C-number of 6 to 30; and examples of substituent include a halogen atom, an alkyl group, an aryl group, a heterocyclic group, an alkoxy group, an aryloxy group, a hetrocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (I-A), r is preferably an integer of 1 or 2, and the position of the substitution of $R_3$ is preferably the meta-position or para-position to

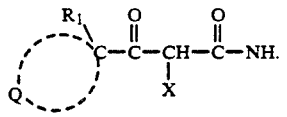

In formula (I-A), X preferably represents a heterocyclic group bonded to the coupling active site through the nitrogen atom or an aryloxy group.

When X represents a heterocyclic group, X is preferably a 5- to 7-membered monocyclic group or condensed ring that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine -2-one, benzoxazolidine-2-one, benzothiazoline-2-one, 2-pyrroline- 5-one, 2-imidazoline-5-one, indoline-2,3-dione, 2,6-dioxypurine, parabanic acid, 1,2,4-triazolidine-3,5 -dione, 2-pyridone, 4-pyridone, 2-pyrimidone, 6-pyridazone-2-pyrazone, 2-amino-1,3,4-thiazolidine, 2-imino-1,3,4-thiazolidine-4-one, and the like, any of which heterocyclic rings may be substituted. Examples of the substituent on the heterocyclic group include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When X represents an aryloxy group, preferably X represents an aryloxy group having 6 to 30 carbon atoms, and when X is a heterocyclic group, it may be substituted by a group selected from the group consisting of those substituents mentioned in the case wherein X represents a heterocyclic group. A preferable substituent on the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Now, substituents which are particularly preferably used in formula (I-A) will be described.

$R_1$ is particularly preferably a halogen atom or an alkyl group, most preferably an ethyl group. Q particularly preferably represents a group of non-metallic atoms which form together with the C a 3- to 5-membered cyclic hydrocarbon group, such as $[C(R)_2]_2$—, —$[C(R)_2]_3$—, and —$[C(R)_2]_4$— wherein R represents a hydrogen atom, a halogen atom, or an alkyl group, the R groups may be the same or different, and $C(R)_2$ groups may be the same or different.

Most preferably Q represents —$[C(R)_2]_2$— which forms a 3-membered ring together with the C bonded thereto.

Particularly preferably $R_2$ represents a chlorine atom, a fluorine atom, an alkyl group having a C-number of 1 to 6 (e.g., methyl, trifluoromethyl, ethyl, isopropyl, and t-butyl), an alkoxy group having a C-number of 1 to 8 (e.g., methoxy, ethoxy, methoxyethoxy, and butoxy), or an aryloxy group having a C-number of 6 to 24 (e.g., phenoxy, p-tolyloxy, and p-methoxyphenoxy), most preferably a chlorine atom, a methoxy group, or a trifluoromethyl group.

Particularly preferably $R_3$ represents a halogen atom, an alkoxy group, an alkoxycarbonyl group, an aryloxycarbonyl group, a carbonamido group, a sulfonamido group, a carbamoyl group, or a sulfamoyl group, most preferably an alkoxy group, an alkoxycarbonyl group, a carbonamido group, or a sulfonamido group.

Particularly preferably X is a group represented by the following formula (I-1), (I-2), or (I-3):

Formula (I-1)

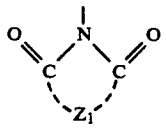

In formula (I-1), $Z_1$ represents —O—$CR_4(R_5)$—, —S—$CR_4(R_5)$—, —$NR_6$—$CR_4(R_5)$—, —$NR_6$—$NR_7$—, —$NR_6$—C(O)—, —$CR_4(R)_5$—$CR_8(R_9)$— or —$CR_{10}$=$CR_{11}$—.

Herein $R_4$, $R_5$, $R_8$, and $R_9$ each represent a hydrogen atom, an alkyl group, an aryl group, an alkoxy group, an aryloxy group, an alkylthio group, an arylthio group, an alkylsulfonyl group, an arylsulfonyl group, or an amino group. $R_6$ and $R_7$ each represent a hydrogen atom, an alkyl group, an aryl group, an alkylsulfonyl group, an arylsulfonyl group, or an alkoxycarbonyl group, and $R_{10}$ and $R_{11}$ each represent a hydrogen atom, an alkyl group, or an aryl group. $R_{10}$ and $R_{11}$ may bond together to form a benzene ring. $R_4$ and $R_5$, $R_5$ and $R_6$, $R_6$ and $R_7$, or $R_4$ and $R_8$ may bond together to form a ring (e.g., cyclobutane, cyclohexane, cycloheptane, cyclohexene, pyrrolidine, and piperidine).

Out of the heterocyclic groups represented by formula (I-1), particularly preferable ones are those wherein Z represents —O—$CR_4(R_5)$—, $NR_6$—$CR_4(R_5)$—, or —$NR_6$—$NR_7$—. The number of carbon atoms in the heterocyclic group represented by formula (I-1) is 2 to 30, preferably 4 to 20, and more preferably 5 to 16.

Formula (I-2)

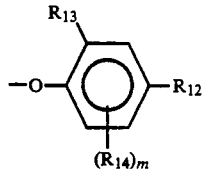

In formula (I-2), at least one of $R_{12}$ and $R_{13}$ is a group selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, and an acyl group, and the other may be a hydrogen atom, an alkyl group, or an alkoxy group. $R_{14}$ has the same meaning as $R_{12}$ or $R_{13}$, and m is an integer of 0 to 2. The number of carbon atoms of the aryloxy group represented by formula (I-2) is 6 to 30, preferably 6 to 24, and more preferably 6 to 15.

Formula (I-3)

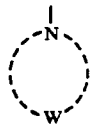

In formula (I-3), W represents a group of nonmetallic atoms required to form together with the N a pyrrole ring, a pyrazole ring, an imidazole ring, or a triazole ring. Herein the ring represented by formula (I-3) may be substituted, and a preferable example of the substituent is a halogen atom, a nitro group, a cyano group, an alkoxycarbonyl group, an alkyl group, an aryl group, an amino group, an alkoxy group, an aryloxyl group, or a carbamoyl group. The number of carbon atoms of the heterocyclic group represented by formula (I-3) is 2 to 30, preferably 2 to 24, and more preferably 2 to 16.

Most preferably X is a group represented by formula (I-1).

The coupler represented by formula (I-A) may form a dimer or more higher polymer by bonding through a divalent or higher polyvalent group at the substituent $R_1$, Q, X or

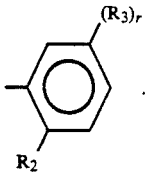
In this case, the number of carbon atoms in the substituents stated above may fall outside the specified ranges.
Specific examples of each of the substituents in formula (I-A) are given below:
(1) Examples of the
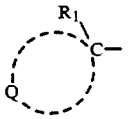
group formed by $R_1$ and Q with C are shown below.
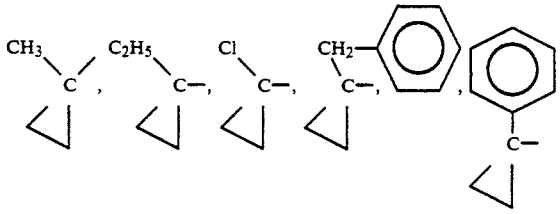
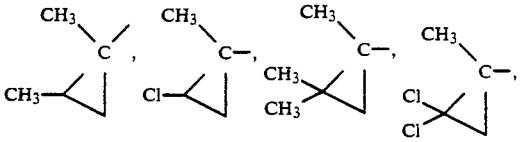
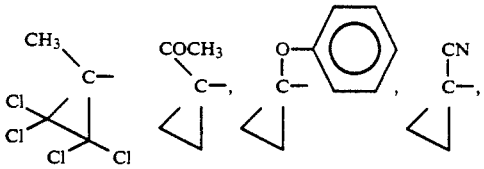
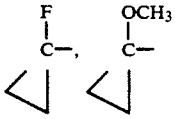
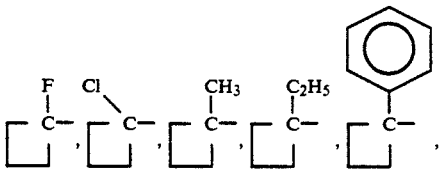
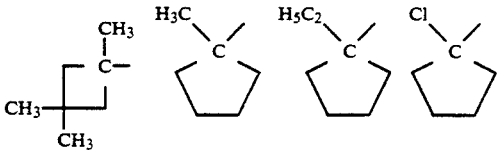
-continued
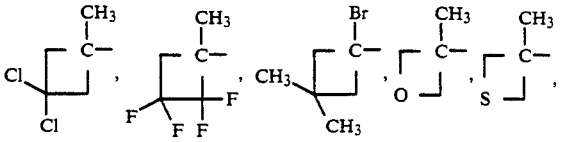
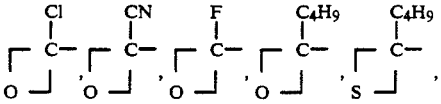
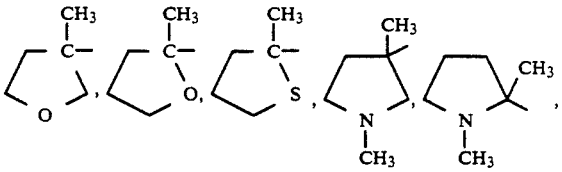
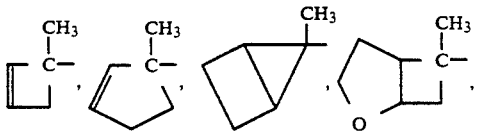
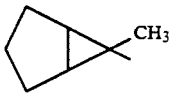
(2) Examples of $R_2$
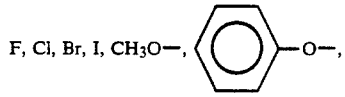
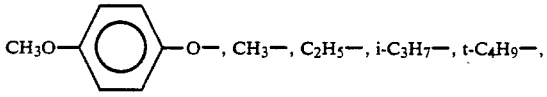
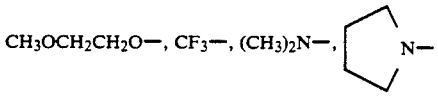
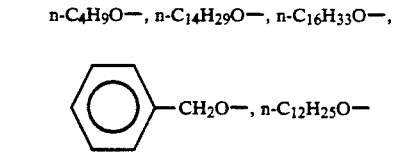
(3) Examples of $R_3$
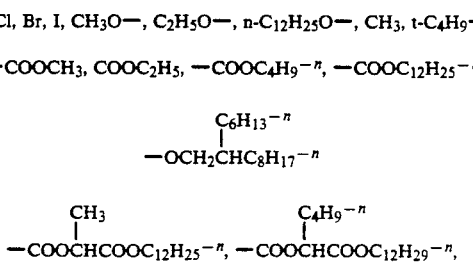

-continued
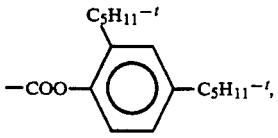
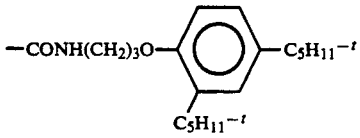
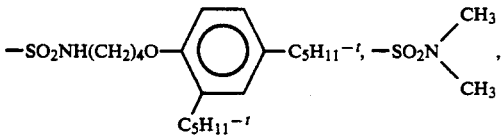
$-SO_2NHCOC_2H_5$, $-SO_2NHC_{15}H_{33}{}^{-n}$, $-NHCOC_{13}H_{27}{}^{-n}$,
$-NHCOC_{15}H_{31}{}^{-n}$, $-NHCOC_{17}H_{35}{}^{-n}$ $-NHCOCH(C_5H_{13}{}^{-n})-C_8H_{17}{}^{-n}$,
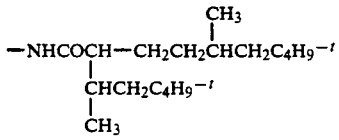
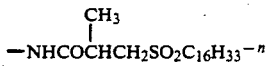
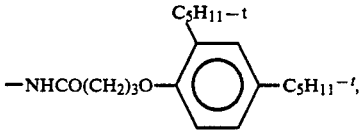
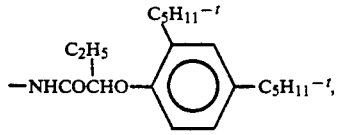
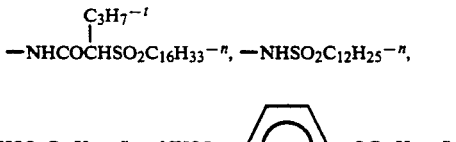
$-NHCOCHSO_2C_{16}H_{33}{}^{-n}$, $-NHSO_2C_{12}H_{25}{}^{-n}$,
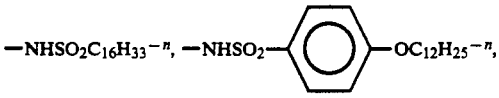
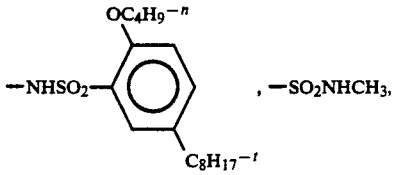
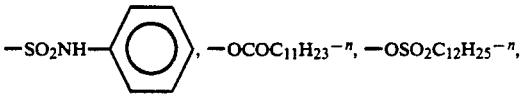
-continued
$-NHCOOC_{12}H_{25}{}^{-n}$,
(4) Examples of X
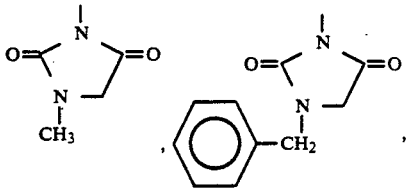
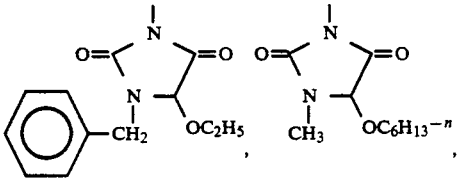
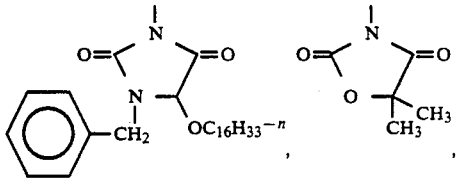
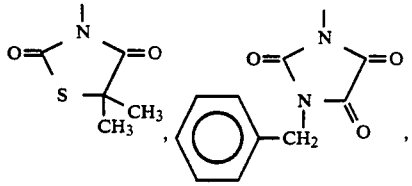
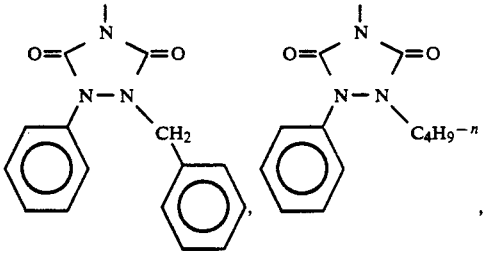
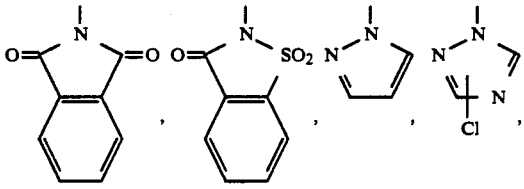
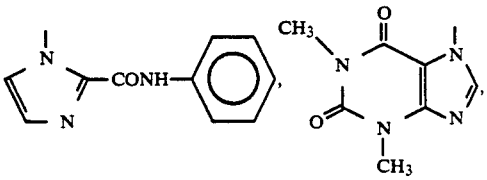

-continued
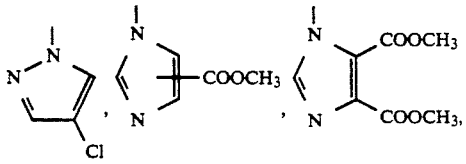
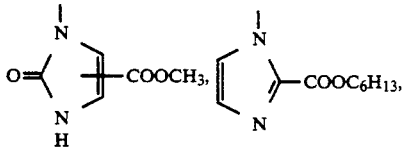
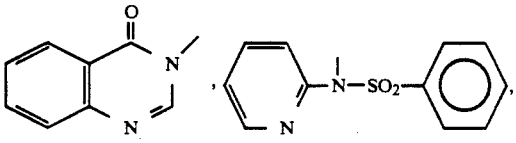
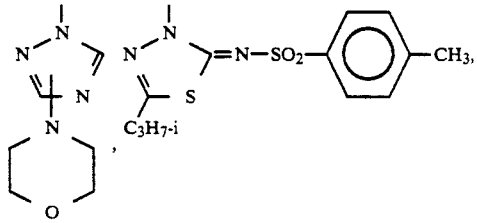
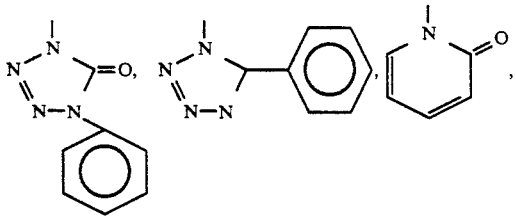
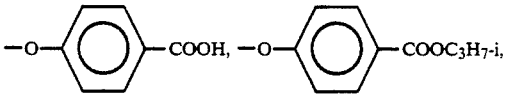
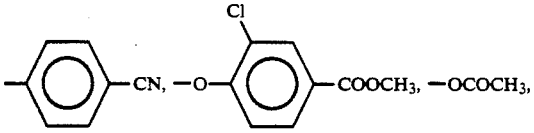
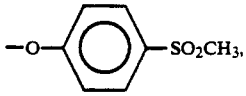
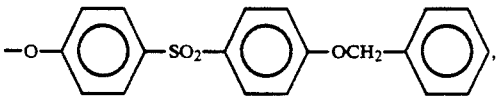
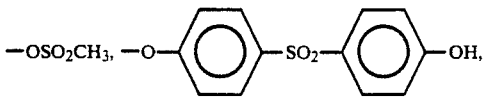
-continued
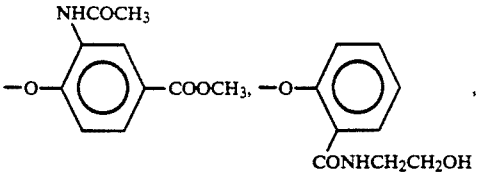
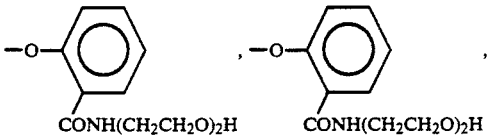
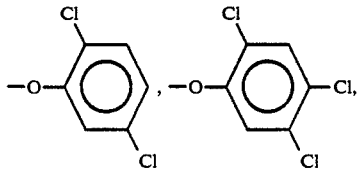
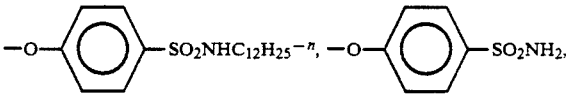
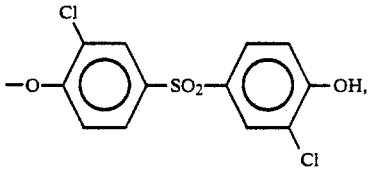
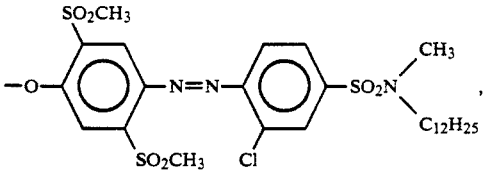
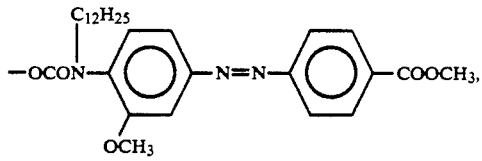
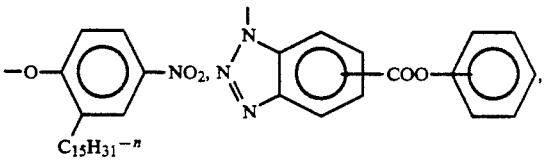
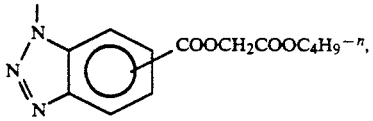

-continued
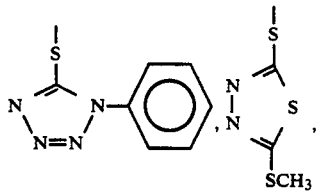
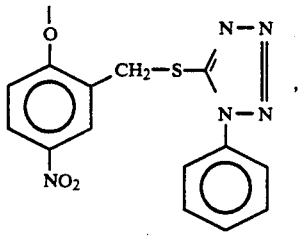
-continued
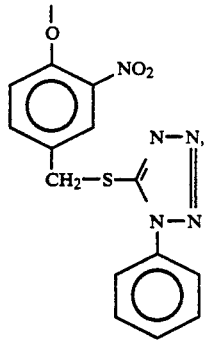
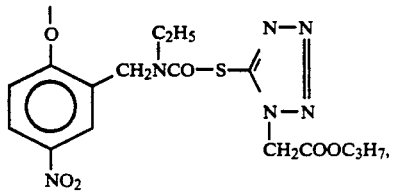
Exemplified yellow couplers represented by (I-A) are shown below.
Y-1
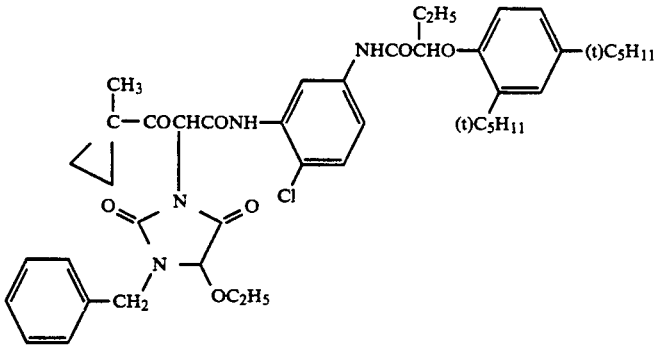
Y-2
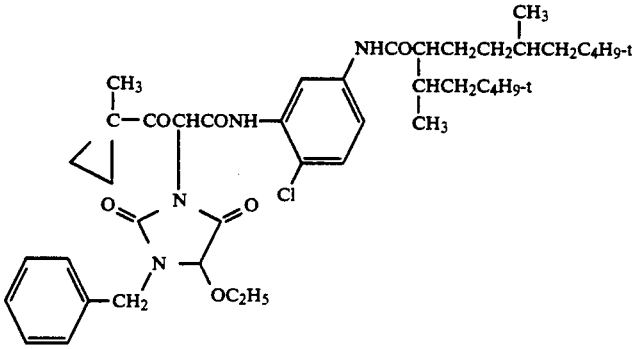

-continued
Y-3
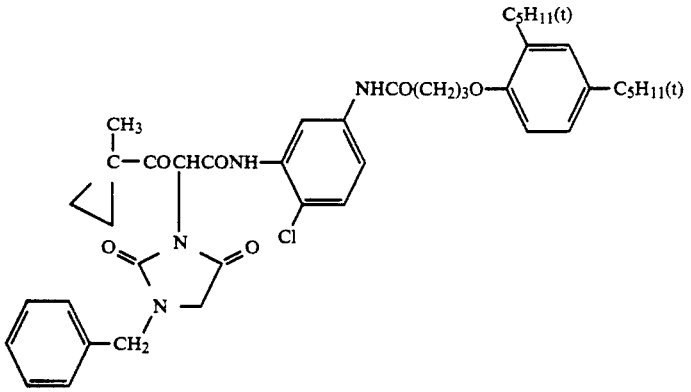
Y-4
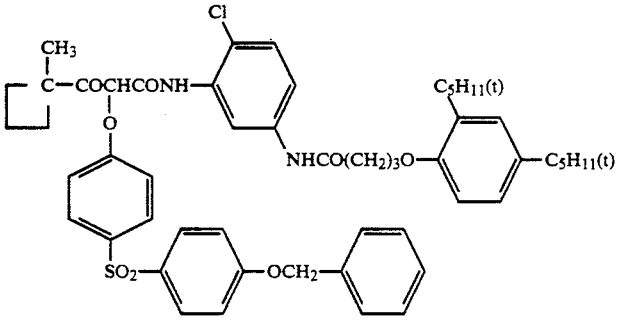
Y-5
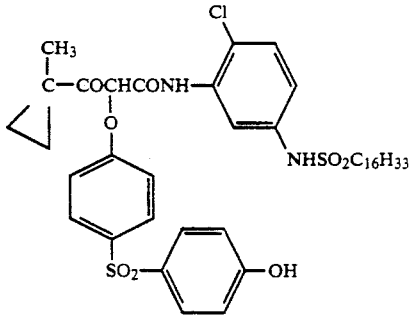
Y-6
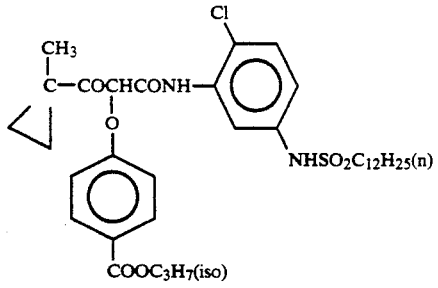
Y-7
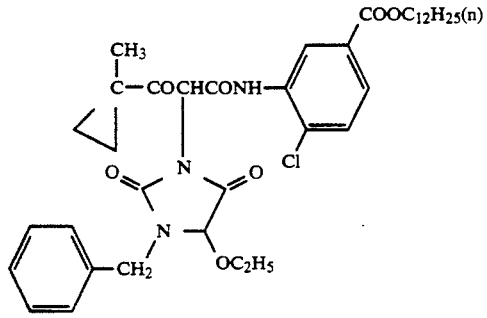

-continued
Y-8
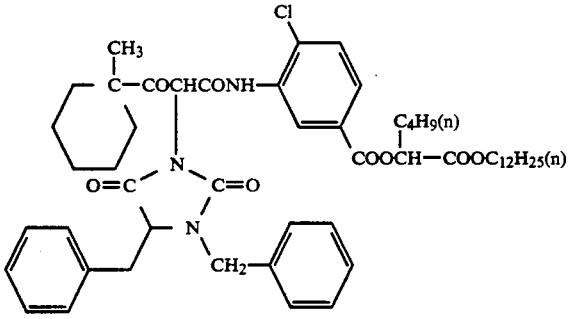
Y-9
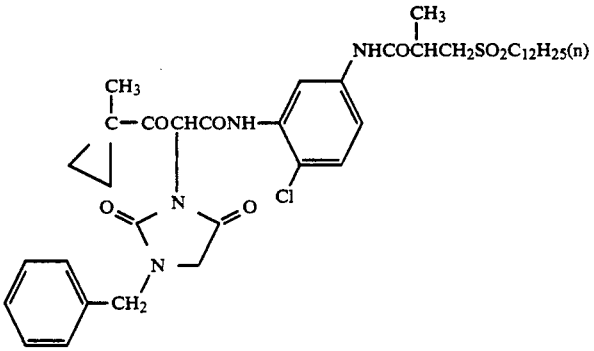
Y-10
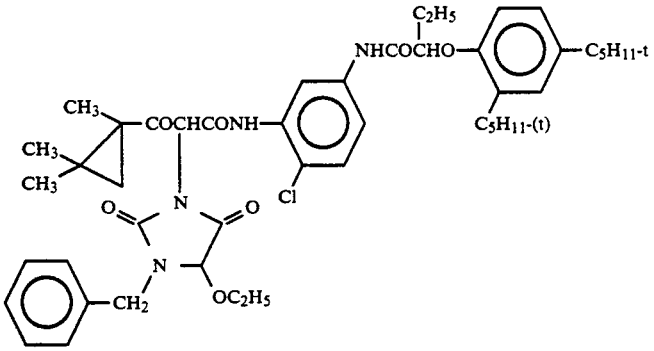
Y-11
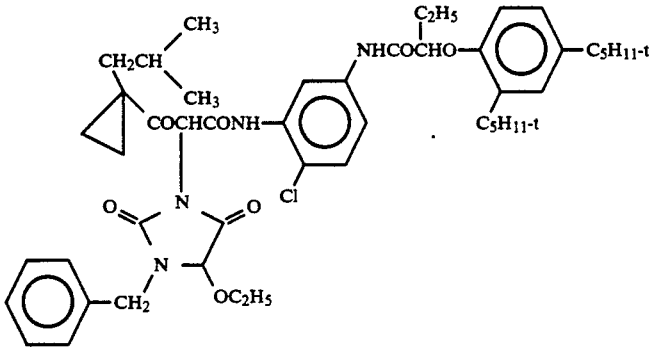

-continued
Y-12
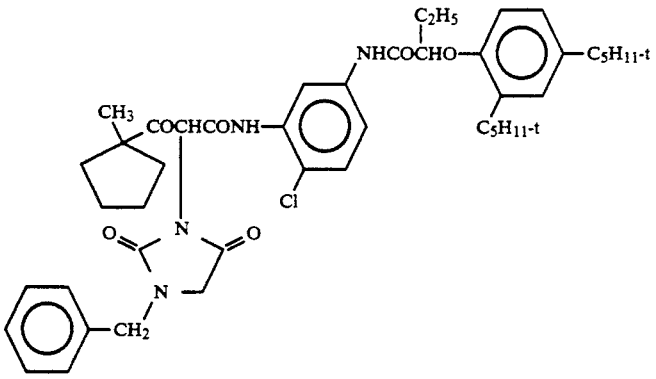
Y-13
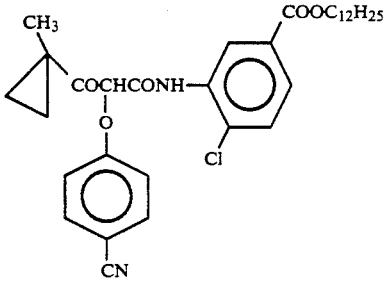
Y-14
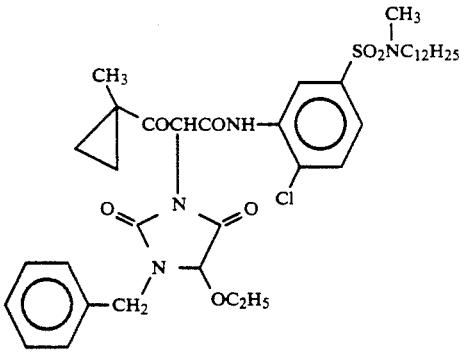
Y-15
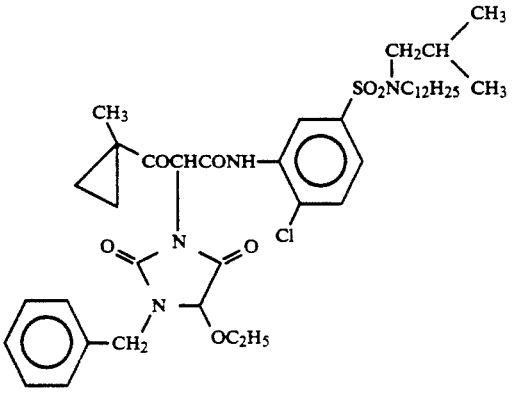

-continued
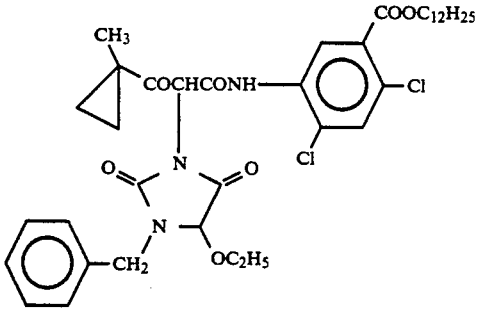
Y-16
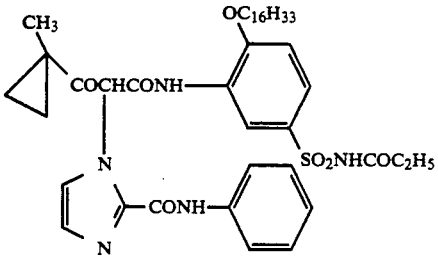
Y-17
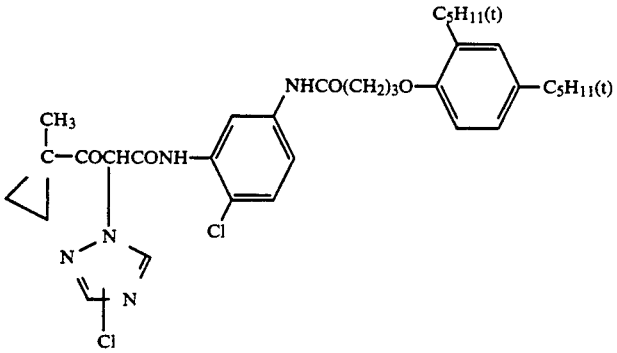
Y-18
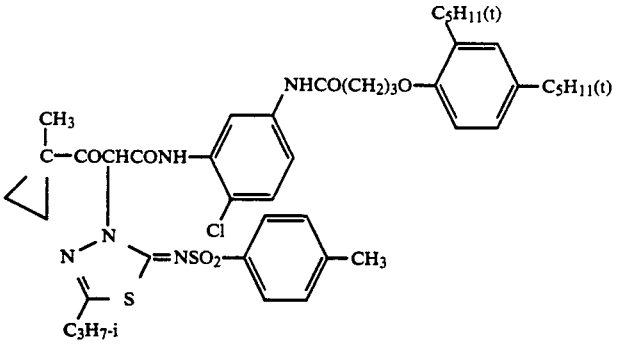
Y-19
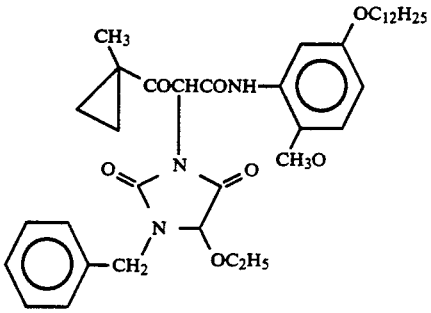
Y-20

-continued
Y-21
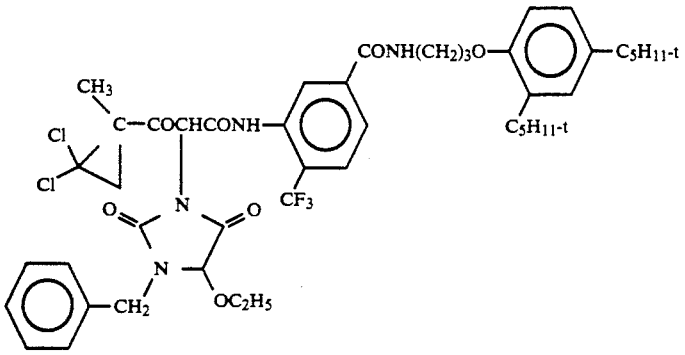
Y-22
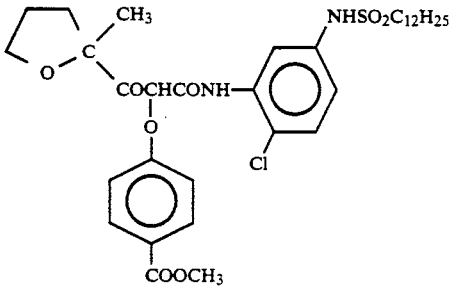
Y-23
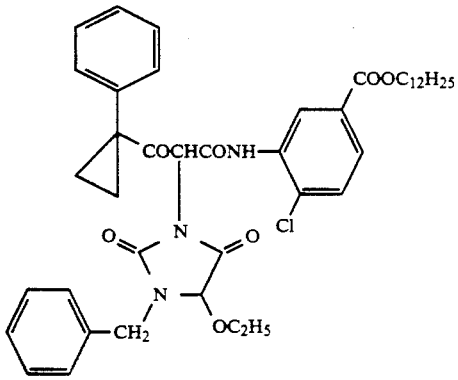
Y-24
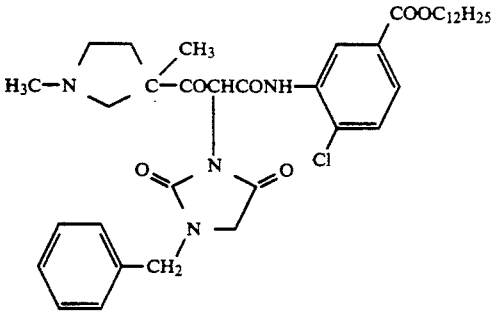
Y-25
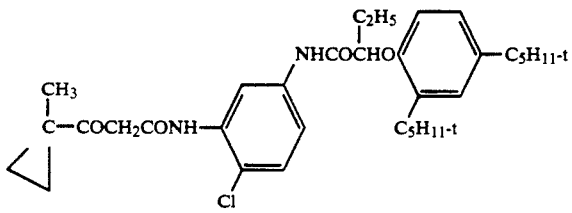

-continued
Y-26
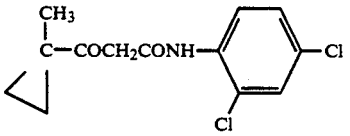
Y-27
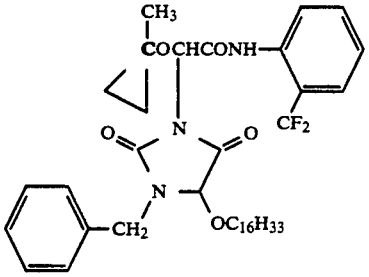
Y-28
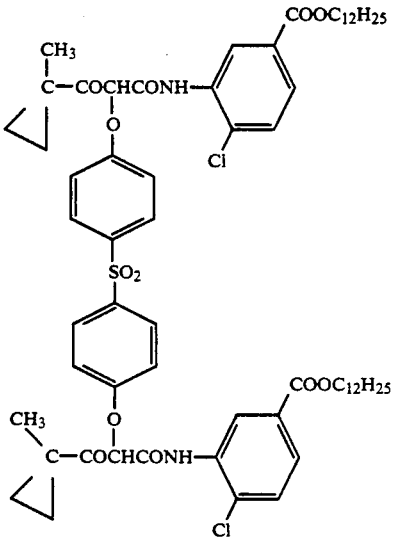
Y-29
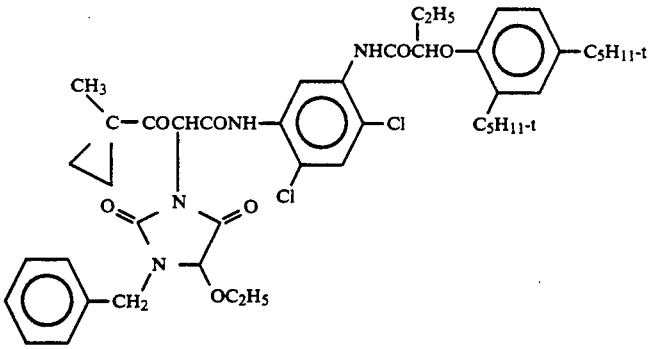
Y-30
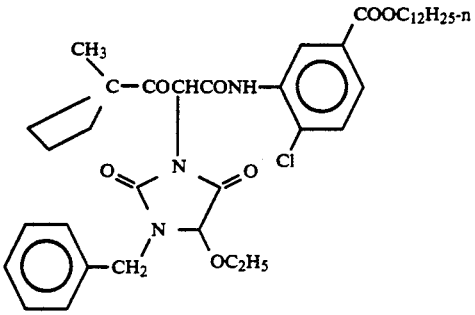

-continued
Y-31
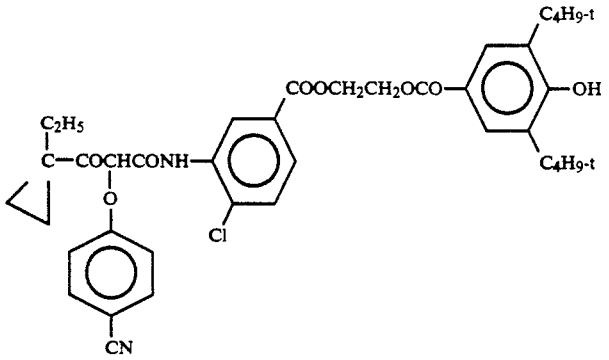
Y-32
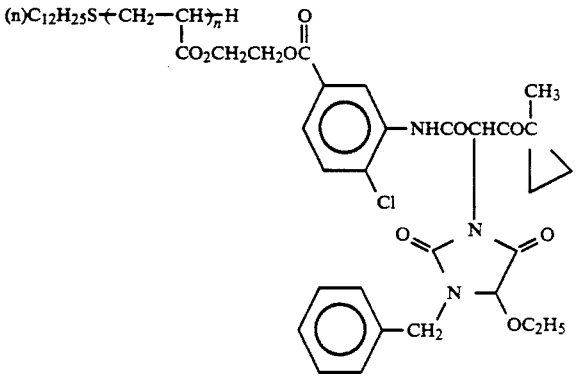
n = 3 (Average)
Y-33
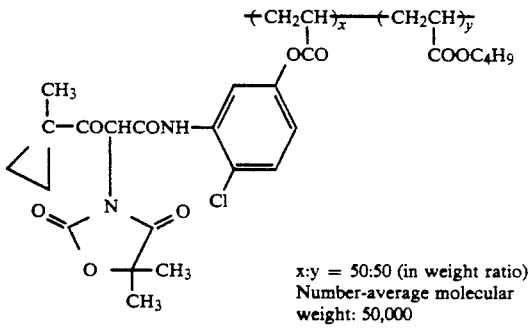
x:y = 50:50 (in weight ratio)
Number-average molecular weight: 50,000
Y-34
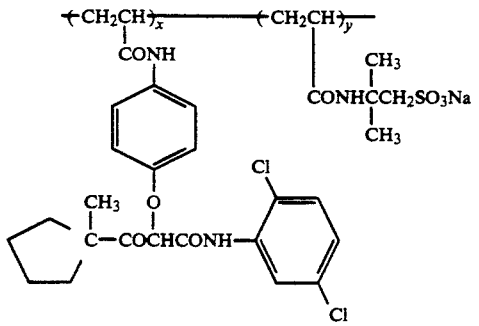
x:y = 80:20 (in weight ratio)
Number-average molecular weight: 70,000

-continued
Y-35
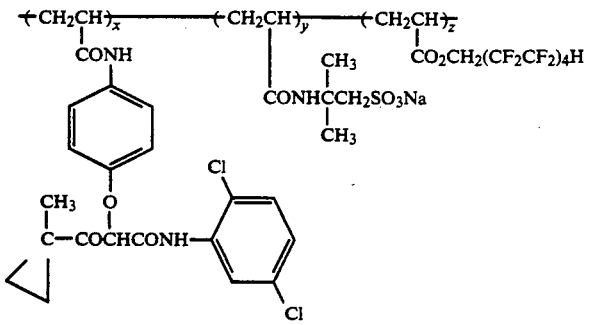
x:y:z = 50:30:20 (in weight ratio)
Number-average molecular weight: 70,000
Y-36
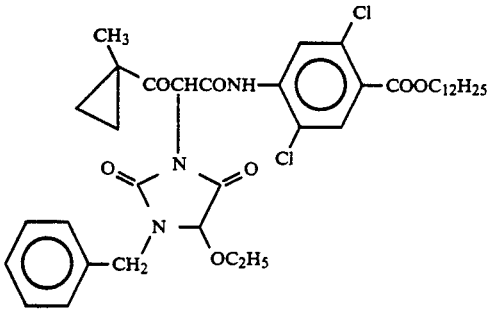
Y-37
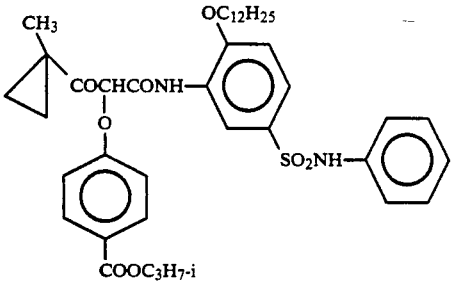
Y-38
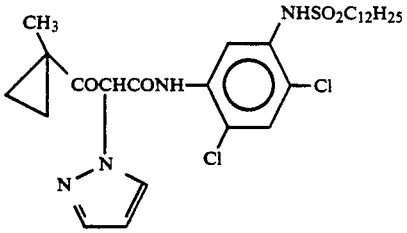
Y-39
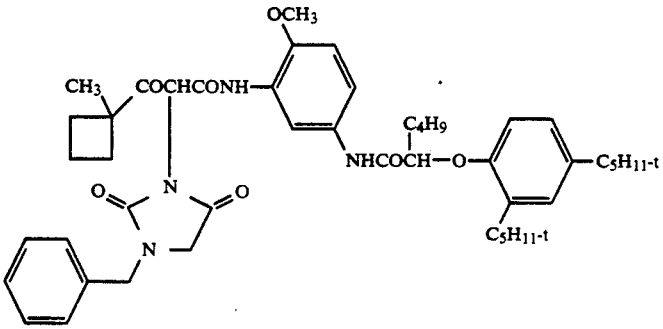

-continued
Y-40
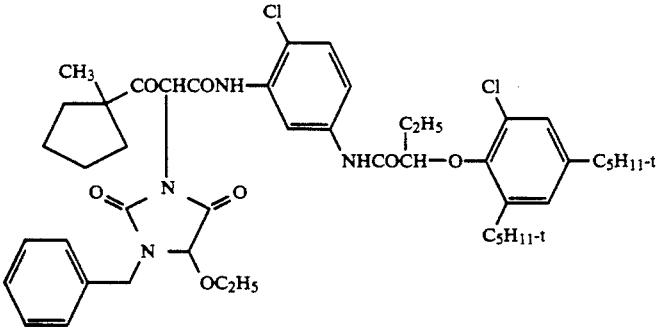
Y-41
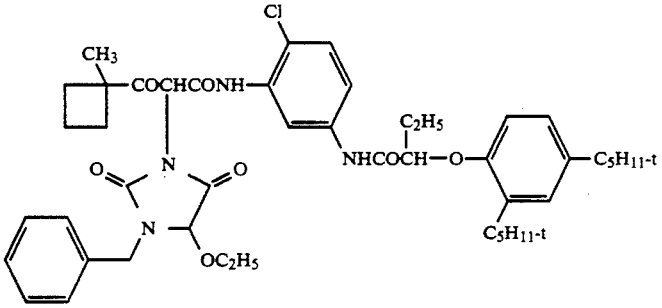
Y-42
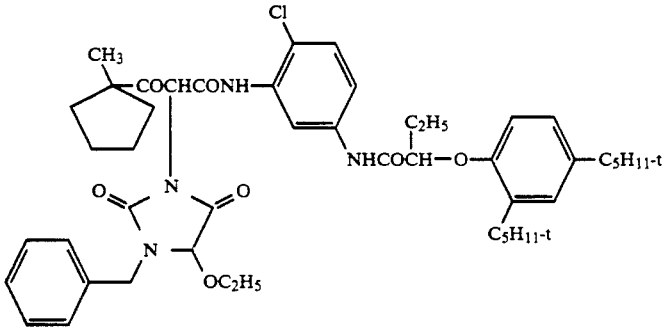
Y-43
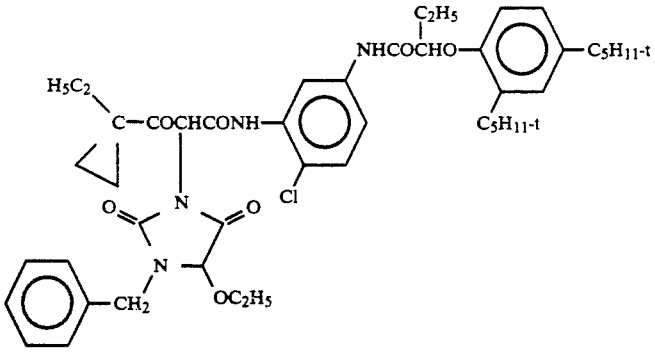
Y-44
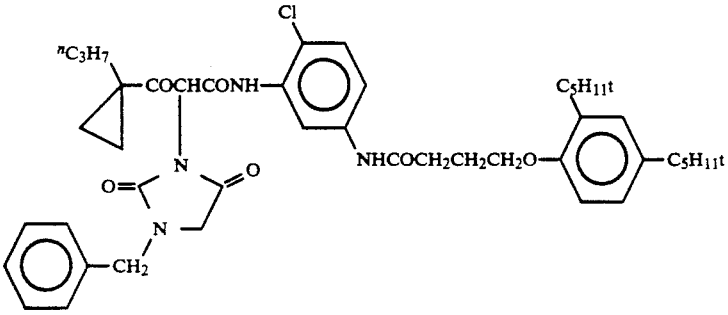

-continued
Y-45
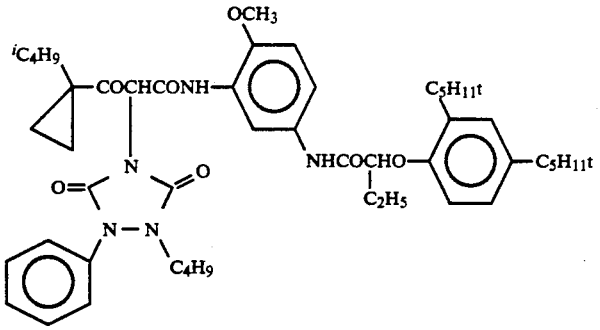
Y-46
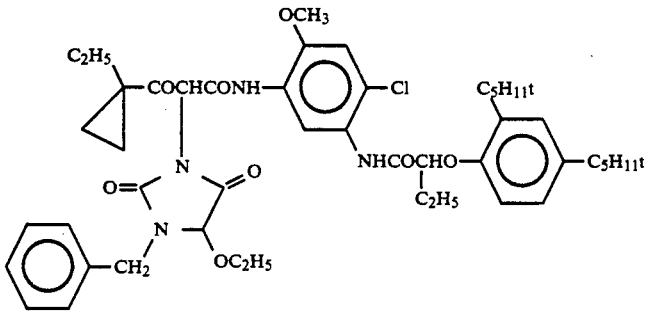
Y-47
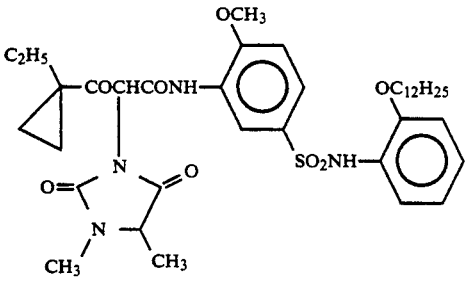
Y-48
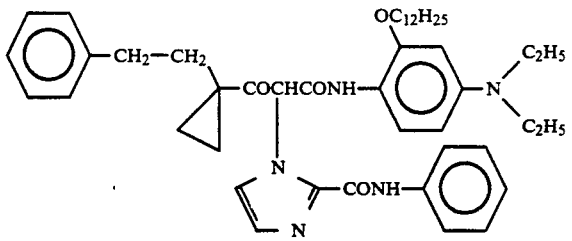
Y-49
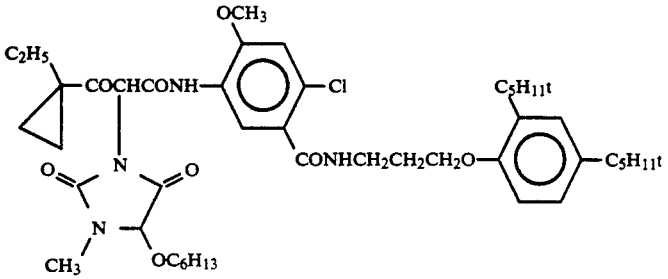

-continued
Y-50
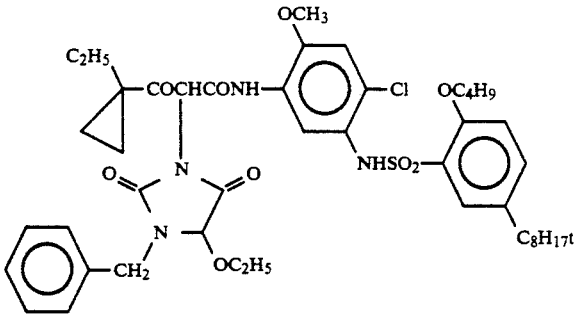
Y-51
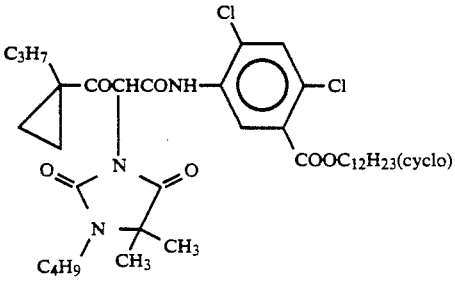
Y-52
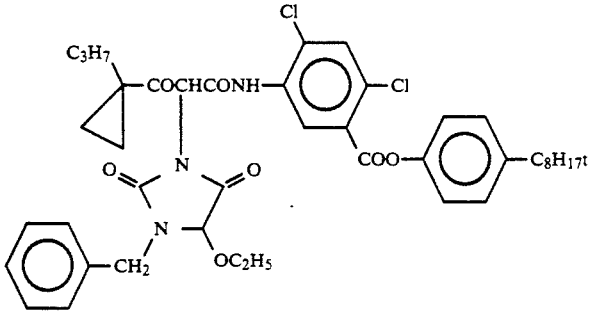
Y-53
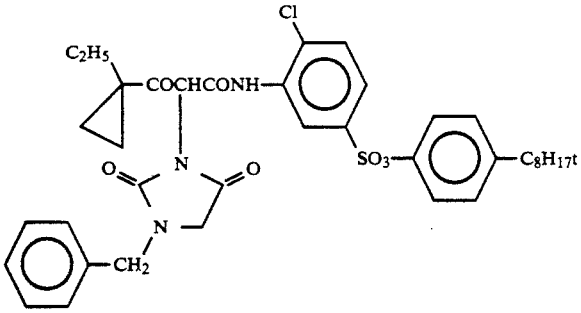
Y-54
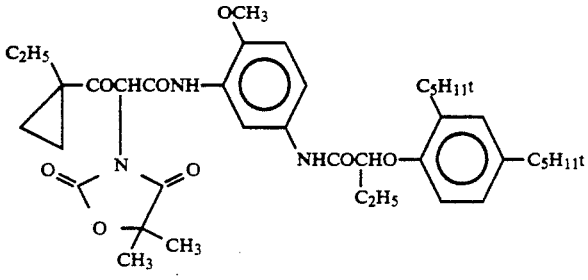

-continued
Y-55
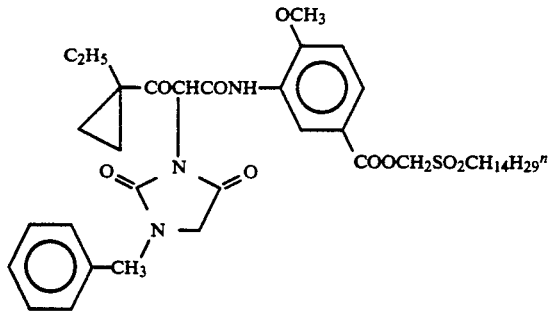
Y-56
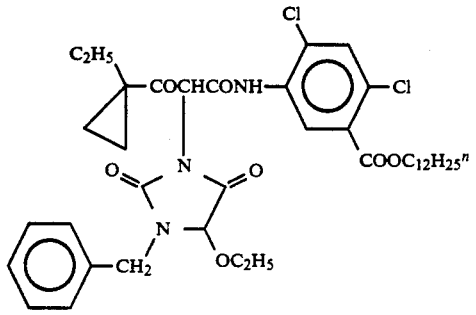
Y-57
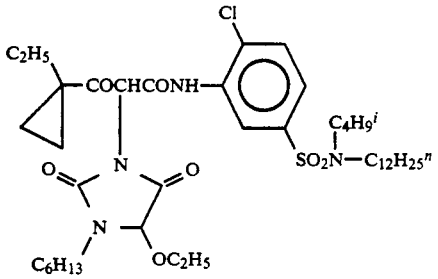
Y-58
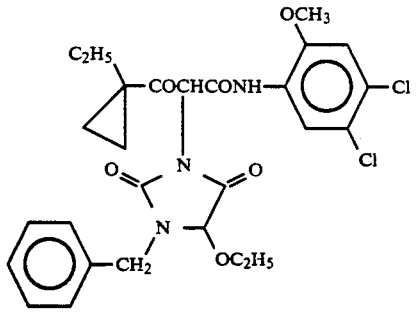
Y-59
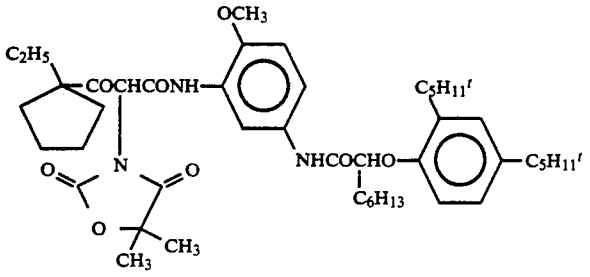

-continued

Y-60

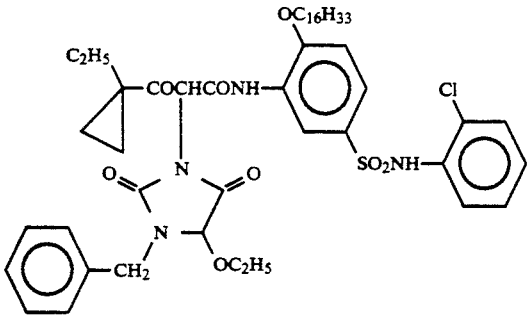

The yellow coupler represented by formula (I-A) of the present invention can be synthesized by the following synthesis route:

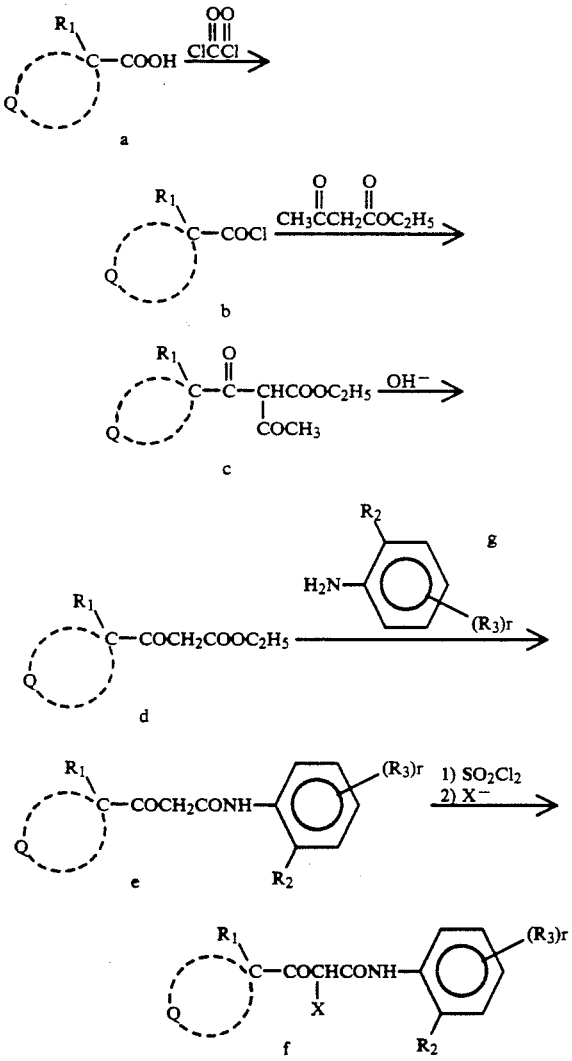

Compound a can be synthesized by a process described, for example, in *J. Chem. Soc.* (C), 1968, 2548, *J. Am. Chem. Soc.*, 1934, 56, 2710, *Synthesis*, 1971, 285, *J. Org. Chem.*, 1978, 43, 1729, or *CA*, 1960, 66, 18533y.

The synthesis of Compound b is carried out by a reaction using thionyl chloride, oxalyl chloride, etc., without a solvent or in a solvent such as methylene chloride, chloroform, carbon tetrachloride, dichloroethane, toluene, N,N-dimethylformamide, or N,N-dimethylacetamide. The reaction temperature is generally about −20° to about 150° C., preferably about −10° to about 80° C.

Compound c is synthesized by converting ethyl acetoacetate into an anion using magnesium methoxide or the like and adding b thereinto. The reaction is carried out without a solvent or in tetrahydrofuran, ethyl ether, or the like, and the reaction temperature is generally about −20° to about 60° C., preferably about −10° to about 30° C. Compound d is synthesized by a reaction using Compound c and, as a base, aqueous ammonia, an aqueous $NaHCO_3$ solution, an aqueous sodium hydroxide solution, or the like, without a solvent or in a solvent such as methanol, ethanol, and acetonitrile. The reaction temperature is about −20° to about 50° C., preferably about −10° to about 30° C.

Compound e is synthesized by reacting Compounds d and g without a solvent. The reaction temperature is generally about 100° to about 150° C., preferably about 100° to about 120° C. When X is not H, after chlorination or bromination the coupling releasing group X is introduced to synthesize Compound f. Compound e is converted, in a solvent such as dichloroethane, carbon tetrachloride, chloroform, methylene chloride, or tetrahydrofuran, to the chlorine-substituted product by using sulfuryl chloride, N-chlorosuccinimide, or the like, or to the bromine-substituted product by using bromine, N-bromosuccinimide, or the like. At that time the reaction temperature is about −20° to about 70° C., preferably about −10° to about 50° C.

Then the chlorine-substituted product or the bromine-substituted product and the proton adduct H-X of the coupling releasing group are reacted in a solvent, such as methylene chloride, chloroform, tetrahydrofuran, acetone, acetonitrile, dioxane, N-methylpyrrolidone, N,N'-dimethyl-imidazolidine-2-one, N,N-dimethylformamide, or N,N-dimethylacetamide at a reaction temperature of about −20° to about 150° C., preferably about −10° to about 100° C., so that Coupler f of the present invention can be obtained. At that time a base can be used, such as triethylamine, N-ethylmorpholine, tetramethylguanidine, potassium carbonate, sodium hydroxide, or sodium bicarbonate.

Synthesis Examples of couplers of the present invention are shown below.

SYNTHESIS EXAMPLE 1

Synthesis of Exemplified Compound Y-25

38.1 g of oxalyl chloride was added dropwise over 30 min to a mixture 25 g of 1-methylcyclopropanecarboxylic acid, which was synthesized by the method described by Gotkis, D., et al., *J. Am. Chem. Soc.*, 1934, 56, 2710, 100 ml of methylene chloride, and 1 ml of N,N-dimethylformamide. After the addition the reaction was carried out for 2 hours at room temperature, and then the methylene chloride and excess oxalyl chloride were removed under reduced pressure by an aspirator, thereby producing an oil of 1-methylcyclopropanecarbonyl chloride.

100 ml of methanol was added dropwise over 30 min at room temperature to a mixture of 6 g of magnesium and 2 ml of carbon tetrachloride, after which the mixture was heated for 2 hours under reflux, and then 32.6 g of ethyl 3-oxobutanate was added dropwise over 30 min under heating and reflux. After the addition the mixture was heated under reflux for 2 hours, and then the methanol was distilled off completely under reduced pressure by an aspirator. 100 ml of tetrahydrofuran was added to and dispersed in the resultant solution, and the previously prepared 1-methylcyclopropanecarbonyl chloride was added dropwise to the dispersion at room temperature. After reacting for 30 min, the reaction liquid was subjected to extraction with 300 ml of ethyl acetate and diluted sulfuric acid, the organic layer was washed with water and dried over anhydrous sodium sulfate, and then the solvent was distilled off, to produce 55.3 g of an oil of ethyl 2-(1-methylcyclopropanecarbonyl)-3-oxobutanate.

A solution of 55 g of the ethyl 2-(1-methylcyclopropanecarbonyl)-3-oxobutanate and 160 ml of ethanol was stirred at room temperature, and 60 ml of a 30% aqueous ammonia was added thereto over 10 min. Thereafter the resulting mixture was stirred for 1 hour and then was subjected to extraction with 300 ml of ethyl acetate and diluted hydrochloric acid, followed by neutralizing and washing with water; then the organic layer was dried over anhydrous sodium sulfate and the solvent was distilled off, to produce 43 g of an oil of ethyl (1-methylcyclopropanecarbonyl)acetate.

34 g of the ethyl (1-methylcyclopropanecarbonyl-)acetate and 44.5 g of N-(3-amino-4-chlorophenyl)-2-(2,4-di-t-pentylphenoxy)butaneamide were heated at an internal temperature of 100° to 120° C. under reflux and reduced pressure by an aspirator. After reacting for 4 hours, the reaction solution was purified by column chromatography with a mixed solvent of n-hexane and ethyl acetate, to produce a viscous oil of 49 g of the Exemplified Compound Y-25. The structure of the compound was identified by MS spectrum, NMR spectrum, and elemental analysis.

SYNTHESIS EXAMPLE 2

Synthesis of Exemplified Compound Y-1

22.8 of the Exemplified Compound Y-25 was dissolved in 300 ml of methylene chloride, and 5.4 g of sulfuryl chloride was added dropwise over 10 min to the resulting solution under cooling with ice. After reacting for 30 min, the reaction liquid was washed well with water and was dried over anhydrous sodium sulfate, followed by concentration, to obtain the chloride of the Exemplified Compound Y-25. A solution of the thus synthesized chloride of the Exemplified Compound Y-25 in 50 ml of N,N-dimethylformaldehyde was added dropwise over 30 min at room temperature to a solution of 18.7 g of 1-benzyl-5-ethoxyhydantoin, 11.2 ml of triethylamine, and 50 ml of N,N-dimethylformamide.

Thereafter the reaction was allowed to continue for four hours at 40° C., and then the reaction liquid was subjected to extraction with 300 ml of ethyl acetate, thereafter washed with water and then washed with 300 ml of a 2% aqueous triethylamine solution. This was followed by neutralization with diluted hydrochloric acid. After the organic layer was dried over anhydrous sodium sulfate, the solvent was distilled off, and the thus obtained oil was crystallized from a mixed solvent of n-hexane and ethyl acetate. After the thus obtained crystals were filtered off, followed by washing with a mixed solvent of n-hexane and ethyl acetate, they were dried, to obtain 22.8 g of crystals of the Exemplified Compound Y-1. The structure of the compound was identified by MS spectrum, NMR spectrum, and elemental analysis. The melting point was 132° to 133° C.

Couplers represented by formula (II) and (III) will be described in detail.

In formula (II) or (III), when $X^1$ and $X^2$ represent an alkyl group, the alkyl group is a straight-chain, branched chain, or cyclic, saturated or unsaturated, substituted or unsubstituted alkyl, group having a C-number of 1 to 30, preferably 1 to 20. Examples of the alkyl group are methyl, ethyl, propyl, butyl, cyclopropyl, allyl, t-octyl, i-butyl, dodecyl, and 2-hexyldecyl.

When $X^1$ and $X^2$ represent a heterocyclic group, the heterocyclic group is a 3- to 12-membered, preferably a 5- to 6-membered, saturated or unsaturated, substituted or unsubstituted, monocyclic or condensed ring heterocyclic group having a C-number of 1 to 20, preferably 1 to 10, and at least one heteroatom, such as a nitrogen atom, an oxygen atom, or a sulfur atom. As an example of the heterocyclic group, 3-pyrrolidinyl, 1,2,4-triazole-3-yl, 2-pyridyl, 4-prymidinyl, 3-pyrazolyl, 2-pyrrolyl, 2,4-dioxo-1,3-imidazolidine-5-yl, or pyranyl can be mentioned.

When $X^1$ and $X^2$ represent an aryl group, the aryl group is a substituted or unsubstituted aryl group having a C-number of 6 to 20, preferably 6 to 10. As a typical example of the aryl group, a phenyl group and a naphthyl group can be mentioned.

When $X^3$ represents a nitrogen-containing heterocyclic group together with the >N—, the heterocyclic group is a 3- to 12-membered, preferably 5- to 6-membered, substituted or unsubstituted, saturated or unsaturated, monocyclic or condensed ring heterocyclic group that have a C-number of 1 to 20, preferably 1 to 15 and may contain in addition to the nitrogen atom, for example, an oxygen atom or a sulfur atom as heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $X^1$ and $X^2$ represent a substituted alkyl, aryl or heterocyclic group and $X^3$ represents a substituted nitrogen-containing heterocyclic group together with the >N—, examples of the substituent include: a halogen atom (e.g., fluorine and chlorine), an alkoxycarbonyl group (preferably having a C-number of 2 to 30, and more preferably 2 to 20, e.g., methoxycarbonyl, dodecyloxycarbonyl, and hexadecyloxycarbonyl), an acylamino group (preferably having a C-number of 2 to 30, and more preferably 2 to 20, e.g., acetamido, tetradecaneamido, 2-(2,4-di-t-amylphenoxy)butaneamido, and benzamido), a sulfonamido group (preferably having a C-number of 1 to 30, and more preferably 1 to 20, e.g., methanesulfonamido, dodecanesulfonamido, hexadecylsulfonamido, and benzenesulfonamido), a carbamoyl group (preferably having a C-number of 1 to 30, and more preferably 1 to 20, e.g., N-butylcarbamoyl and N,N-diethylcarbamoyl), an N-sulfonylcarbamoyl group (preferably having a C-number of 1 to 30, and more preferably 1 to 20, e.g., N-mesylcarbamoyl and N-dodecylsulfonylcarbamoyl), a sulfamoyl group (preferably having a C-number of 1 to 30, and more preferably 1 to 20, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (preferably having a C-number of 1 to 30, and more preferably 1 to 20, e.g., methoxy, hexadecyloxy, and isopropoxy), an aryloxy group (preferably having a C-number of 6 to 20, and more preferably 6 to 10, e.g., phenoxy, 4-methoxyphenoxy, 3-t-butylhydroxyphenoxy, and naphthoxy), an aryloxycarbonyl group (preferably having a C-number of 7 to 21, and more preferably 7 to 11, e.g., phenoxycarbonyl), an N-acylsulfamoyl group (preferably having a C-number of 2 to 30, and more preferably 2 to 20, e.g., N-propanoylsulfamoyl and N-tetradecanoylsulfamoyl), a sulfonyl group (preferably having a C-number of 1 to 30, and more preferably 1 to 20, e.g., methanesulfonyl, octanesulfonyl, 4-hydroxyphenylsulfonyl, and dodecanesulfonyl), an alkoxycarbonylamino group (preferably having a C-number of 1 to 30, and more preferably 1 to 20, e.g., ethoxycarbonylamino), a cyano group, a nitro group, a carboxyl group, a hydroxyl group, a sulfo group, an alkylthio group (preferably having a C-number of 1 to 30, and more preferably 1 to 20, e.g., methylthio, dodecylthio, and dodecylcarbamoylmethylthio), a ureido group (having a C-number of 1 to 30, more preferably 1 to 20, e.g., N-phenylureido and N-hexadecylureido), an aryl group (preferably having a C-number of 6 to 20, and more preferably 6 to 10, e.g., phenyl, naphthyl, and 4-methoxyphenyl), a heterocyclic group (which is a 3- to 12-membered, preferably 5- to 6-membered, monocyclic or condensed ring having preferably a C-number of 1 to 20, and more preferably 1 to 10 and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated and preferably has a C-number of 1 to 30, and more preferably 1 to 20, e.g., methyl, ethyl, isopropyl, cyclopropyl, t-pentyl, t-octyl, cyclopentyl, t-butyl, s-butyl, dodecyl, and 2-hexyldecyl), an acyl group (preferably having a C-number of 1 to 30, and more preferably 2 to 20, e.g., acetyl and benzoyl), an acyloxy group (preferably having a C-number of 2 to 30, and more preferably 2 to 20, e.g., propanoyloxy and tetradecanoyloxy), an arylthio group (preferably having a C-number of 6 to 20, and more preferably 6 to 10, e.g., phenylthio and naphthylthio), a sulfamoylamino group (preferably having a C-number of 0 to 30, and more preferably 0 to 20, e.g., N-butyl-sulfamoylamino, N-dodecylsulfamoylamino, and N-phenylsulfamoylamino), or an N-sulfonylsulfamoyl group (preferably having a C-number of 1 to 30, and more preferably 1 to 20, e.g., N-mesylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable substituents includes, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (II) and (III) represents an aryl group, the aryl group is a substituted or unsubstituted aryl group preferably having a C-number of 6 to 20, and more preferably 6 to 10. Typical examples thereof are a phenyl group and a naphthyl group.

When Y in formulas (II) and (III) represents a heterocyclic group, the heterocyclic group has the same meaning as that of the heterocyclic group represented by $X^1$ and $X^2$.

When Y represents a substituted aryl group or a substituted heterocyclic group, examples of the substituent include those mentioned as examples of the substituent possessed by $X^1$. Preferable examples of the substituted aryl group and heterocyclic group represented by Y are those wherein the substituted group has a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by Z in formulas (II) and (III) may be any one of conventionally known coupling releasing groups. Preferably Z includes, for example, a nitrogen-containing heterocyclic group bonded to the coupling site through the nitrogen atom, an aryloxy group, an arylthio group, a heterocyclic oxy group, a heterocyclic thio group, an acyloxy group, a carbamoyloxy group, an alkylthio group, or a halogen atom.

These coupling releasing groups may be any one of non-photographically useful groups, photographically useful groups, or precursors thereof (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When Z is a photographically useful group, one which is conventionally known is useful. For example, photographically useful groups described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent No. 193389 A, 348139 A, or 272573 A or coupling releasing groups for releasing them (e.g., a timing group) are used.

When Z represents a nitrogen-containing heterocyclic group bonded to the coupling site through the nitrogen atom, preferably Z represents a 5- to 6-membered, substituted or unsubstituted, saturated or unsaturated, monocyclic or condensed ring heterocyclic group preferably having a C-number of 1 to 15, and more preferably 1 to 10. As heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine- 2,4-dione-3-yl, 1,2,4-triazolidine-3,5-dione-4-yl, imidazolidine-2,4,5-trion-3-yl, 2-imidazolinone-1-yl-, 3,5-dioxomorpholino, or 1-indazolyl can be mentioned. When these heterocyclic groups are substituted, the substituent includes those mentioned as examples of the substituent which may be possessed by the $X^1$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When Z represents an aromatic oxy group, preferably the aromatic oxy group is a substituted or unsubstituted aromatic oxy group having a C-number of 6 to 10, and more preferably a substituted or unsubstituted phenoxy group. If the aromatic oxy group is substituted, examples of the substituent include those mentioned as examples of the substituent which may be possessed by $X^1$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When Z represents an aromatic thio group, preferably the aromatic thio group is a substituted or unsubstituted aromatic thio group having a C-number of 6 to 10, and more preferably a substituted or unsubstituted phenylthio group. When the aromatic thio group is substituted, examples of the substituent include those mentioned as examples of the substituent which may be possessed by $X^1$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When Z represents a heterocyclic oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic oxy group, a pyridyloxy group, a pyrazolyloxy group, or a furyloxy group can be mentioned. When the heterocyclic oxy group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

When Z represents a heterocyclic thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic thio group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When Z represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $X^1$ mentioned above.

When Z represents a carbamoyloxy group, the carbamoyloxy group is an aliphatic or aromatic or heterocyclic, substituted or unsubstituted carbamoyloxy group preferably having a C-number of 1 to 30, and more preferably 1 to 20. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $X^1$ mentioned above.

When Z represents an alkylthio group, the alkylthio group is a substituted or unsubstituted, straight-chain, branched chain, or cyclic, saturated or unsaturated alkylthio group having a C-number of 1 to 30, more preferably 1 to 20. When the alkylthio group is substituted, examples of the substituent include those mentioned as examples of the substituent which may be possessed by $X^1$ mentioned above.

Now, couplers represented by formulas (II) and (III) that fall in a particularly preferable range will be described.

The group represented by $X^1$ in formula (II) is preferably an alkyl group, and particularly preferably an alkyl group having a C-number of 1 to 10.

The group represented by Y in formulas (II) and (III) is preferably an aromatic group, and particularly preferably a phenyl group having at least one substituent in the ortho position. The substituent includes those mentioned above, which may be possessed by the aromatic group represented by Y. Preferable substituents include preferable ones mentioned above, which may be possessed by the aromatic group represented Y.

The group represented by Z in formulas (II) and (III) includes preferably a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

Preferable couplers in formulas (II) and (III) are represented by the following formula (II-1), (III-1), or (III-2):

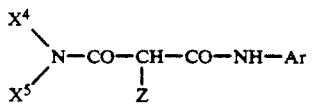

Formula (II-1)

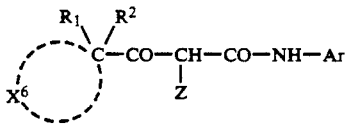

Formula (III-1)

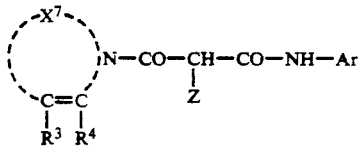

Formula (III-2)

wherein Z has the same meaning as defined in formula (II), $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group (monocyclic or condensed ring) together with the $-C(R^1R^2)-N<$, $X^7$ represents an organic residue required to form a nitrogen heterocyclic group (monocyclic or condensed ring) together with the $-C(R^3)=C(R^4)-N<$, and $R^1$, $R^2$, $R^3$, and $R^4$ each represent a hydrogen atom or a substituent. $R^3$ and $R^4$ may bond together to form a ring.

Preferable examples of substituent in the ortho position of phenyl group represented by Ar in formulas (II-1) to (III-2) include, for example, a halogen atom, an alkyl group (including a substituted alkyl, such as trifluoromethyl), an alkoxy group, and a phenoxy group. Further, on another position, particularly preferably on the metha position, of the phenyl group, one or more substituents may be introduced, and as a preferable substituent can be mentioned a halogen atom, an alkoxy group, an alkoxycarbonyl group, a carbonamido group, a sulfonamido group, a carbamoyl group, a sulfonyl group, and a sulfamoyl group (including an acylsulfamoyl or the like). These substituents may be further substituted.

With respect to a detailed description and a preferable range of the groups represented by $X^4$ to $X^7$, Ar, and Z in formulas (II-1) to (III-2), the description in the relevant range described for formulas (II) and (III) is applied. When $R^1$ to $R^4$ represent a substituent, examples include those substituents that may be possessed by $X^1$ mentioned above.

Among the couplers represented by the above mentioned formulas, particularly preferable couplers are those represented by formula (III-1) or (III-2).

The couplers represented by formulas (II) and (III) or (II-1), (III-1), and (III-2) may form a dimer or higher polymer (e.g., a telomer or a polymer) by bonding at the groups represented by $X^1$ to $X^7$, Y, Ar, $R^1$ to $R^4$, and Z through a divalent group or more higher polyvalent group. In that case, the number of carbon atoms may fall outside the range of the number of carbon atoms defined in the above-mentioned substituents.

Preferable examples of the couplers represented by formulas (II) and (II) or (II-1), (III-1), and (III-2) are nondiffusible couplers. The term "nondiffusible couplers" refers to couplers having in the molecule a group with a molecular weight large enough to make the molecule immobilized in the layer in which the molecule is added. Generally an alkyl group having a total C-number of 8 to 30, preferably 10 to 20, or an aryl group having a total C-number of 4 to 40, is used. These nondiffusible groups may be substituted on any position in the molecule, and two or more of them may be present in the molecule.

Specific examples of the couplers represented by formulas (II) and (II) or (II-1), (III-1), and (III-2) are shown below, but the present invention is not restricted to them.

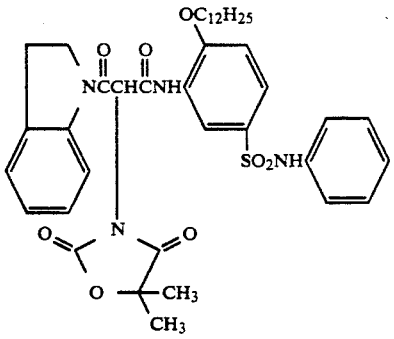

Y-101

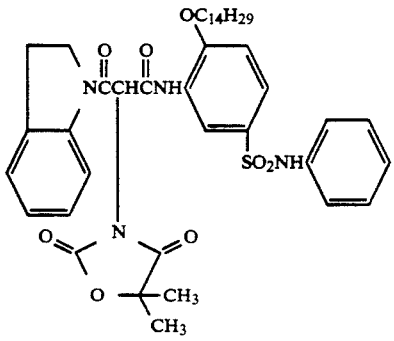

Y-102

-continued
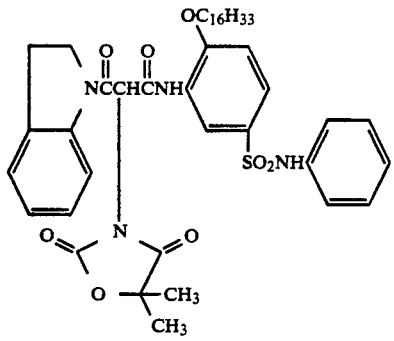
Y-103
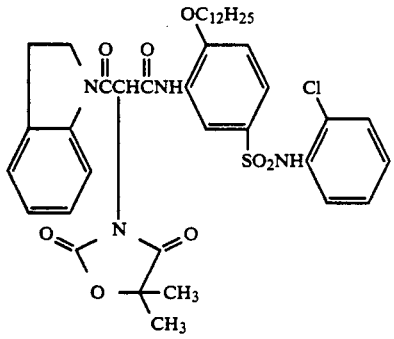
Y-104
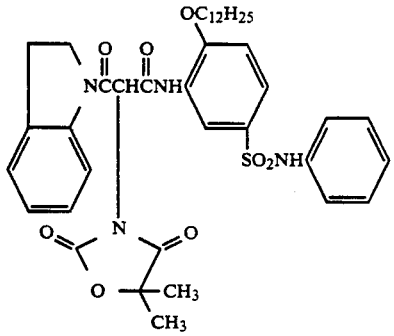
Y-105
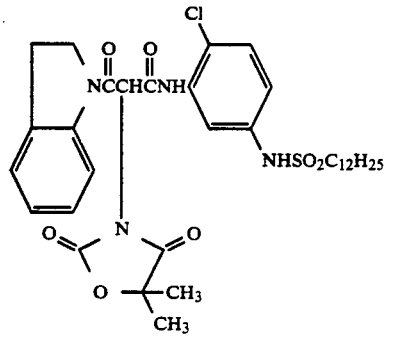
Y-106

-continued
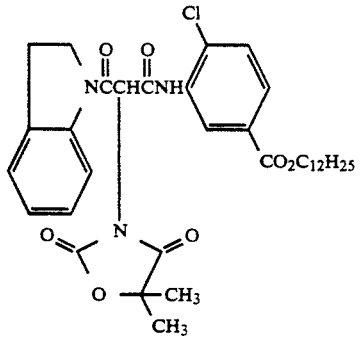
Y-107
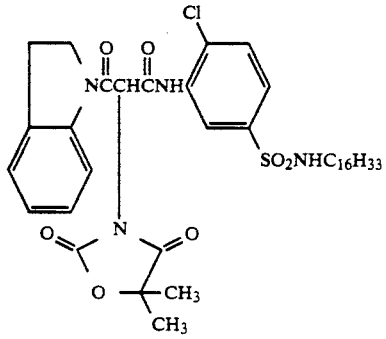
Y-108
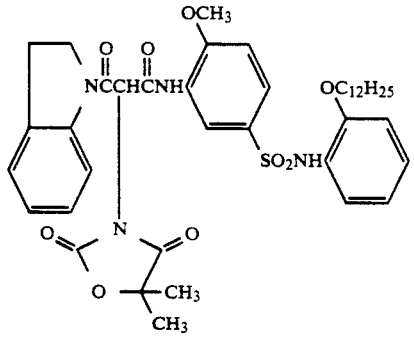
Y-109
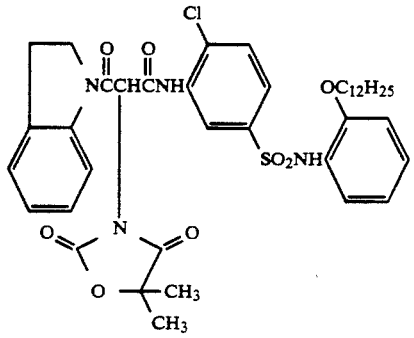
Y-110

-continued
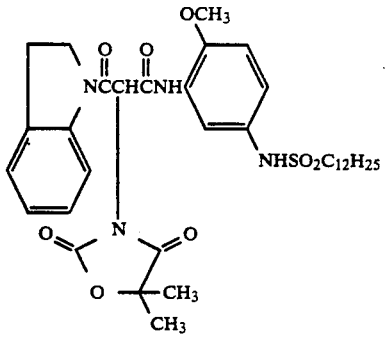
Y-111
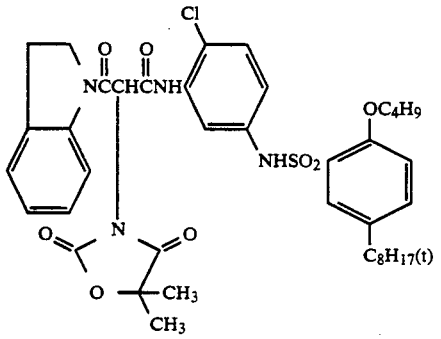
Y-112
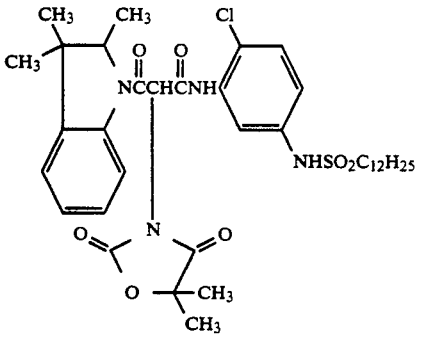
Y-113
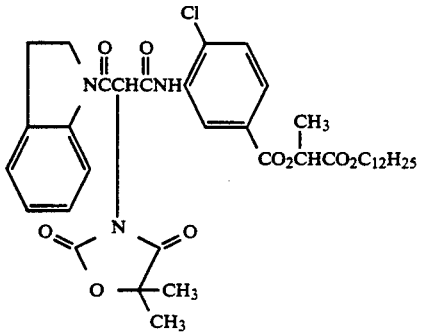
Y-114

-continued
Y-115
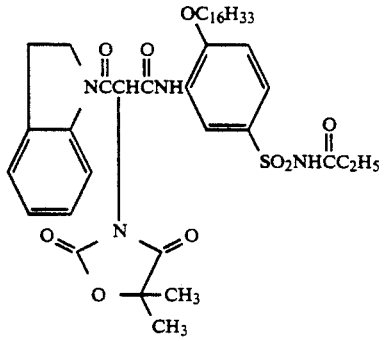
Y-116
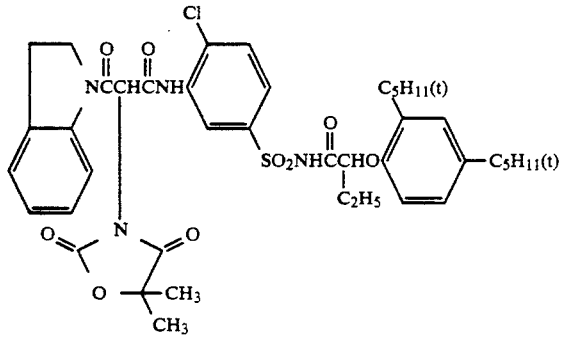
Y-117
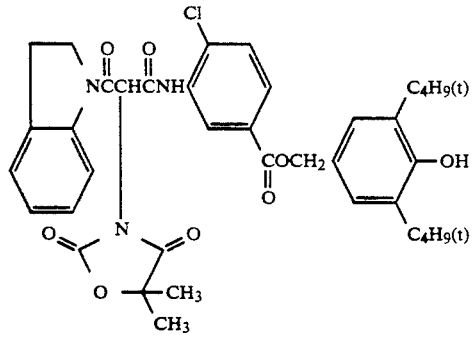
Y-118
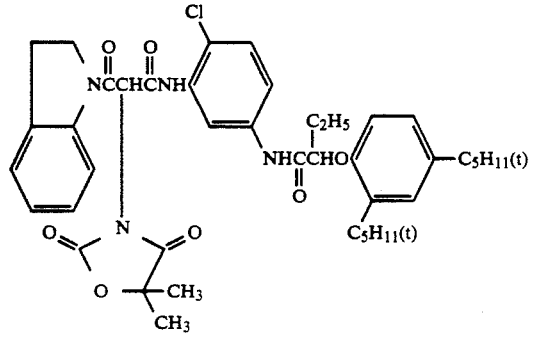

-continued
Y-119
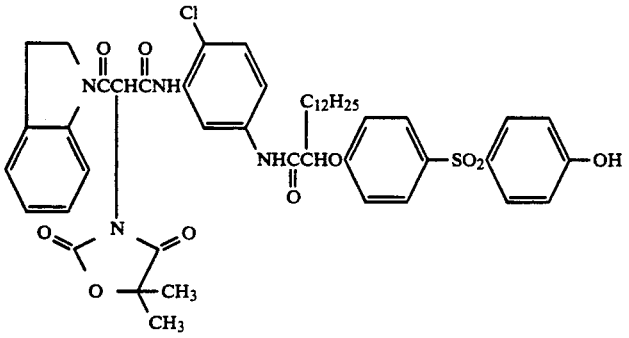
Y-120
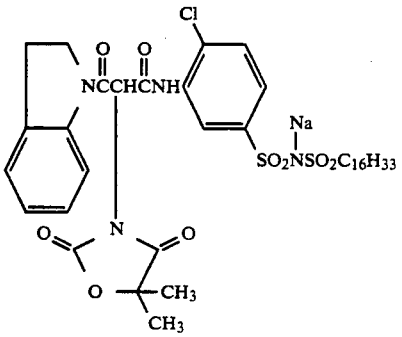
Y-121
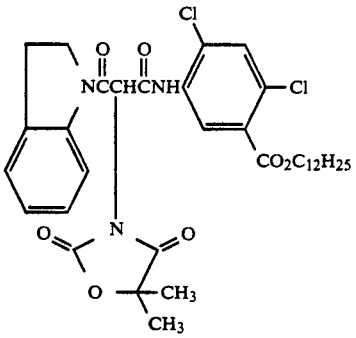
Y-122
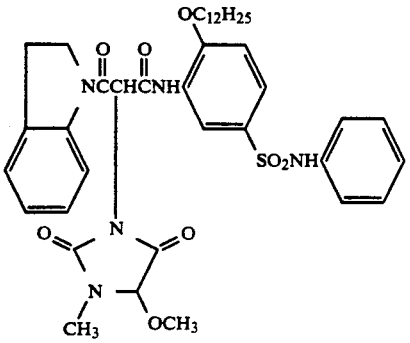

-continued
Y-123
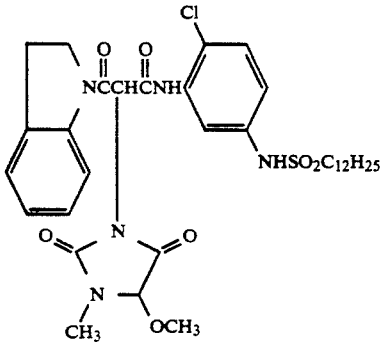
Y-124
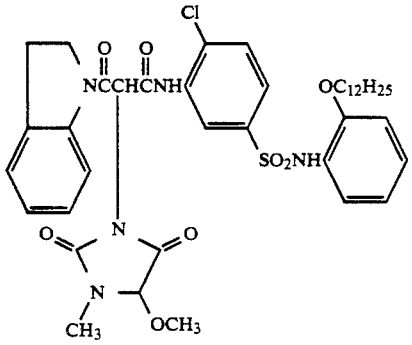
Y-125
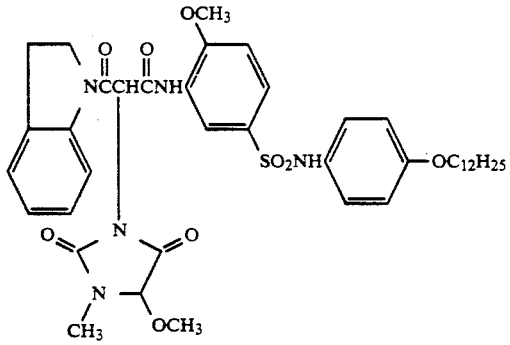
Y-126
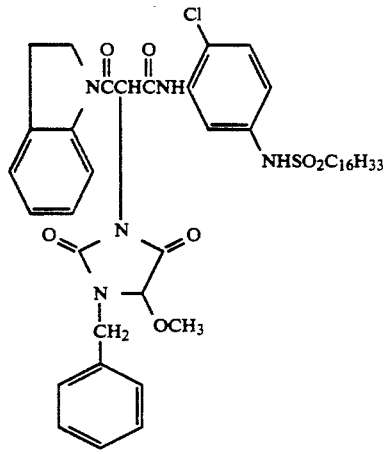

-continued
Y-127
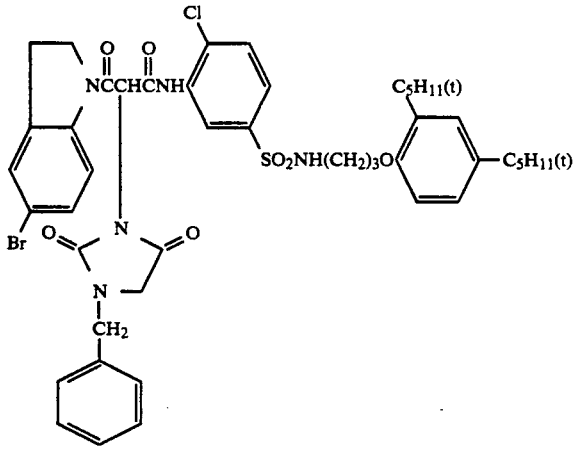
Y-128
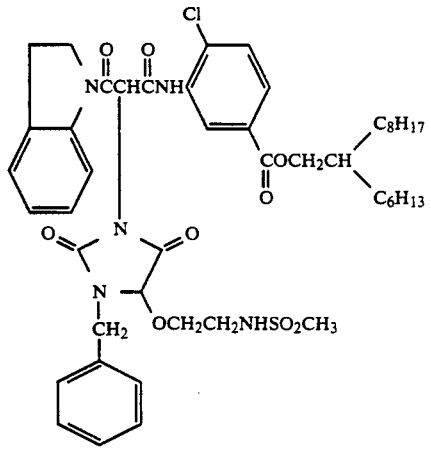
Y-129
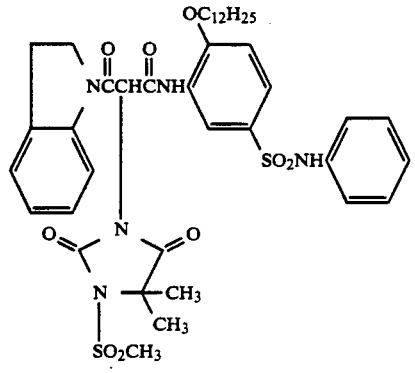

-continued
Y-130
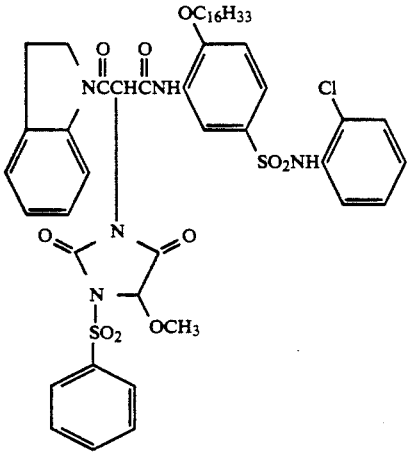
Y-131
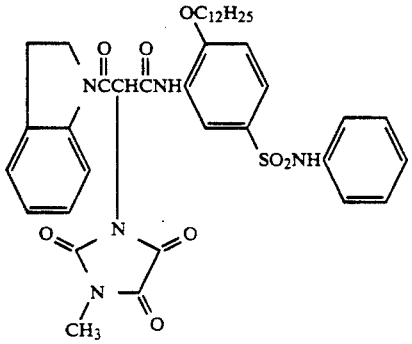
Y-132
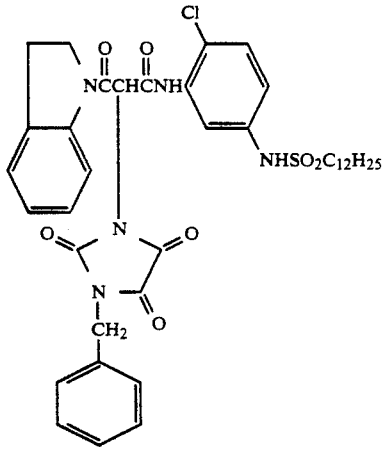
Y-133
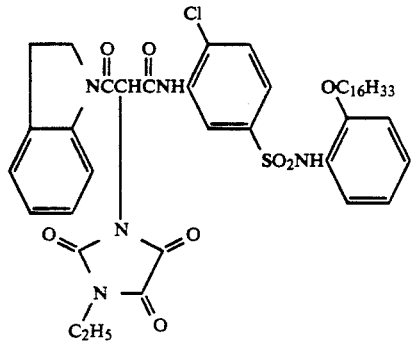

-continued
Y-134
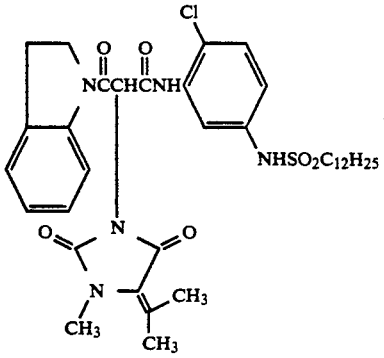
Y-135
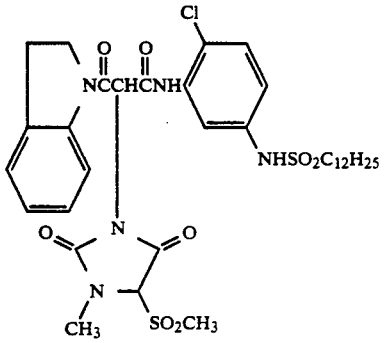
Y-136
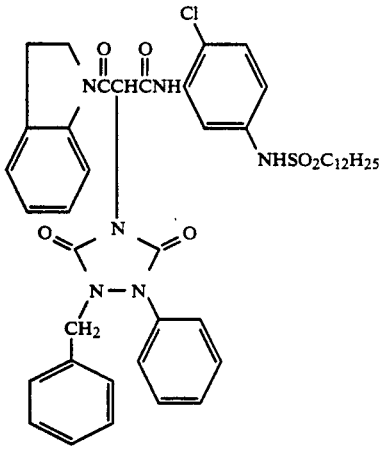
Y-137
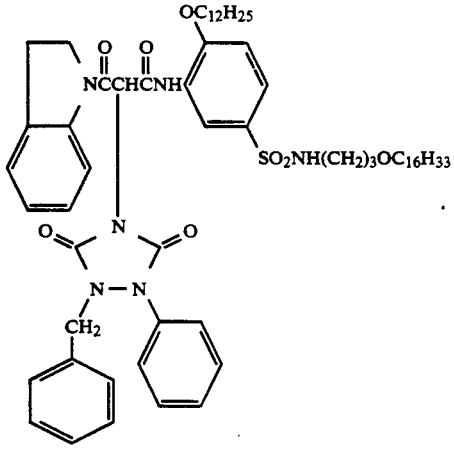

-continued
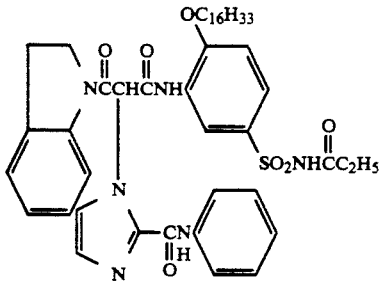
Y-138
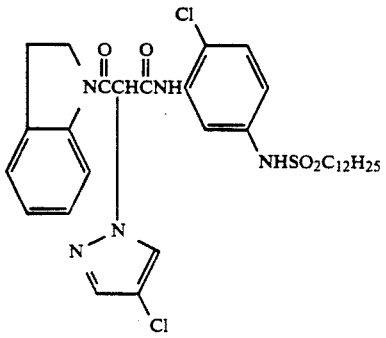
Y-139
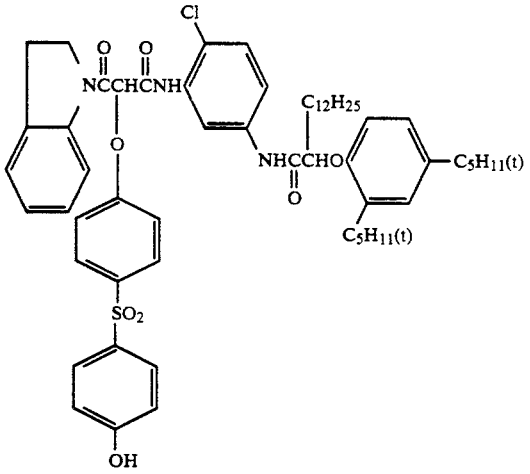
Y-140
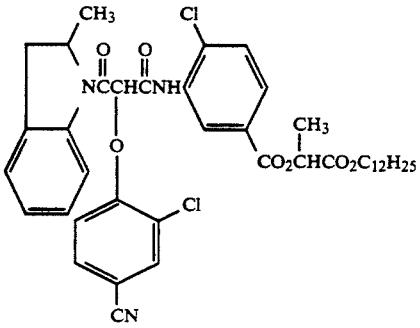
Y-141

-continued
Y-142
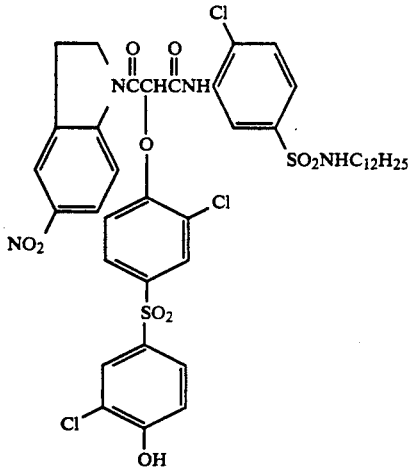
Y-143
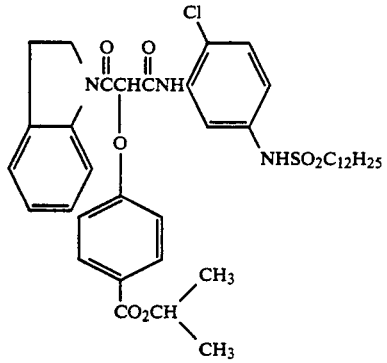
Y-144
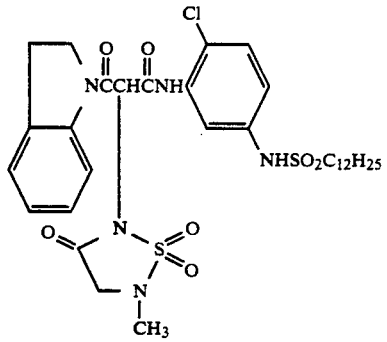
Y-145
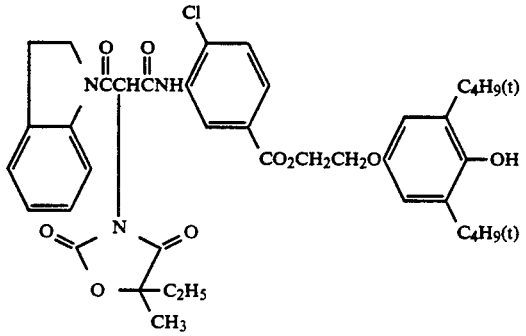

-continued
Y-146
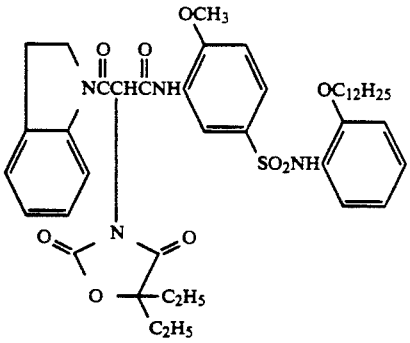
Y-147
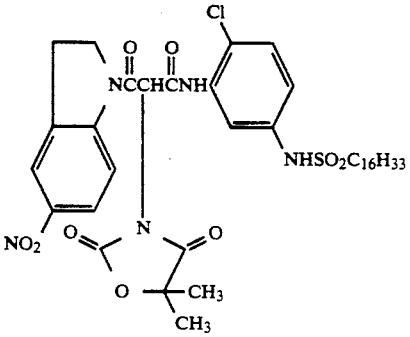
Y-148
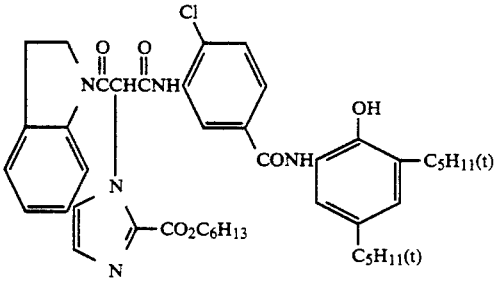
Y-149
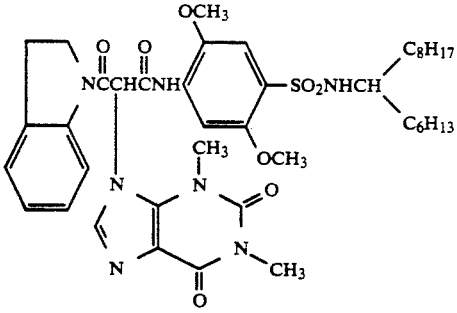
Y-150
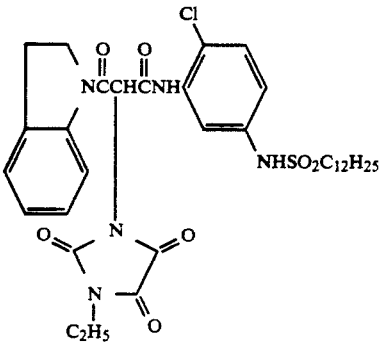

-continued
Y-151
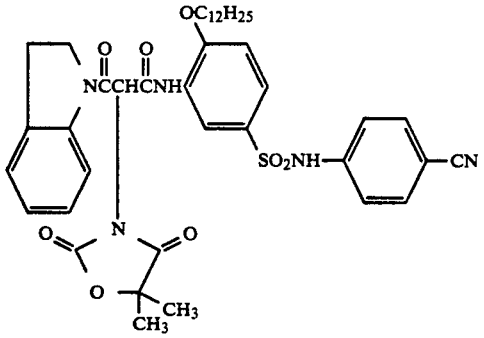
Y-152
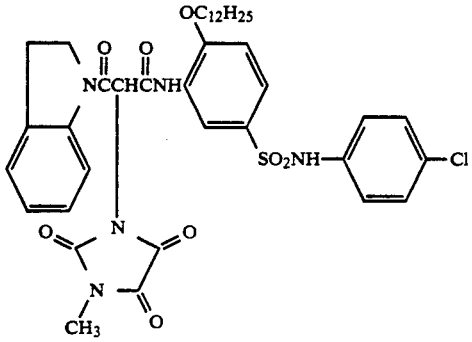
Y-153
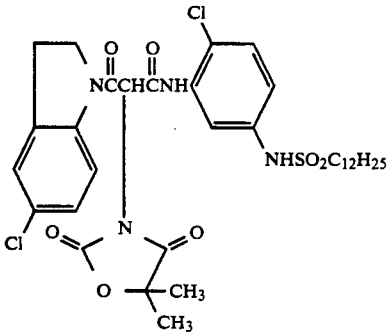
Y-154
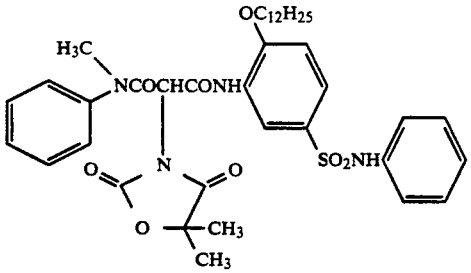
Y-155
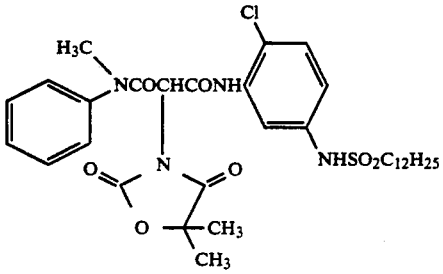

-continued
Y-156
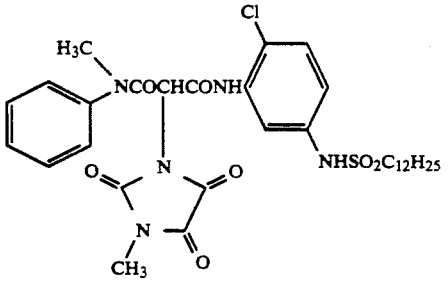
Y-157
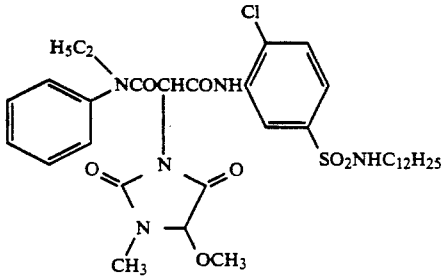
Y-158
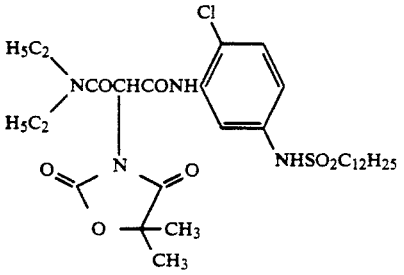
Y-159
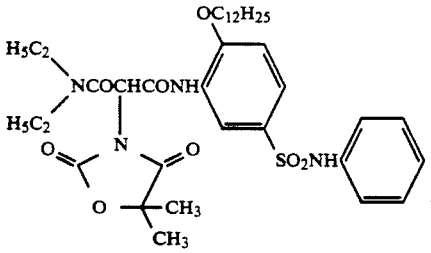
Y-160
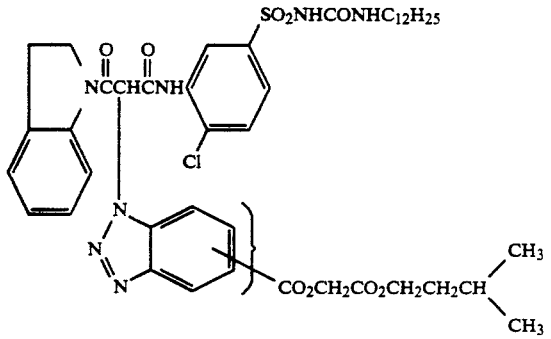

-continued
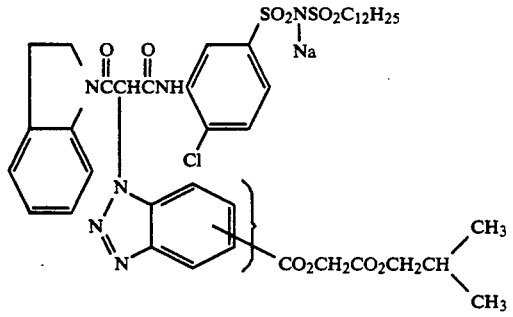
Y-161
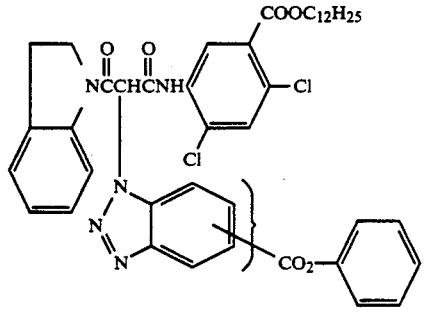
Y-162
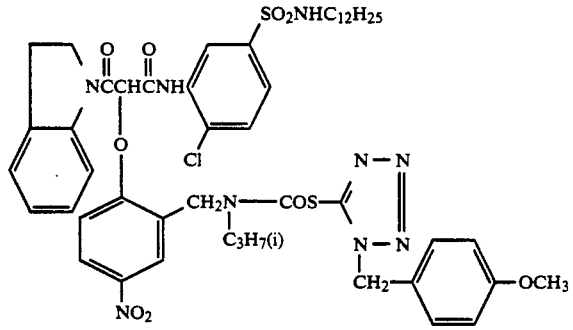
Y-163
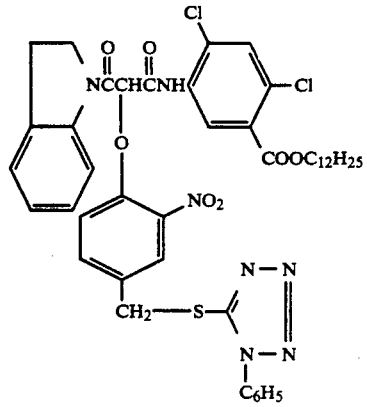
Y-164

-continued
Y-165
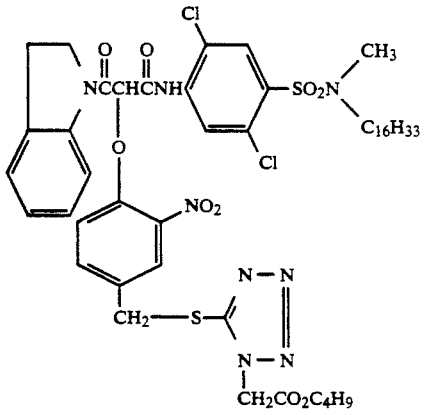
Y-166
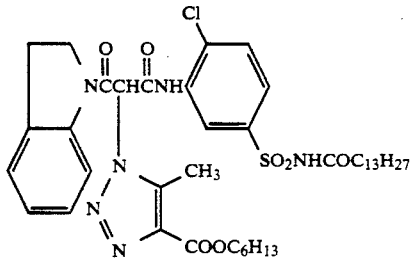
Y-167
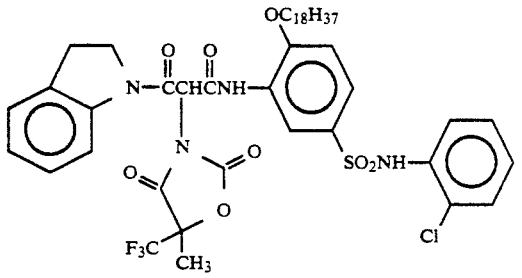
Y-168
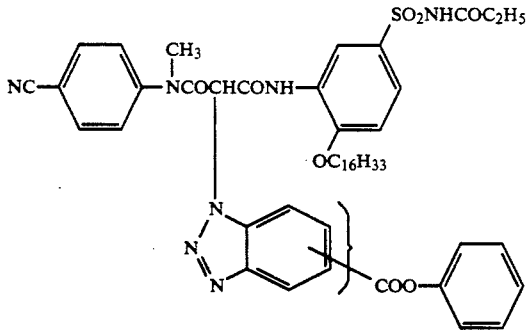
Y-169
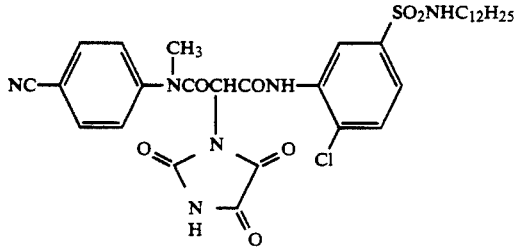

-continued
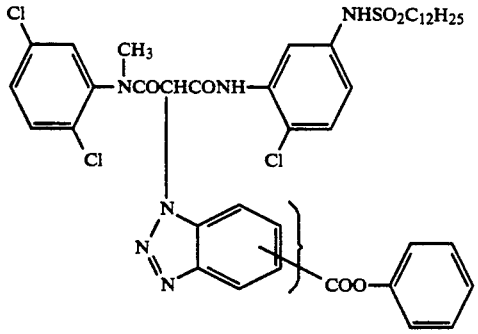
Y-170
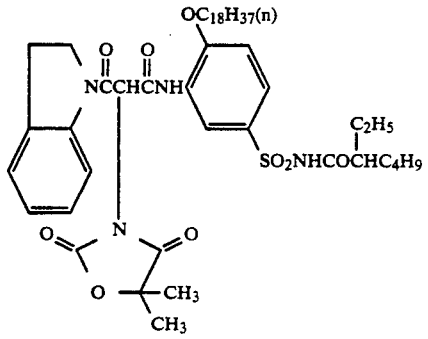
Y-171
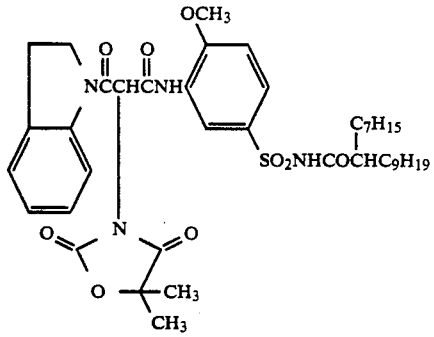
Y-172
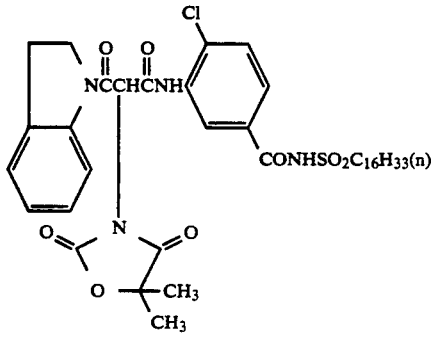
Y-173

-continued
Y-174
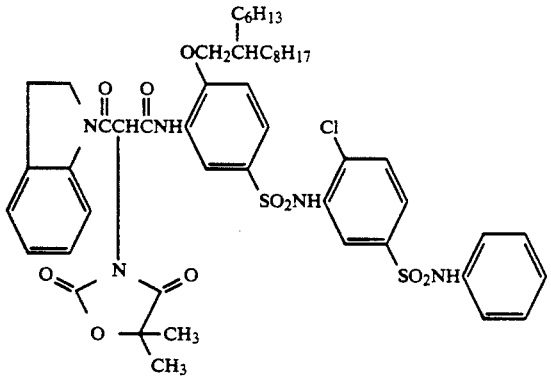
Y-175
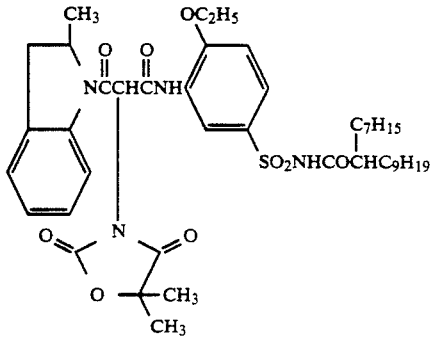
Y-176
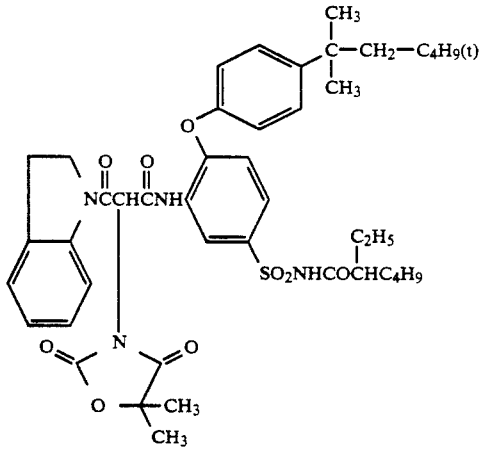
Y-177
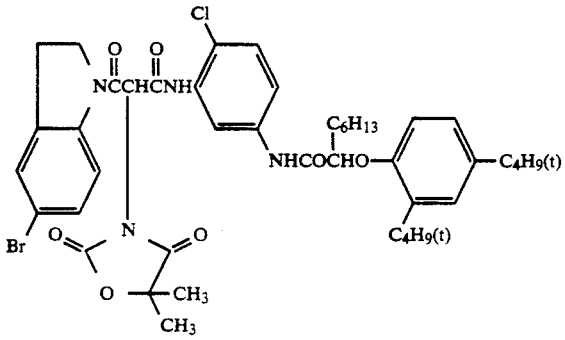

-continued
Y-178
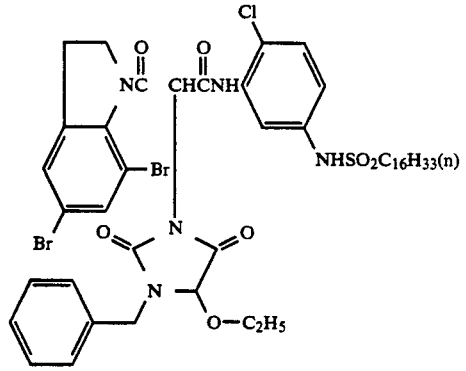
Y-179
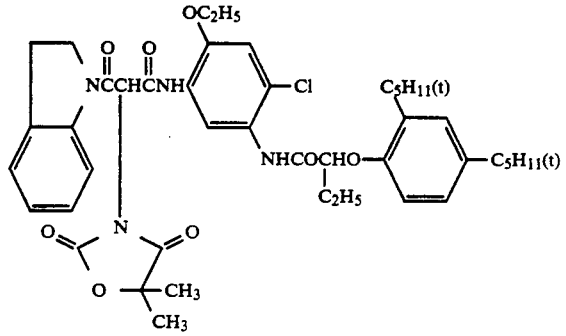
Y-180
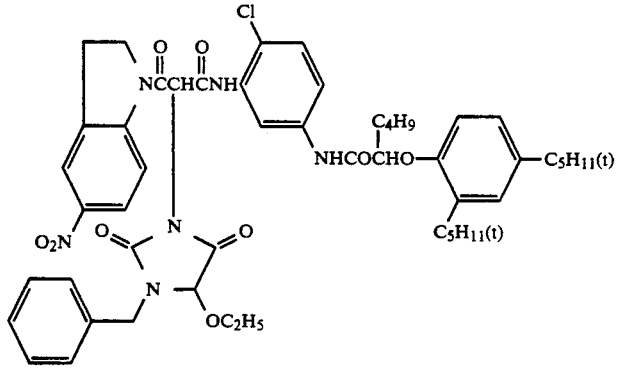
Y-181
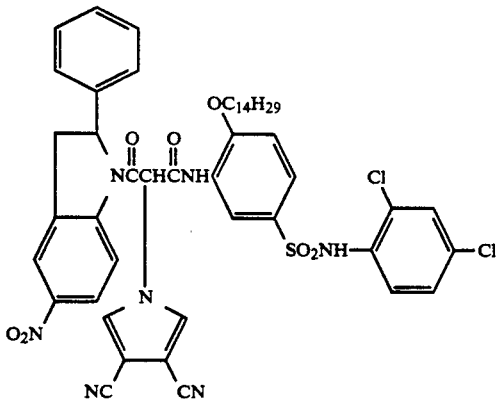
Synthesis examples of compounds represented by formula (II) and (II) or (II-1), (III-1), and (III-2) are shown below.
SYNTHESIS EXAMPLE 3

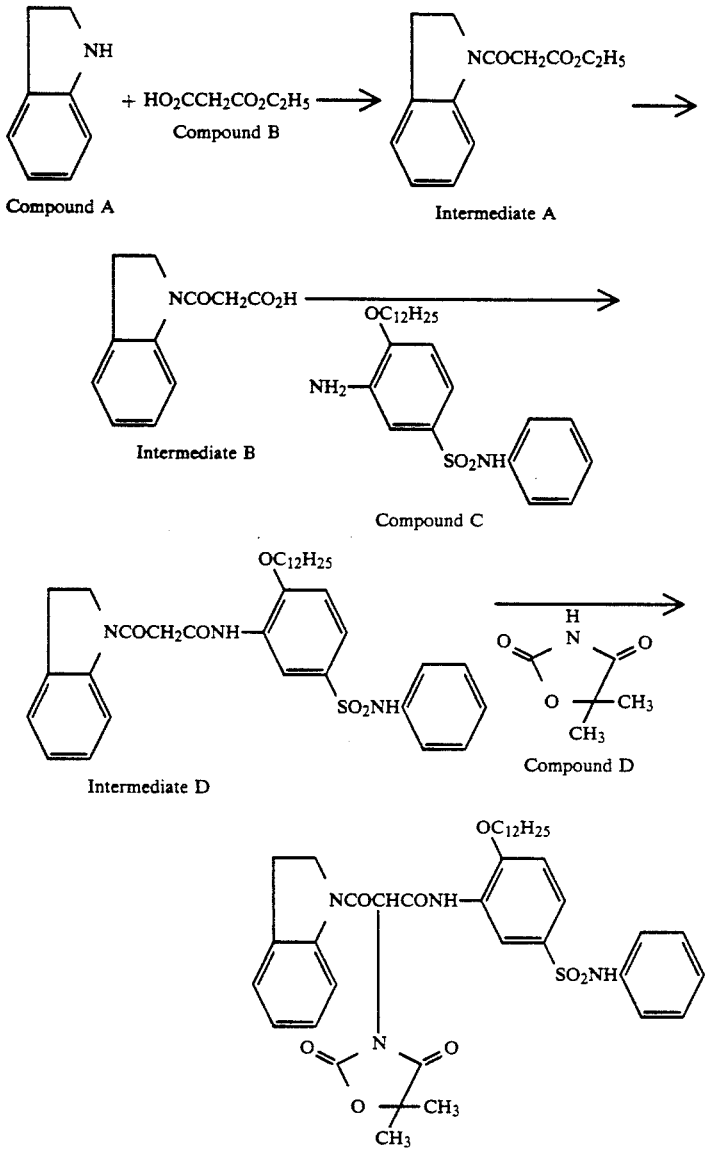

Synthesis of Intermediate B 357.5 g (3.0 mol) of Compound A and 396.3 g (3.0 mol) of Compound BA were dissolved in 1.2 liters of ethyl acetate and 0.6 liters of dimethylformamide. To the resulting solution, a solution of 631 g (3.06 mol) of dicyclohexylcarbodiimide in acetonitrile (400 ml) was added dropwise at 15° to 35° C. with stirring. After reacting for 2 hours at 20° to 30° C., the deposited dicyclohexyl urea was filtered off.

500 ml of ethyl acetate and 1 liter of water were added to the filtrate and the water layer was removed. Then, the organic layer was washed twice with 1 liter of water each time. After the organic layer was dried over anhydrous sodium sulfate, the ethyl acetate was distilled off under reduced pressure, to obtain an oil of 692 g (98.9%) of Intermediate A.

692 g (2.97 mol) of the Intermediate A was dissolved in 3 liters of ethyl alcohol and, to the resulting solution, 430 g of 30% sodium hydroxide was added dropwise at 75° to 80° C. with stirring. After the addition, the reaction was continued for 30 min at the same temperature and the deposited crystals were filtered (yield: 658 g).

The crystals were suspended in 5 liters of water and 300 ml of concentrated hydrochloric acid was added dropwise to the suspension at 40° to 50° C. After stirring for 1 hour at the same temperature, the crystals were filtered to obtain 579 g (95%) of Intermediate B (decomposition point: 127° C.).

Synthesis of Intermediate D 45.1 g (0.22 mol) of the Intermediate B and 86.6 g (0.2 mol) of Compound C were dissolved in 400 ml of ethyl acetate and 200 ml of dimethylacetamide. To the solution, a solution of 66 g (0.32 mol) of dicylohexylcarbodiimide in acetonitrile (100 ml) was added dropwise with stirring. After reacting for 2 hours at 20° to 30° C., the deposited dicyclohexyl urea was filtered off.

400 ml of ethyl acetate and 600 ml of water were added to the filtrate, and after the water layer was removed, the organic layer was washed with water twice. After the organic layer was dried over anhydrous sodium sulfate, the ethyl acetate was distilled off, to obtain 162 g of an oil.

This oil was crystallized from 100 ml of ethyl acetate and 300 ml of n-hexane, to obtain 108 g (87.1%) of Intermediate D. (melting point: 132° to 134° C.)

| Elemental analysis of Intermediate D | | | |
|---|---|---|---|
| | C % | H % | N % |
| Calculated | 67.82 | 7.32 | 6.78 |
| Found | 67.81 | 7.32 | 6.76 |

Synthesis of Exemplified Coupler Y-101

49.6 g (0.08 mol) of the Intermediate D was dissolved in 300 ml of dichloromethane. To the solution, 11.4 g (0.084 mol) of sulfuryl chloride was added dropwise at 10° to 15° C. with stirring.

After reacting for 30 min at the same temperature, 200 g of a 5% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 47 g of an oil.

47 g of this oil was dissolved in 200 ml of acetonitrile and, to the solution, 28.4 g (0.22 mol) of Compound D and 22.2 g (0.22 mol) of triethylamine were added with stirring. After reacting for 4 hours at 40° to 50° C., the reaction mixture was poured into 300 ml of water, and the deposited oil was extracted with 300 ml of ethyl acetate. The organic layer was washed with 200 g of 5% aqueous sodium hydroxide solution and then twice with 300 ml of water each time. After the organic layer was acidified with diluted hydrochloric acid, the organic layer was washed with water twice and was concentrated under reduced pressure, to obtain a residue (yield: 70 g).

The obtained oily substance was crystallized from 50 ml of ethyl acetate and 100 ml of n-hexane, to obtain 47.8 g (80%) of Exemplified Coupler Y-101. (melting point: 145° to 147° C.)

| Elemental analysis of Exemplified Coupler Y-101 | | | |
|---|---|---|---|
| | C % | H % | N % |
| Calculated | 64.32 | 6.75 | 7.50 |
| Found | 64.31 | 6.73 | 7.50 |

SYNTHESIS EXAMPLE 4

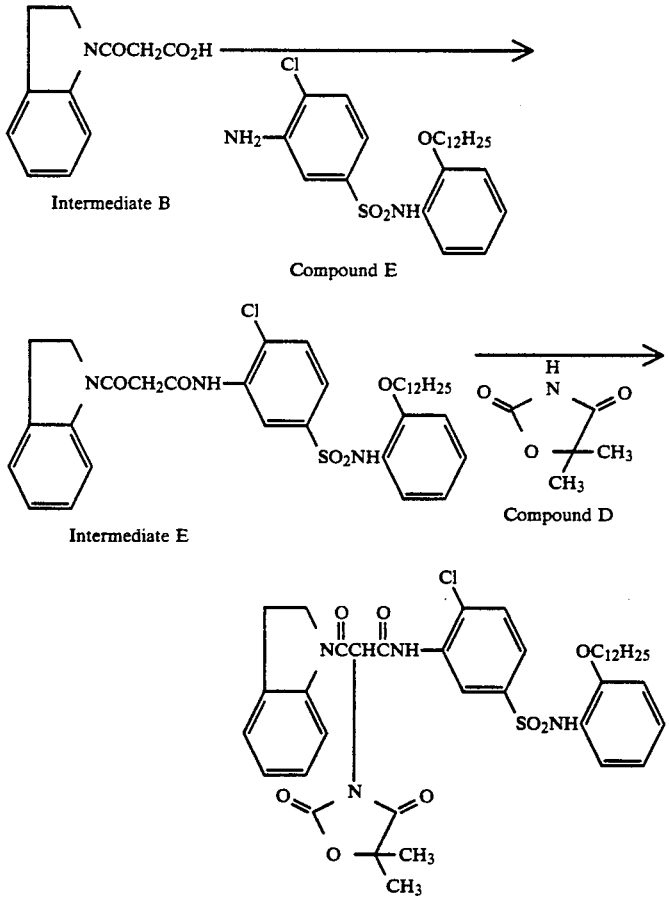

Synthesis of Intermediate E 90.3 g (0.44 mol) of the Intermediate B and 187 g (0.4 mol) of Compound E were dissolved in 500 ml of ethyl acetate and 300 ml of dimethylformamide. To the solution, a solution of 131.9 g (0.64 mol) of dicyclohexylcarbodiimide in acetonitrile (200 ml) was added dropwise at 15° to 30° C. with stirring.

After reacting for 2 hours at 20° to 30° C., the deposited dicyclohexyl urea was filtered off. To the filtrate, 500 ml of ethyl acetate and 600 ml of water were added, and after the water layer was removed, the organic layer was washed with water twice. After the organic layer was dried over anhydrous sodium sulfate, the ethyl acetate was distilled off under reduced pressure, to obtain 281 g of an oil. The oil was dissolved in 1.5 liters of n-hexane by heating, and undissolved matter was filtered and removed. The n-hexane solution was cooled with water, and the deposited Intermediate E was filtered. The yield was 243.4 g (93%) and the melting point was 103° to 105° C.

Elemental analysis of Intermediate E

| | C % | H % | N % |
|---|---|---|---|
| Calculated | 64.25 | 6.78 | 6.42 |
| Found | 64.24 | 6.76 | 6.43 |

Synthesis of Exemplified Coupler Y-110

39.3 g (0.06 mol) of the Intermediate E was dissolved in 200 ml of dichloromethane. To the solution, 8.7 g (0.064 mol) of sulfuryl chloride was added dropwise at 10° to 15° C. with stirring.

After reacting for 30 min at the same temperature, 200 g of a 4% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 41.3 g of an oil.

41.3 g of this oil was dissolved in 100 ml of acetonitrile and 200 ml of dimethylacetamide and, to the solution, 20.8 g (0.16 mol) of Compound D and 16.2 g of triethylamine were added with stirring. After reacting for 3 hours at 30° to 40° C., the reaction mixture was poured into 400 ml of water, and the deposited oil was extracted with 300 ml of ethyl acetate. The organic layer was washed with 300 g of 2% aqueous sodium hydroxide solution, and then with water twice. Then after the organic layer was acidified with diluted hydrochloric acid, the organic layer was washed with water twice and was concentrated under reduced pressure, to obtain 42 g of a residue.

The residue was crystallized from 200 ml of methanol, to obtain 39.8 g (85%) of Exemplified Coupler Y-110. (melting point: 110° to 112° C.)

Elemental analysis of Exemplified Coupler Y-110

| | C % | H % | N % |
|---|---|---|---|
| Calculated | 61.48 | 6.32 | 7.17 |
| Found | 61.46 | 6.30 | 7.18 |

SYNTHESIS EXAMPLE 5

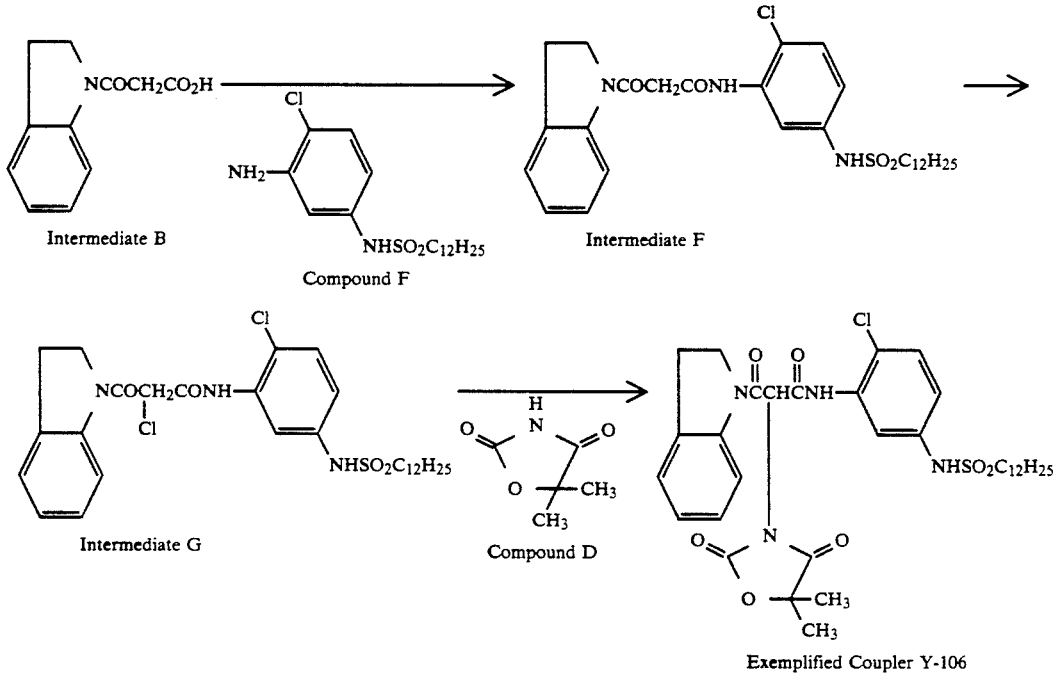

Synthesis of Intermediate F 104.7 g (0.51 mol) of the Intermediate B and 187.5 g (0.5 mol) of Compound F were dissolved in 1 liter of ethyl acetate and 400 ml of dimethylformamide. To the solution, a solution of 107.3 g (0.525 mol) of dicyclohexylcarbodiimide in dimethylformamide (100 ml) was added dropwise at 15° to 30° C. with stirring.

After reacting for 1 hour at 20° to 30° C., 500 ml of ethyl acetate was added; then the reaction mixture was heated to 50° to 60° C., and dicyclohexyl urea was filtered off.

To the filtrate, 600 ml of water was added, and after the water layer was removed, washing with water was carried out twice. After the organic layer was dried over anhydrous sodium sulfate, the ethyl acetate was distilled off under reduced pressure, to obtain 290 g of an oil. The oil was heated together with 1 liter of ethyl acetate and 2 liters of methanol; then undissolved matter was filtered and removed, and upon cooling of the filtrate with water, crystals of Intermediate F deposited, which were filtered. The yield was 267 g (95%) and the melting point was 163° to 164° C.

| Elemental analysis of Intermediate F | C % | H % | N % |
|---|---|---|---|
| Calculated | 61.95 | 7.17 | 7.48 |
| Found | 67.93 | 7.17 | 7.46 |

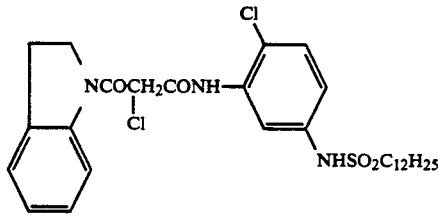

Intermediate G

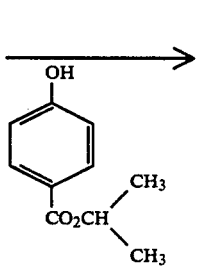

Compound G

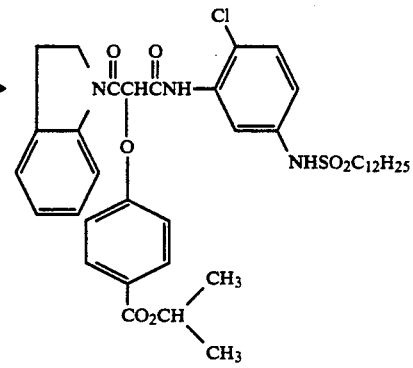

Exemplified Coupler Y-143

Synthesis of Intermediate G 114.0 g (0.2 mol) of the Intermediate G was dissolved in 500 ml of dichloromethane. To the solution, 28.4 g (0.21 mol) of sulfuryl chloride was added dropwise at 10° to 15° C. with stirring.

After reacting for 30 min at the same temperature, 500 g of a 6% aqueous sodium bicarbonate solution was added dropwise to the reaction mixture. After the organic layer was separated, it was washed with 500 ml of water and dried over anhydrous sodium sulfate. The dichloromethane was distilled off under reduced pressure, to deposit crystals of Intermediate G, which were filtered. Yield: 108.6 g (91%)

Synthesis of Exemplified Coupler Y-106

29.8 g (0.05 mol) of the Intermediate G was dissolved in 80 ml of dimethylformamide, 12.9 g (0.1 mol) of Compound D was added to the solution, and then 10.1 g (0.01 mol) of triethylamine was added dropwise thereto at 20° to 30° C. with stirring. After reacting at 40° to 45° C. for 1 hour, 300 ml of ethyl acetate and 200 ml of water were added to the reaction mixture.

After the organic layer was washed twice with 400 g of 2% aqueous sodium hydroxide solution, the organic layer was washed with water once. After the organic layer was acidified with diluted hydrochloric acid, the organic layer was washed with water twice and was concentrated, to obtain 24 g of a residue. The residue was crystallized from a mixed solvent of 50 ml of ethyl acetate and 150 ml of n-hexane, to obtain 19 g of Exemplified coupler Y-106.

The crystals were recrystallized from 120 ml of a mixed solvent of ethyl acetate/n-hexane (⅓ in vol/vol), to obtain 15 g (43.5% of Exemplified Coupler Y-106. (melting point: 135° to 136° C.)

| Elemental analysis of Exemplified Coupler Y-106 | C % | H % | N % |
|---|---|---|---|
| Calculated | 59.24 | 6.58 | 8.13 |
| Found | 59.27 | 6.56 | 8.12 |

SYNTHESIS EXAMPLE 6

Synthesis Example Y-143

27.0 g (0.15 mol) of the Intermediate G and 15.2 g (0.15 mol) of triethylamine were dissolved in 50 ml of dimethylformamide. To this mixture, a solution of 9.8 g (0.005 mol) of the Intermediate G in dimethylformamide (30 ml) was added dropwise with stirring.

After reacting for 4 hours at 30° to 40° C., 400 ml of ethyl acetate and 300 ml of water were added to the reaction mixture. The organic layer was washed twice with 400 g of 2% aqueous sodium hydroxide solution and then with water twice. After the organic layer was acidified with diluted hydrochloric acid, the organic layer was washed with water twice and was dried over anhydrous sodium sulfate. The ethyl acetate was distilled off under reduced pressure, to obtain 54 g of a residue.

The residue was crystallized from 300 ml of a mixed solvent of ethyl acetate/methanol (½ in vol/vol) and the crystals were filtered, to obtain Exemplified Coupler Y-143. The obtained crystals were recrystallized from 200 ml of a mixed solvent of ethyl acetate/methanol (½ in vol/vol) to obtain 28.8 g (77.8%) of Exemplified Coupler Y-143. (melting point: 190° to 191° C.)

| Elemental analysis of Exemplified Coupler Y-143 | C % | H % | N % |
|---|---|---|---|
| Calculated | 63.26 | 6.81 | 5.68 |
| Found | 63.24 | 6.79 | 5.67 |

Formula (IV) will be described below in detail.

The alkyl group represented by $R_{41}$ and $R_{42}$ in formula (IV) may be substituted or unsubstituted and is preferably an alkyl group having 1 to 24 carbon atoms, such as a methyl group, an ethyl group, an isopropyl group, a t-butyl group, a 2-ethylhexyl group, a dodecyl group, and a t-octyl group. The cycloalkyl group represented by $R_{41}$ and $R_{42}$ may be substituted or unsubstituted and is preferably a cycloalkyl group having 5 to 24 carbon atoms, such as a cyclopentyl group and a cyclohexyl group. The alkenyl group represented by $R_{41}$ and $R_{42}$ may be substituted or unsubstituted and is preferably an alkenyl group having 3 to 24 carbon atoms, such as an allyl group and a 2,9-pentadienyl group. The aryl group represented by $R_{41}$ and $R_{42}$ may be substituted or unsubstituted and examples thereof are a phenyl group, a spiroindane ring group, a chroman ring group, and a naphthyl group. The heterocyclic group represented by $R_{41}$ and $R_{42}$ may be substituted or unsubstituted and examples thereof include a pyridyl group, an imidazolyl group, a tetrazolyl group, an oxazolyl group, a thiazolyl group, a benzimidazolyl group, a benzthiazolyl group, a benzoxazolyl group, a pyrimidyl group, an indolyl group, a pyrrolyl group, a pyrazolyl group, a purinyl group, a quinolyl group, an isooxazolyl group, an oxadiazolyl group, a thiadiazolyl group, a triazolyl group, a furyl group, and a succinimidoyl group.

Each of the groups represented by $R_{41}$ and $R_{42}$ mentioned above may be substituted, and examples of the substituent include a hydroxy group, an alkoxy group, an aryl group, an acylamino group, a sulfonamido group, an aryloxy group, an alkylthio group, an arylthio group, a carbamoyl group, a sulfonyl group, a nitro group, a cyano group, a carboxyl group, an alkylamino group, an alkoxycarbonyl group, an acyl group, an acyloxy group, and a halogen atom.

$R_{41}$ and $R_{42}$ may bond together to form a 5- to 7-membered ring, which is represented by the following formula (V):

Formula (V):

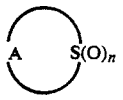

wherein A represents a divalent group to form the above sulfur-containing 5- to 7-membered ring, and n has the same meaning as defined above.

Specific examples of the above-mentioned sulfur-containing 5- to 7-membered ring in formula (V) are mentioned in specific examples of formula (IV) mentioned later.

Out of the dye image stabilizers having formula (IV), preferable ones are represented by the following formulas (IV-A), (IV-B), (IV-C), and (IV-D):

Formula (IV-A):

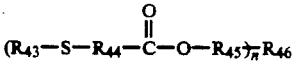

wherein n=1 or 4; when n=1, $R_{43}$ represent an alkoxycarbonylalkyl group, $R_{44}$ represents an alkylene group, $R_{45}$ represents a methylene group, and $R_{46}$ represents a hydrogen atom or an alkyl group having 1 to 19 carbon atoms, and $R_{43}$ may be the same as the group represented by one of $R_{44}$ to $R_{46}$; and when n=4, $R_{43}$ represents an alkyl group having 1 to 20 carbon atoms, $R_{44}$ represents an alkylene group, $R_{45}$ represents an alkylene group or an arylene group, and $R_{46}$ represents a carbon atom.

Formula (IV-B):

-continued

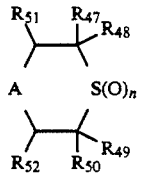

wherein $R_{48}$ and $R_{49}$ each represent a hydrogen atom or an alkyl group, $R_{47}$ and $R_{50}$ each represent a hydrogen atom, an alkyl group, an aryl group, or a heterocyclic group, $R_{51}$ and $R_{52}$ each represent a hydrogen atom, an alkyl group, an aryl group, an acyl group, or an alkoxycarbonyl group, n is an integer of 0 to 2, and A represents a divalent group to form the abovementioned sulfur-containing 5- to 7-membered ring.

Formula (IV-C):

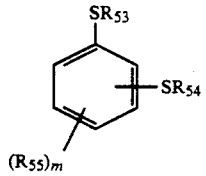

wherein $R_{53}$ and $R_{54}$ each represent an alkyl group, an alkenyl group, a cycloalkyl group, a hetero group, or an acyl group, $R_{55}$ represents a halogen atom, an alkyl group, an aryl group, an alkylthio group, an arylthio group, an amino group, an alkylamino group, an arylamino group, an acylamino group, a sulfonamido group, a ureido group, an acyl group, a carbamoyl group, an alkoxycarbonyl group, a sulfonyl group, a sulfamoyl group, a nitro group, a cyano group, or a carboxyl group, and m is an integer of 0 to 4.

Formula (IV-D):

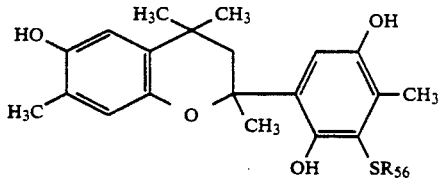

wherein $R_{56}$ represents a substituted or unsubstituted alkyl group having 1 to 24 carbon atoms.

Among compounds represented by the abovementioned formulas (IV-A) to (IV-D), compounds represented by formula (IV-B) are particularly preferable.

The compounds represented by formula (IV) may be used as a mixture of two or more, and also they may be used in combination with conventionally used anti-fading additives.

Although the amount of the compound represented by formula (IV) to be used will vary depending on the type of yellow coupler used with the compound, the desired aim can be attained when the compound is used in an amount of 0.5 to 200 wt %, preferably 2 to 150 wt %, based on the yellow coupler. Generally preferably the compound represented by formula (IV) is co-emulsified with yellow couplers represented by formulas (I), (II), and (III).

Specific examples of the compound represented by formula (IV) are given below, but the present invention is not limited to them.
$C_{12}H_{25}SCH_2CH_2CO_2CH_3$ IV-1
$C_{14}H_{29}SCH_2CH_2CO_2C_2H_5$ IV-2
$C_{18}H_{37}S(CH_3)CHCH_2CO_2C_4H_9$ IV-3
$S(CH_2CH_2COOC_8H_{16})_2$ IV-4
$S(CH_2CH_2COOC_{13}H_{27})_2$ IV-5
$S(CH_2CH_2COOC_{18}H_{37})_2$ IV-6
$[H_{25}C_{12}SCH_2CH_2COOCH_2]_4C$ IV-7
$[H_{25}C_{12}SCH_2CH_2COOCH_2CH_2]_4C$ IV-8
IV-9
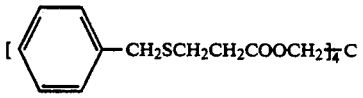
IV-10
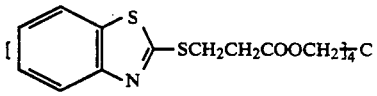
IV-11
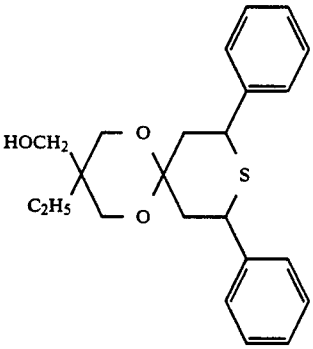
IV-12
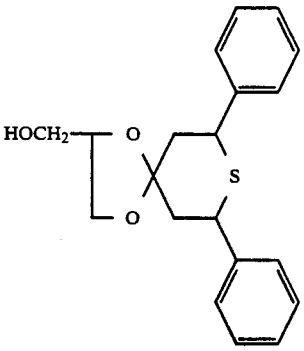
IV-13
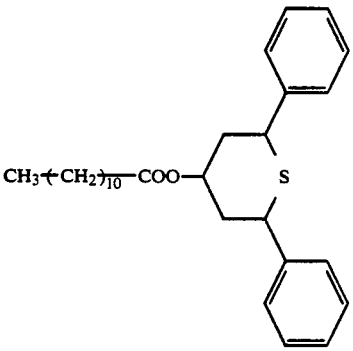
-continued
IV-14
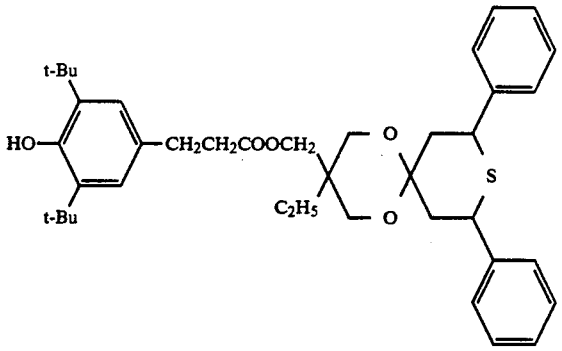
IV-15
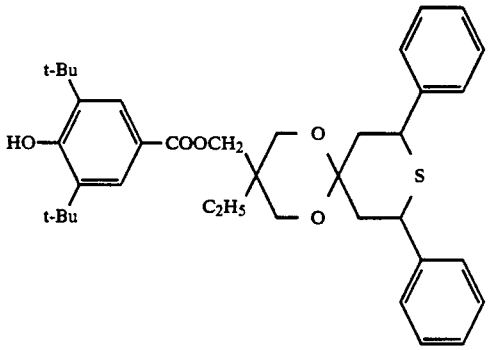
IV-16
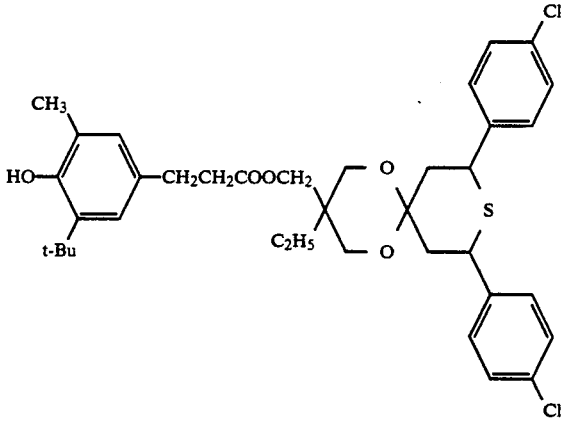
IV-17
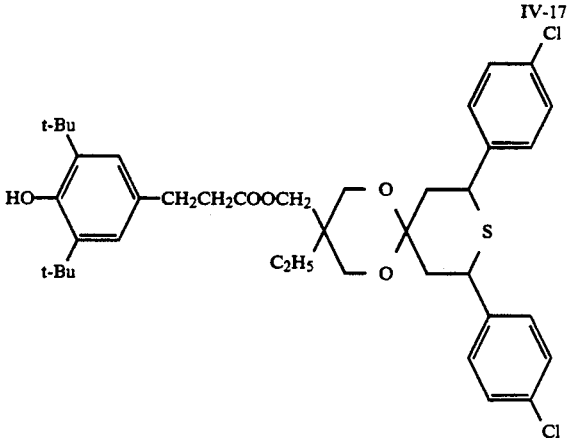

-continued

IV-18

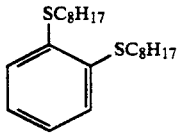

IV-19

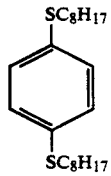

IV-20

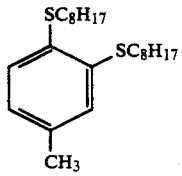

IV-21

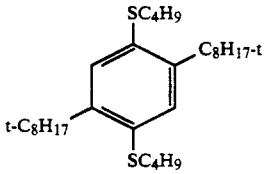

IV-22

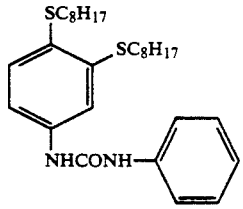

IV-23

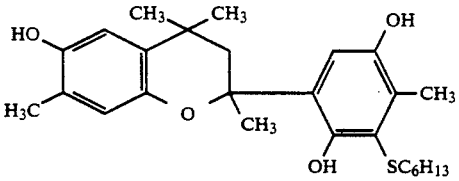

IV-24

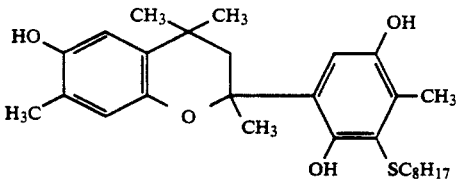

IV-25

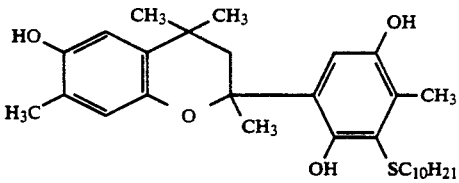

The amount of the yellow coupler represented by formula (I), (II), or (III) to be added may be suitably 0.1 to 1.0 mol, preferably 0.1 to 0.5 mol, per mol of silver halide.

Although, as a silver halide used in the present invention, for example, silver chloride, silver bromide, silver bromo(iodo)chloride, and silver bromoiodide can be used, particularly if rapid processing is intended, a silver chloride emulsion or a silver bromochloride emulsion substantially free from silver iodide and having a silver chloride content of 90 mol % or more, preferably 95 mol % or more, particularly preferably 98 mol % or more, is used preferably.

In the photographic material according to the present invention, in order to improve, for example, sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt % or more (preferably 14 wt % or more) of titanium oxide the surface of which has been treated with secondary to quaternary alcohol (e.g., trimethylolethane) or the like is contained in a water-resistant resin layer of the support.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in JP-A No. 215272/1987, from page 137 (right lower column) to page 144 (right upper column).

The cyan, magenta, or yellow coupler can be emulsified and dispersed into a hydrophilic colloid, by impregnating into a loadable latex polymer (e.g., see U.S. Pat. No. 4,203,716) in the presence or absence of the above high-boiling organic solvent or by dissolving into a polymer insoluble in water but soluble in organic solvents.

Preferably, homopolymers and copolymers described in U.S. Pat. No. 4,857,449 and International Publication WO 88/00723, pages 12 to 30, are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional color development processing, and then preferably it is subjected to bleach-fix processing for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing | p. 144 lower left column line 1 to p. 146 upper | p. 27 lower right column line 10 to p. 28 upper left | p. 63 line 51 to p. 64 line 56 |

-continued

| Element constituting photographic material | JP-A No. 215272/1987 | JP-A No. 33144/1990 | EP 0,355,660A2 |
|---|---|---|---|
| additives for photograph | right column line 7 | column last line and p. 35 lower right column line 12 to p. 36 upper right column line 7 | |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Anti-static agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processng method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included.

Further, as cyan couplers for combination use, diphenylimidazole series cyan couplers described in JP-A No. 33144/1990, as well as 3-hydroxypyridine series cyan couplers described in European Patent EP 0,333,185A2 (in particular one obtained by causing Coupler (42), which is a four-equivalent coupler, to have a chlorine coupling split-off group, thereby rendering it to two-equivalent, and Couplers (6) and (9), which are listed as specific examples, are preferable) and cyclic active methylene cyan dye-forming couplers described in JP-A No. 32260/1990 (in particular, specifically listed Coupler Examples 3, 8, and 34 are preferable) are preferably used.

As a method for color development processing of a photographic material using a high-silver-chloride emulsion having a silver chloride content of 90 mol % or more, the method described in, for example, JP-A No. 207250/1990, page 27 (the left upper column) to page 34 (the right upper column), is preferably used.

The silver halide color photographic material according to the present invention is outstanding in color-formation, and is improved in image-keeping property, in particularly, exhibits its effect in that the color balance does not change after storage for a long period either in dark or under irradiation of light.

The present invention will be described in more detail in accordance with Examples, but the invention is not limited to these Examples.

EXAMPLE 1

A multilayer color print paper (Sample 123) having layer compositions shown below was prepared on a paper support laminated on both sides thereof with polyethylene film. Coating solutions were prepared as follows:

Preparation of the Fifth Layer Coating Solution

To a mixture of 19.1 g of yellow coupler (Exemplified Coupler Y-150), 4.4 g of image-dye stabilizer (Cpd-1), and 0.7 g of image-dye stabilizer (Cpd-7) were added and dissolved 27.2 ml of ethyl acetate and each 4.1 g of solvent (Solv-3) and solvent (Solv-7). The resulting solution was dispersed and emulsified in 185 ml of 10% aqueous gelatin solution containing 8 ml of sodium dodecylbenzenesulfonate, thereby prepared emulsified dispersion. Separately silver chlorobromide emulsion A (cubic grains, 3:7 (silver molar ratio) blend of large size grain emulsion A and small size grain emulsion A having 0.88 μm and 0.70 μm of average grain size, respectively, each in which 0.3 mol % of silver bromide was located at the surface of grains) was prepared, and yellow color forming sensitizing dyes A and B, shown below, were added in this emulsion in such amount of $2.0\times10^{-4}$ mol to the large size emulsion A and $2.5\times10^{-4}$ mol to the small size emulsion B, per mol of silver, respectively. The chemical ripening was carried out by adding sulfur and gold sensitizing agents. The above-described emulsified dispersion and this emulsion were mixed together and dissolved to give the composition shown below, thereby preparing the first layer coating solution. Coating solutions for the second to the seventh layer were also prepared in the same manner as the first layer coating solution. As a gelatin hardener for the respective layers, 1-hydroxy-3,5-dichloro-s-triazine sodium salt was used.

As spectral-sensitizing dyes for the respective layers, the following compounds were used:

Sensitizing dye A for yellow color-forming emulsion layer

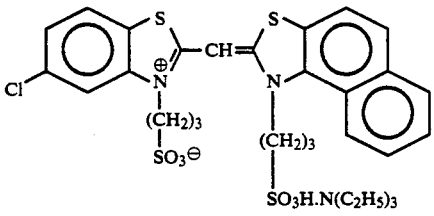

Sensitizing dye B for yellow color-forming emulsion layer

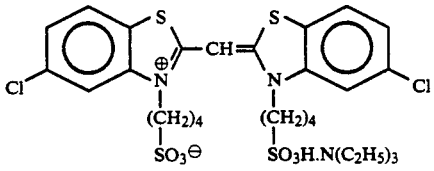

(each $2.0\times10^{-4}$ mol to the large size emulsion and $2.5\times10^{-4}$ mol to the small size emulsion, per mol of silver halide.)

Sensitizing dye C for magenta color-forming emulsion layer

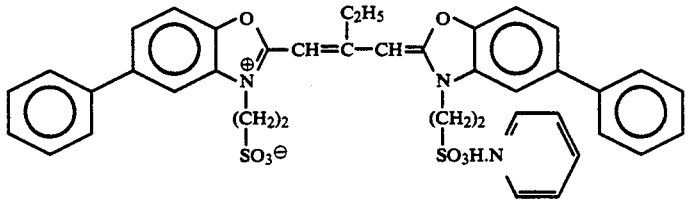

($4.0\times10^{-4}$ mol to the large size emulsion and $5.6\times10^{-4}$ mol to the small size emulsion, per mol of silver halide)

Sensitizing dye D for magenta color-forming emulsion layer

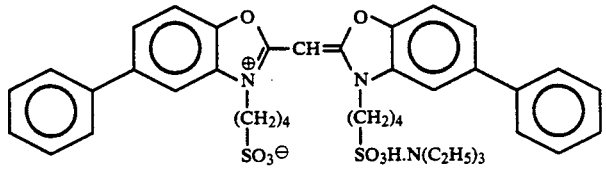

-continued $7.0 \times 10^{-5}$ mol to the large size emulsion and $1.0 \times 10^{-5}$ mol to the small size emulsion, per mol of silver halide)

Sensitizing dye E for cyan color-forming emulsion layer

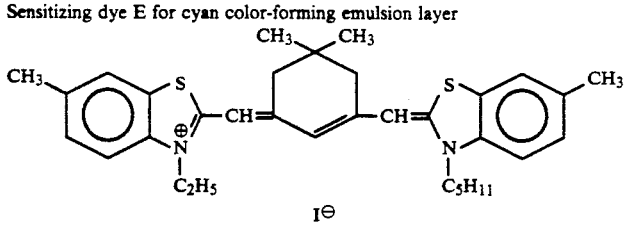

($0.9 \times 10^{-4}$ mol to the large size emulsion and $1.1 \times 10^{-4}$ mol to the small size emulsion, per mol of silver halide)

To the cyan color-forming emulsion layer, the following compound was added in an amount of $2.6 \times 10^{-3}$ mol per mol of silver halide:

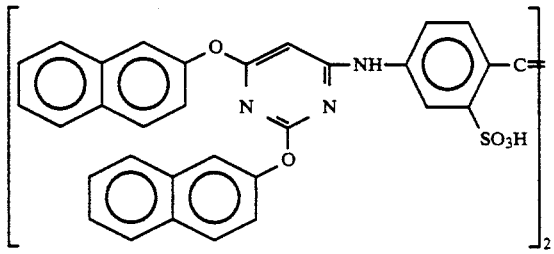

Further, 1-(5-methylureidophenyl)-5-mercaptotetrazole was added to the yellow color-forming emulsion layer, the magneta color-forming emulsion layer, and the cyan color-forming emulsion layer in amount of $8.5 \times 10^{-5}$ mol, $7.0 \times 10^{-4}$ mol, and $2.5 \times 10^{-4}$ mol, per mol of silver halide, respectively.

Further, 4-hydroxy-6-methyl-1,3,3a,7-tetrazaindene was added to the yellow color-forming emulsion layer and the magenta color-forming emulsion layer in amount of $1 \times 10^{-4}$ mol and $2 \times 10^{-4}$ mol, per mol of silver halide, respectively.

The dyes shown below (figure in parentheses represents coating amount) were added to the emulsion layers for prevention of irradiation.

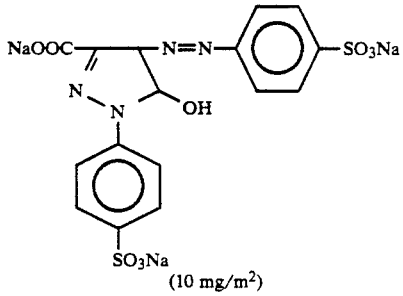

(10 mg/m²)

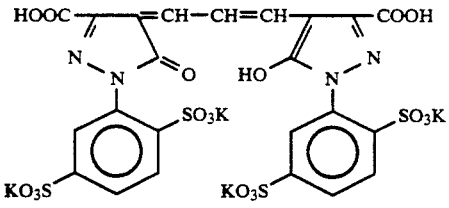

(10 mg/m²)

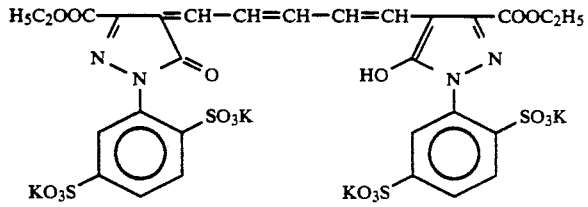

(40 mg/m²)

and

-continued

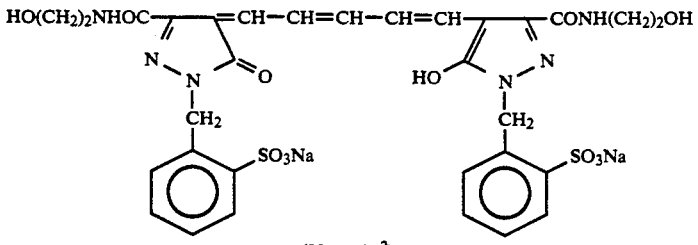

(20 mg/m²)

Composition of Layers

The composition of each layer is shown below. The figures represent coating amount (g/m²). The coating amount of each silver halide emulsion is given in terms of silver

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First Layer (Yellow color-forming emulsion layer) | |
| Silver chlorobromide emulsion (cubic grains, 3:7 (Ag mol ratio) blend of large size emulsion having average grain size of 0.88 μm and small size emulsion having average grain size of 0.70 μm, each of whose deviation coefficient of grain size distribution is 0.08 and 0.10, respectively, each in which 0.3 mol % of AgBr was located at the surface of grains) | 0.30 |
| Gelatin | 1.22 |
| Yellow coupler (ExY) | 0.80 |
| Solvent (Solv-3) | 0.10 |
| Solvent (Solv-6) | 0.10 |
| Image-dye stabilizer (Cpd-6) | 0.06 |
| Image-dye stabilizer (Cpd-9) | 0.01 |
| Second Layer (Color-mix preventing layer) | |
| Gelatin | 0.64 |
| Color-mix inhibitor (Cpd-4) | 0.08 |
| Solvent (Solv-1) | 0.16 |
| Solvent (Solv-4) | 0.08 |
| Third Layer (Magenta color-forming emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains) | 0.12 |

-continued

| | |
|---|---|
| Gelatin | 1.28 |
| Magenta coupler (ExM) | 0.23 |
| Image-dye stabilizer (Cpd-1) | 0.03 |
| Image-dye stabilizer (Cpd-2) | 0.16 |
| Image-dye stabilizer (Cpd-3) | 0.02 |
| Image-dye stabilizer (Cpd-8) | 0.02 |
| Solvent (Solv-2) | 0.40 |
| Fourth Layer (Ultraviolet rays-absorbing layer) | |
| Gelatin | 1.58 |
| Ultraviolet-absorber (UV-1) | 0.47 |
| Color-mix inhibitor (Cpd-4) | 0.05 |
| Solvent (Solv-5) | 0.24 |
| Fifth Layer (Cyan color-forming emulsion layer) | |
| Silver chlorobromide emulsions (cubic grains, 1:4 (Ag mol ratio) blend of large size emulsion having average grain size of 0.58 μm and small size emulsion having average grain size of 0.45 μm, each of whose deviation coefficient of grain size distribution is 0.09 and 0.11, respectively, each in which 0.6 mol % of AgBr was located at the surface of grains) | 0.23 |
| Gelatin | 1.04 |
| Cyan coupler (ExC) | 0.32 |
| Image-dye stabilizer (Cpd-1) | 0.03 |
| Image-dye stabilizer (Cpd-3) | 0.02 |
| Image-dye stabilizer (Cpd-5) | 0.18 |
| Image-dye stabilizer (Cpd-6) | 0.40 |
| Image-dye stabilizer (Cpd-7) | 0.05 |
| Solvent (Solv-1) | 0.08 |
| Sixth layer (Ultraviolet rays-absorbing layer) | |
| Gelatin | 0.48 |
| Ultraviolet absorber (UV-1) | 0.16 |
| Color-mix inhibitor (Cpd-4) | 0.02 |
| Solvent (Solv-5) | 0.08 |
| Seventh layer (Protective layer) | |
| Gelatin | 1.10 |
| Acryl-modified copolymer of polyvinyl alcohol (modification degree: 17%) | 0.17 |
| Liquid paraffin | 0.03 |

Compounds used are as follows:

(ExY) Yellow coupler

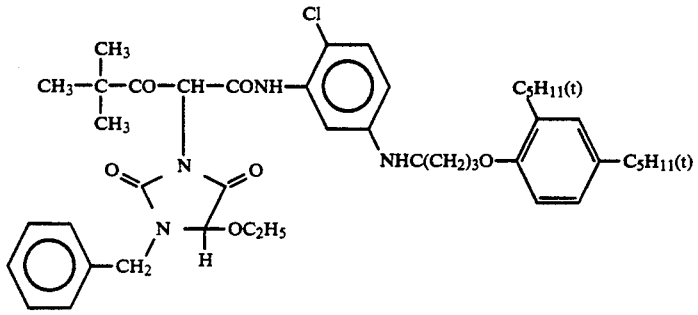

(ExM) Magenta coupler

-continued
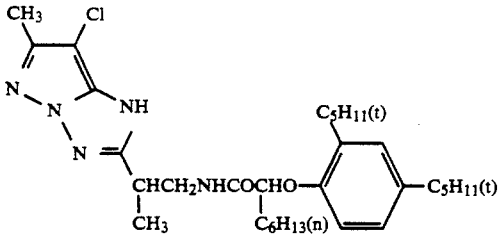
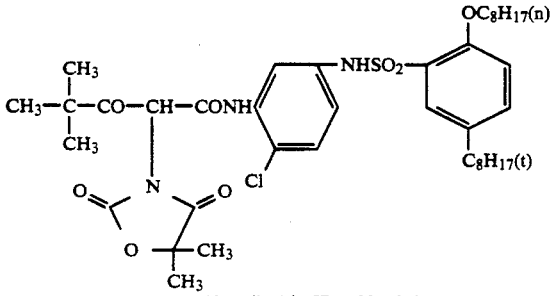
(YR-1)
(described in JP-A No. 313154/1988)
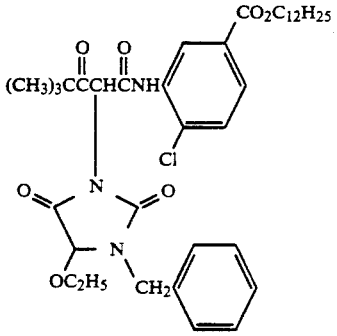
(YR-2)
(described in JP-A No. 57238/1984)
(described in JP-A No. 229029/1985)
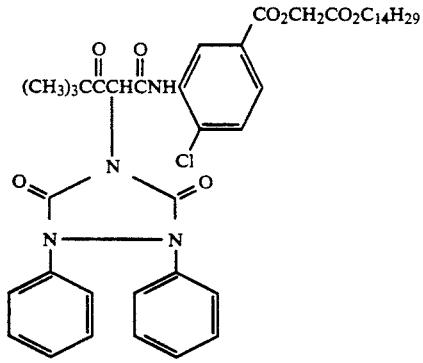
(YR-3)
(described in JP-A No. 20037/1982)
(ExC) Cyan coupler
Mixture (2:3:5 in molar ratio) of
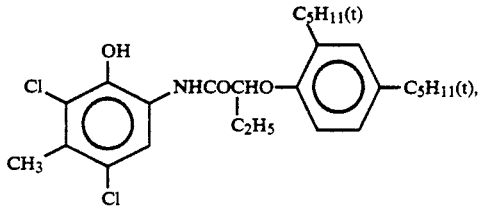

-continued
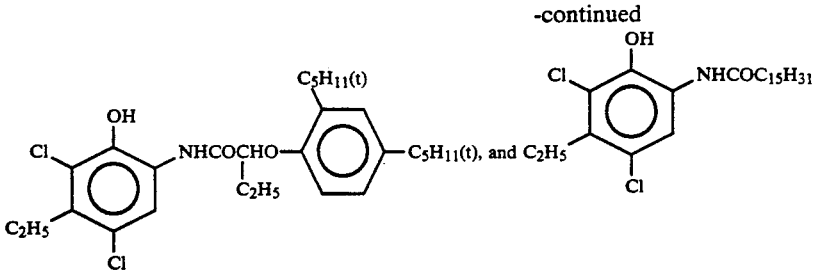
(Cpd-1) Image-dye stabilizer
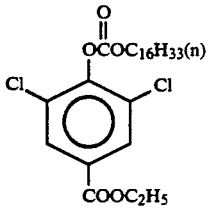
(Cpd-2) Image-dye stabilizer
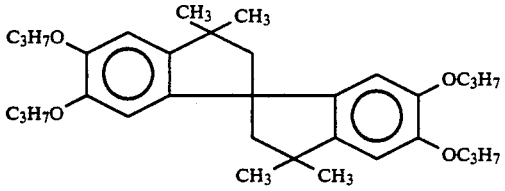
(Cpd-3) Image-dye stabilizer
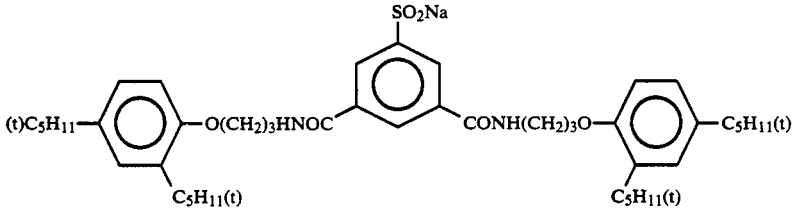
(Cpd-4) Color-mix inhibitor
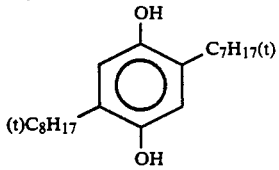
(Cpd-5) Image-dry stabilizer
Mixture (2:4:4 in weight ratio) of
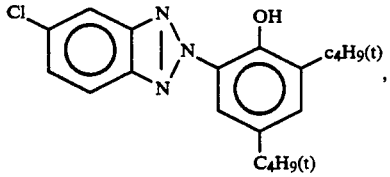
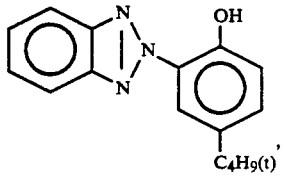
and -continued
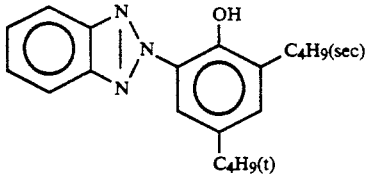
(Cpd-6) Image-dye stabilizer
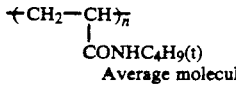
Average molecular weight: 60,000
(Cpd-7) Image-dye stabilizer
Mixture (1:1 in weight ratio) of
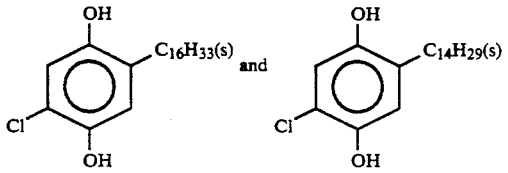
(Cpd-8) Image-dye stabilizer
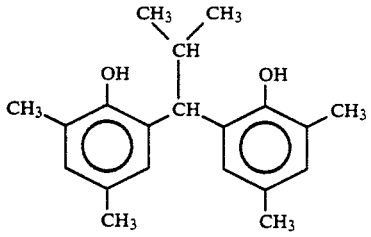
(Cpd-9) Image-dye stabilizer
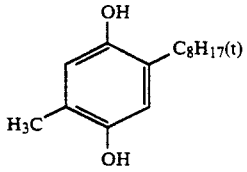
(Cpd-10) Antiseptic
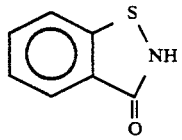
(Cpd-11) Antiseptic
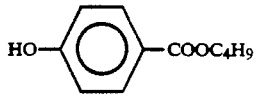
(UV-1) Ultraviolet ray absorber
Mixture (4:2:4 in weight ratio) of
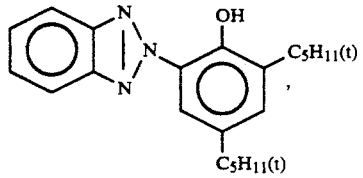

-continued

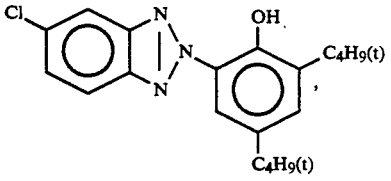

and

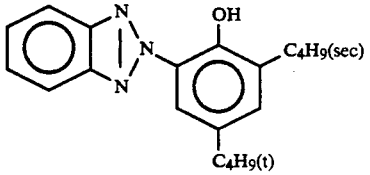

(Solv-1) Solvent

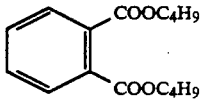

(Solv-2) Solvent
Mixture (1:1 in volume ratio) of

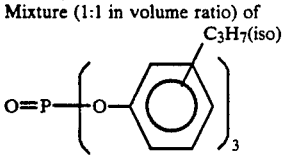

and

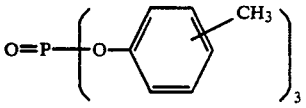

(Solv-3) Solvent
$O{=}P{\leftarrow}O{-}C_9H_{19}(iso)_3$ (Solv-4) Solvent

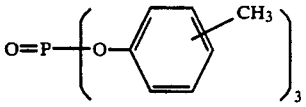

(Solv-5) Solvent

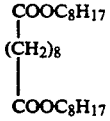

(Solv-6) Solvent
$C_8H_{17}CHCH(CH_2)_7COOC_8H_{17}$
O

The thus-prepared photographic material was named Sample 123.

Samples 100 to 122 and 124 to 143 were prepared in the s same manner as Sample 123, except that the yellow coupler and image-dye stabilizer in the first layer were changed as shown in Table 1.

TABLE 1

| Sample No. | 1st layer Yellow coupler | 1st layer Image-dye stabilizer | 3rd layer Magenta coupler | 5th layer Cyan coupler | Remarks |
|---|---|---|---|---|---|
| 100 | Y-29 | IV-5 | ExM | ExC | This Invention |
| 101 | Y-29 | IV-7 | " | " | " |
| 102 | Y-29 | IV-14 | " | " | " |
| 103 | Y-29 | IV-16 | " | " | " |
| 104 | Y-29 | IV-21 | " | " | " |
| 105 | Y-29 | IV-24 | " | " | " |

TABLE 1-continued

| Sample No. | 1st layer Yellow coupler | 1st layer Image-dye stabilizer | 3rd layer Magenta coupler | 5th layer Cyan coupler | Remarks |
|---|---|---|---|---|---|
| 106 | Y-29 | IV-25 | " | " | " |
| 107 | Y-1 | IV-5 | " | " | " |
| 108 | Y-1 | IV-14 | " | " | " |
| 109 | Y-1 | IV-21 | " | " | " |
| 110 | Y-1 | IV-24 | " | " | " |
| 111 | Y-115 | IV-5 | " | " | " |
| 112 | Y-115 | IV-14 | " | " | " |
| 113 | Y-115 | IV-21 | " | " | " |
| 114 | Y-115 | IV-24 | " | " | " |
| 115 | Y-150 | IV-5 | " | " | " |
| 116 | Y-150 | IV-14 | " | " | " |
| 117 | Y-150 | IV-21 | " | " | " |
| 118 | Y-150 | IV-24 | " | " | " |
| 119 | Y-131 | IV-14 | " | " | " |
| 120 | Y-151 | IV-14 | " | " | " |
| 121 | Y-152 | IV-14 | " | " | " |
| 122 | Y-153 | IV-14 | " | " | " |
| 123 | ExY | — | " | " | Comparison |
| 124 | ExY | IV-5 | " | " | " |
| 125 | ExY | IV-14 | " | " | " |
| 126 | ExY | IV-21 | " | " | " |
| 127 | ExY | IV-24 | " | " | " |
| 128 | Y-29 | — | " | " | " |
| 129 | Y-1 | — | " | " | " |
| 130 | Y-115 | — | " | " | " |
| 131 | Y-150 | — | " | " | " |
| 132 | YR-1 | IV-5 | " | " | " |
| 133 | YR-1 | IV-14 | " | " | " |
| 134 | YR-1 | IV-21 | " | " | " |
| 135 | YR-1 | IV-24 | " | " | " |
| 136 | YR-2 | IV-5 | " | " | " |
| 137 | YR-2 | IV-14 | " | " | " |
| 138 | YR-2 | IV-21 | " | " | " |
| 139 | YR-2 | IV-24 | " | " | " |
| 140 | YR-3 | IV-5 | " | " | " |
| 141 | YR-3 | IV-14 | " | " | " |
| 142 | YR-3 | IV-21 | " | " | " |
| 143 | YR-3 | IV-24 | " | " | " |

Then, each of samples was subjected to a gradation exposure to light through three color separated filter for sensitometry using a sensitometer (FWH model made by Fuji Photo Film Co., Ltd., the color temperature of light source was 3200 K.). At that time, the exposure was carried out in such a manner that the exposure amount was 250 CMS with the exposure time being 0.1 sec.

After exposure to light, each sample was subjected to a processing shown below.

| Processing step | Temperature | Time |
|---|---|---|
| Color developing | 35° C. | 45 sec |
| Bleach-fixing | 30–34° C. | 45 sec |
| Rinse (1) | 30–34° C. | 20 sec |
| Rinse (2) | 30–34° C. | 20 sec |
| Rinse (3) | 30–34° C. | 20 sec |
| Drying | 70–80° C. | 60 sec |

Note:
Rinsing steps were carried out in 3-tanks countercurrent mode from the tank of rinsing (3) toward the tank of rinsing (1).

The composition of each processing solution is as followed, respectively:

| Color-developer | |
|---|---|
| Water | 800 ml |
| Ethylenediamine-N,N,N',N'-tetramethylene phosphonic acid | 1.5 g |
| Potassium bromide | 0.015 g |
| Triethanolamine | 8.0 g |

-continued

| | |
|---|---|
| Sodium chloride | 1.4 g |
| Potassium carbonate | 25 g |
| N-ethyl-N-(β-methanesulfonamidoethyl)-3-methyl-4-aminoaniline sulfate | 5.0 g |
| N,N-Bis(carboxymethyl)hydrazine | 4.0 g |
| Monosodium N,N-di(sulfoethyl)-hydroxylamine | 4.0 g |
| Fluorescent whitening agent (WHITEX-4B, made by Sumitomo Chemical Ind.) | 1.0 g |
| Water to make | 1000 ml |
| pH (25° C.) | 10.45 |
| Bleach-fixing solution | |
| Water | 400 ml |
| Ammonium thiosulfate (70%) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Water to make | 1000 ml |
| pH (25°) | 6.0 |
| Rinse solution | |
| Ion-exchanged water (calcium and magnesium each are 3 ppm or below) | |

With respect to each color of the samples having color formed dye images formed in the above manner, the maximum density, the preservability under light and the preservability under heat in dark are tested as follows:

(a) The preservability under light — The sample was exposed to sunlight for 60 days (use was made of an under glass outdoor exposure stand).

(b) The preservability under heat in dark — The sample was kept at 80° C. and 70% RH for 30 days.

The dye image preservability was expressed by the percentage (%) of the density (D) after the test to the initial density $(D)_0=1.0$.

Results are shown in Table 2.

TABLE 2

| Sample No. | Maximum density Y | Maximum density M | Maximum density C | Preservability under light (%) Y | Preservability under light (%) M | Preservability under light (%) C | Preservability under heat in dark (%) Y | Preservability under heat in dark (%) M | Preservability under heat in dark (%) C | Remarks |
|---|---|---|---|---|---|---|---|---|---|---|
| 100 | 2.31 | 2.36 | 2.35 | 89 | 90 | 89 | 91 | 94 | 89 | This Invention |
| 101 | 2.33 | 2.35 | 2.34 | 87 | 91 | 89 | 95 | 95 | 89 | This Invention |
| 102 | 2.31 | 2.35 | 2.35 | 90 | 92 | 89 | 96 | 97 | 91 | This Invention |
| 103 | 2.34 | 2.37 | 2.36 | 87 | 92 | 89 | 94 | 98 | 91 | This Invention |
| 104 | 2.31 | 2.34 | 2.35 | 90 | 90 | 91 | 92 | 96 | 92 | This Invention |
| 105 | 2.35 | 2.36 | 2.34 | 90 | 92 | 88 | 94 | 97 | 91 | This Invention |
| 106 | 2.30 | 2.35 | 2.33 | 88 | 92 | 91 | 92 | 97 | 89 | This Invention |
| 107 | 2.36 | 2.36 | 2.36 | 86 | 91 | 90 | 95 | 94 | 93 | This Invention |
| 108 | 2.36 | 2.34 | 2.37 | 89 | 93 | 90 | 91 | 97 | 90 | This Invention |
| 109 | 2.34 | 2.34 | 2.35 | 91 | 89 | 90 | 93 | 96 | 90 | This Invention |
| 110 | 2.32 | 2.34 | 2.35 | 88 | 90 | 88 | 92 | 94 | 89 | This Invention |
| 111 | 2.35 | 2.33 | 2.36 | 92 | 92 | 90 | 96 | 95 | 92 | This Invention |
| 112 | 2.34 | 2.36 | 2.36 | 91 | 91 | 90 | 93 | 96 | 93 | This Invention |
| 113 | 2.32 | 2.34 | 2.36 | 91 | 91 | 89 | 95 | 96 | 90 | This Invention |
| 114 | 2 34 | 2.35 | 2.36 | 89 | 91 | 90 | 94 | 96 | 92 | This Invention |

TABLE 2-continued

| Sample No. | Maximum density Y | M | C | Preservability under light (%) Y | M | C | Preservability under heat in dark (%) Y | M | C | Remarks |
|---|---|---|---|---|---|---|---|---|---|---|
| 115 | 2.37 | 2.33 | 2 35 | 92 | 92 | 91 | 97 | 97 | 90 | This Invention |
| 116 | 2.37 | 2.35 | 2.38 | 91 | 93 | 91 | 95 | 96 | 94 | This Invention |
| 117 | 2 34 | 2.24 | 2.37 | 89 | 90 | 90 | 94 | 95 | 90 | This Invention |
| 118 | 2.36 | 2.35 | 2.35 | 89 | 91 | 91 | 97 | 96 | 94 | This Invention |
| 119 | 2.35 | 2.38 | 2.36 | 91 | 91 | 90 | 91 | 95 | 91 | This Invention |
| 120 | 2.36 | 2.33 | 2.38 | 92 | 92 | 91 | 95 | 97 | 90 | This Invention |
| 121 | 2.38 | 2.34 | 2.38 | 91 | 90 | 89 | 94 | 96 | 91 | This Invention |
| 122 | 2.35 | 2.33 | 2.36 | 90 | 90 | 91 | 97 | 98 | 88 | This Invention |
| 123 | 2.37 | 2.35 | 2.35 | 81 | 91 | 92 | 80 | 95 | 92 | Comparison |
| 124 | 2.25 | 2.34 | 2.35 | 82 | 90 | 89 | 87 | 90 | 90 | " |
| 125 | 2.32 | 2.35 | 2.33 | 85 | 91 | 91 | 81 | 98 | 93 | " |
| 126 | 2.26 | 2.34 | 2.34 | 87 | 91 | 90 | 82 | 97 | 91 | " |
| 127 | 2.28 | 2.34 | 2.35 | 83 | 91 | 88 | 82 | 96 | 90 | " |
| 128 | 2.38 | 2.35 | 2.35 | 81 | 90 | 89 | 78 | 97 | 91 | " |
| 129 | 2.39 | 2.33 | 2.34 | 82 | 92 | 89 | 76 | 98 | 92 | " |
| 130 | 2.37 | 2.36 | 2.35 | 80 | 91 | 89 | 80 | 95 | 91 | " |
| 131 | 2.39 | 2.37 | 2.34 | 84 | 92 | 87 | 81 | 96 | 92 | " |
| 132 | 2.31 | 2.34 | 2.37 | 84 | 93 | 91 | 82 | 97 | 91 | " |
| 133 | 2.29 | 2.33 | 2.38 | 86 | 89 | 88 | 81 | 96 | 90 | " |
| 134 | 2.33 | 2.34 | 2.35 | 85 | 91 | 92 | 84 | 98 | 89 | " |
| 135 | 2.28 | 2.34 | 2.36 | 84 | 90 | 91 | 85 | 95 | 93 | " |
| 136 | 2.32 | 2.35 | 2.34 | 86 | 91 | 90 | 82 | 97 | 91 | " |
| 137 | 2.31 | 2.34 | 2.34 | 81 | 92 | 92 | 85 | 98 | 94 | " |
| 138 | 2.30 | 2.35 | 2.33 | 82 | 90 | 89 | 84 | 97 | 90 | " |
| 139 | 2.28 | 2.33 | 2.36 | 80 | 92 | 89 | 90 | 96 | 91 | " |
| 140 | 2.30 | 2.36 | 2.34 | 84 | 89 | 88 | 84 | 97 | 90 | " |
| 141 | 2.28 | 2.32 | 2.33 | 79 | 93 | 90 | 82 | 98 | 93 | " |
| 142 | 2.29 | 2.37 | 2.36 | 86 | 90 | 88 | 83 | 95 | 90 | " |
| 143 | 2.30 | 2.36 | 2.33 | 85 | 93 | 88 | 82 | 96 | 93 | " |

As is apparent from the results in Table 2, it was found that in the case of samples (100 to 122) of the present invention, the preservability of image under light and the preservability of image under heat in dark are improved and the color balance is kept good over the period of the storage in comparison with the case of samples (123 to 143) wherein a comparative coupler was used or a compound represented by formula (IV) was not used. Further the paper processing solution after the continuous processing (running test) where the color developer was replenished in an amount twice as much as the tank volume was used to process these samples, they were tested in the same way as above, and effects similar to the above effects were observed.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having photosensitive layers of yellow color-forming layer, magenta color-forming layer, and cyan color-forming layer, and non-photosensitive layers adjacent to said photosensitive layers on a base, which comprises, in the said yellow color-forming photosensitive layer, at least one coupler selected from an acylacetamide yellow dye-forming coupler represented by the following formula (I), a nondiffusible yellow dye-forming coupler represented by the following formula (II), and a nondiffusible yellow dye-forming coupler represented by the following formula (III), and in at least one layer selected from yellow color-forming photosensitive layers and non-photosensitive layers adjacent thereto, at least one compound represented by the following formula (IV):

Formula (I)

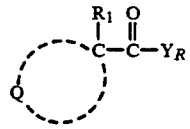

wherein $R^1$ represents a monovalent group, Q represents a group of non-metallic atoms required to form together with the C a substituted or unsubstituted 3- to 5-membered cyclic hydrocarbon group or a substituted or unsubstituted 3- to 5-membered heterocyclic group that has in the group at least one heteroatom selected from a group consisting of N, S, O, and P, and $Y_R$ represents a residue remaining after removing the acyl group

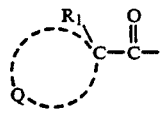

at the α position of the acetamide moiety from the acylacetamide yellow dye-forming coupler represented by formula (I), provided that $R_1$ is not a hydrogen atom and does not bond to Q to form a ring, Formula (II)

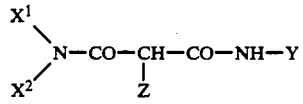

Formula (III)

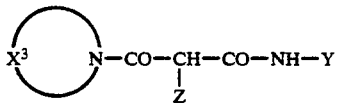

wherein $X^1$ and $X^2$ each represent an alkyl group, an aryl group, or a heterocyclic group, $X^3$ represents an organic residue required to form a nitrogen-containing heterocyclic group together with the >N—, Y represents an aryl group or a heterocyclic group, and Z represents a group capable of being released upon a coupling reaction of the coupler represented by said formula with the oxidized product of a developing agent, Formula (IV)

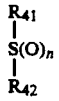

wherein $R_{41}$ represents a hydrogen atom, a substituted or unsubstituted alkyl group, a substituted or unsubstituted aryl group, a substituted or unsubstituted alkenyl group, or a substituted or unsubstituted heterocyclic group; $R_{42}$ represents a substituted or unsubstituted alkyl group, a substituted or unsubstituted aryl group, a substituted or unsubstituted alkenyl group, or a substituted or unsubstituted heterocyclic group, and n is an integer of 0 to 4, provided that $R_{41}$ and $R_{42}$ may together form a 5- to 7-membered ring.

2. The silver halide color photographic material as claimed in claim 1, wherein the acylacetamide yellow dye-forming coupler is selected from a compound represented by the following formula (I-A):

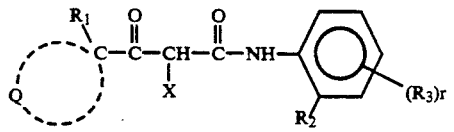

wherein $R_1$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, O, S, and P; $R_2$ represents a hydrogen atom, a halogen atom, an alkoxy group, an aryloxy group, an alkyl group, or an amino group, $R_3$ represents a group capable of substitution onto a benzene ring, X represents a hydrogen atom or a group capable of being released upon a coupling reaction thereof with the oxidized product of an aromatic primary amine developing agent, r is an integer of 0 to 4, and when r is 2 or more, the $R_3$ groups may be the same or different.

3. The silver halide color photographic material as claimed in claim 1, wherein $R_1$ in formula (I) is a halogen atom or an alkyl group.

4. The silver halide color photographic material as claimed in claim 1, wherein the ring formed by Q together with the C in formula (I) is a substituted or unsubstituted 3-, 4-, or 5-membered cyclic hydrocarbon group.

5. The silver halide color photographic material as claimed in claim 1, wherein the ring formed by Q together with the C in formula (I) is a substituted or unsubstituted 3-membered cyclic hydrocarbon group.

6. The silver halide color photographic material as claimed in claim 2, wherein $R_2$ in formula (I-A) represent a chlorine atom, fluorine atom, an alkyl group, an alkoxy group, or an aryloxy group.

7. The silver halide color photographic material as claimed in claim 2, wherein $R_3$ in formula (I-A) represents a halogen atom, an alkoxy group, an alkoxycarbonyl group, an aryloxycarbonyl group, a carbonamido group, a sulfonamido group, a carbamoyl group, or a sulfamoyl group.

8. The silver halide color photographic material as claimed in claim 2, wherein X in formula (I-A) represents a heterocyclic group bonded to the coupling active site through the nitrogen atom or an aryloxy group.

9. The silver halide color photographic material as claimed in claim 1, wherein the nondiffusible yellow coupler represented by formula (II) or (III) is selected from the group consisting of compounds represented by the following formula (II-1), (III-1), or (III-2):

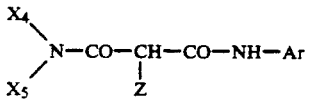

Formula (II-1)

-continued

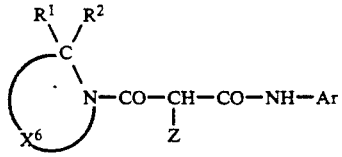

Formula (III-1)

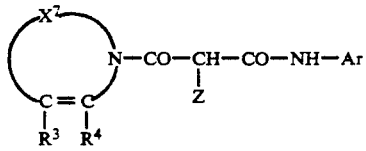

Formula (III-2)

wherein Z represents a group capable of being released upon a coupling reaction of the coupler represented by formula (II-1), (III-1), or (III-2) with the oxidized product of a developing agent, $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group together with the $—C(R^1R^2)—N<$, $X^7$ represents an organic residue required to form a nitrogen-containing heterocyclic group together with the $—C(R^3)=C(R^4)—N<$, and $R^1$, $R^2$, $R^3$, and $R^4$ each represent a hydrogen atom or a substituent, $R^3$ and $R^4$ may bond together to form a ring.

10. The silver halide color photographic material as claimed in claim 1, wherein $X^1$ or $X^2$ in formula (II) is an alkyl group having 1 to 10 carbon atoms.

11. The silver halide color photographic material as claimed in claim 1, wherein Y in formulas (II) and (III) is a phenyl group having at least one substituent on the ortho position thereof.

12. The silver halide color photographic material as claimed in claim 1, wherein Z in formulas (II) and (III) is a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

13. The silver halide color photographic material as claimed in claim 1, wherein the coupler represented by formula (II) or (III) forms a dimer or higher polymer by bonding at the groups represented by $X^1$ to $X^3$, Y, and Z through a divalent group or more higher polyvalent group.

14. The silver halide color photographic material as claimed in claim 1, wherein the coupler represented by formula (I), (II), or (III) is contained in the range of 0.1 to 1.0 mol per mol of the silver halide in the layer where the yellow coupler is used.

15. The silver halide color photographic material as claimed in claim 1, wherein the alkyl group represented by $R_{41}$ or $R_{42}$ in formula (IV) is selected from the group consisting of alkyl groups having 1 to 24 carbon atoms.

16. The silver halide color photographic material as claimed in claim 1, wherein the cycloalkyl group represented by $R_{41}$ or $R_{42}$ in formula (IV) is selected from the group consisting of cycloalkyl groups having 5 to 24 carbon atoms.

17. The silver halide color photographic material as claimed in claim 1, wherein the alkenyl group represented by $R_{41}$ or $R_{42}$ in formula (IV) is selected from the group consisting of alkenyl groups having 3 to 24 carbon atoms.

18. The silver halide color photographic material as claimed in claim 1, wherein the aryl group represented by $R_{41}$ or $R_{42}$ in formula (IV) is selected from the group consisting of a phenyl group, a spiroindane ring group, a chroman ring group, and a naphthyl group.

19. The silver halide color photographic material as claimed in claim 1, wherein the heterocyclic group represented by $R_{41}$ or $R_{42}$ in formula (IV) is selected from the group consisting of a pyridyl group, an imidazolyl group, a tetrazolyl group, an oxazolyl group, a thiazolyl group, a benzimidazolyl group, a benzthiazolyl group, a benzoxazolyl group, a pyrimidyl group, an indolyl group, a pyrrolyl group, a pyrazolyl group, a purinyl group, a quinolyl group, an isooxazolyl group, an oxadiazolyl group, a thiadiazolyl group, a triazolyl group, a furyl group, and a succinimidoyl group.

20. The silver halide color photographic material as claimed in claim 1, wherein the compound represented by formula (IV) is used in an amount of 0.5 to 200 wt % based on the yellow coupler.

21. The silver halide color photographic material as claimed in claim 1, wherein the compound represented by formula (IV) is coemulsified with a yellow coupler represented by formulas (I), (II), or (III).

22. The silver halide color photographic material as claimed in claim 1, wherein the compound represented by formula (IV) is selected from the group consisting of compounds represented by the following formulas (IV-A), (IV-B), (IV-C), and (IV-D):

Formula (IV-A)

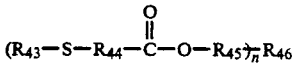

wherein n=1 or 4; when n=1, $R_{43}$ represent an alkoxycarbonylalkyl group, $R_{44}$ represents an alkylene group, $R_{45}$ represents a methylene group, and $R_{46}$ represents a hydrogen atom or an alkyl group having 1 to 19 carbon atoms, and $R_{43}$ may be the same as the group represented by one of $R_{44}$ to $R_{46}$; and when n=4, $R_{43}$ represents an alkyl group having 1 to 20 carbon atoms, $R_{44}$ represents an alkylene group, $R_{45}$ represents an alkylene group or an arylene group, and $R_{46}$ represents a carbon atom, Formula (IV-B)

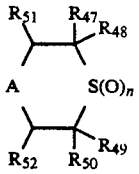

-continued wherein $R_{48}$ and $R_{49}$ each represent a hydrogen atom or an alkyl group, $R_{47}$ and $R_{50}$ each represent a hydrogen atom, an alkyl group, an aryl group, or a heterocyclic group, $R_{51}$ and $R_{52}$ each represent a hydrogen atom, an alkyl group, an aryl group, an acyl group, or an alkoxycarbonyl group, n is an integer of 0 to 2, and A represents a divalent group to form a sulfur-containing 5- to 7-membered ring, Formula (IV-C)

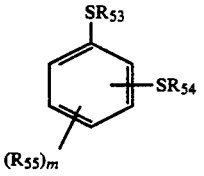

wherein $R_{53}$ and $R_{54}$ each represent an alkyl group, an alkenyl group, a cycloalkyl group, a hetero group, or an acyl group, $R_{55}$ represents a halogen atom, an alkyl group, an aryl group, an alkylthio group, an arylthio group, an amino group, an alkylamino group, an arylamino group, an acylamino group, a sulfonamido group, a ureido group, an acyl group, a carbamoyl group, an alkoxycarbonyl group, a sulfonyl group, a sulfamoyl group, a nitro group, a cyano group, or a carboxyl group, and m is an integer of 0 to 4, Formula (IV-D)

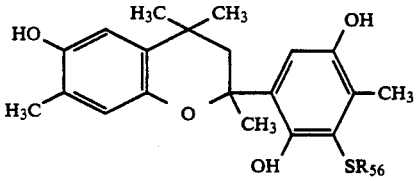

wherein $R_{56}$ represents a substituted or unsubstituted alkyl group having 1 to 24 carbon atoms.

23. The silver halide color photographic material as claimed in claim 1, wherein Z in formulae (II) and (III) is a non-photographically useful group.

24. The silver halide color photographic material as claimed in claim 9, wherein Z in formulae (II-1), (III-1), and (III-2) is a non-photographically useful group.

25. The silver halide color photographic material as claimed in claim 1, wherein Z in formulae (II) and (III) is a 5- to 6-membered nitrogen-containing heterocyclic group bonded to the coupling site through the nitrogen atom, or a 5- to 6-membered heterocyclic thio group.

* * * * *